US008192608B2

(12) United States Patent
Matthews

(10) Patent No.: US 8,192,608 B2
(45) Date of Patent: Jun. 5, 2012

(54) SYSTEM AND METHOD FOR ISOTOPE SEPARATION

(76) Inventor: Mehlin Dean Matthews, Saratoga, CA (US)

( * ) Notice: Subject to any disclaimer, the term of this patent is extended or adjusted under 35 U.S.C. 154(b) by 66 days.

(21) Appl. No.: 12/965,866

(22) Filed: Dec. 11, 2010

(65) Prior Publication Data

US 2011/0079516 A1 Apr. 7, 2011

Related U.S. Application Data

(63) Continuation of application No. 11/564,855, filed on Nov. 30, 2006, now Pat. No. 7,879,216, which is a continuation-in-part of application No. 11/439,932, filed on May 23, 2006, now Pat. No. 7,879,206.

(51) Int. Cl.
*C25B 1/00* (2006.01)
*C25D 1/00* (2006.01)

(52) U.S. Cl. ..... 205/339; 205/89; 204/229.5; 204/250

(58) Field of Classification Search ..... 205/339, 205/89

See application file for complete search history.

(56) References Cited

U.S. PATENT DOCUMENTS

| | | | | |
|---|---|---|---|---|
| 2,016,442 | A * | 10/1935 | Kilgus | 205/339 |
| 4,201,635 | A * | 5/1980 | Muller | 205/339 |
| 4,552,664 | A * | 11/1985 | Benner | 210/695 |
| 4,643,809 | A * | 2/1987 | Botts et al. | 204/155 |
| 6,277,265 | B1 * | 8/2001 | Hanak | 205/687 |
| 2004/0020785 | A1 * | 2/2004 | Minteer | 205/339 |
| 2004/0026253 | A1 * | 2/2004 | Leddy et al. | 205/50 |
| 2010/0209335 | A1 * | 8/2010 | Mills | 423/648.1 |

* cited by examiner

*Primary Examiner* — Harry D Wilkins, III
(74) *Attorney, Agent, or Firm* — M. Dean Matthews

(57) ABSTRACT

An anode and cathode for an electrolytic cell configured as a low inductance transmission line to enable control of an interphase at an electrode surface. The anode and cathode are coupled to a switched current source by a low inductance path that includes a parallel plate transmission line, a coaxial transmission line, or both. The switched current source provides fast switching between current sources to provide fast charging and discharging of the double-layer capacitance associated with the electrode surface so that an isotope may be selectively transported to the electrode surface for oxidation or reduction. A photon source may be used to create a population of isotope containing species within the electrolyte. An additional static magnetic field and/or an alternating current magnetic excitation source may be used to modify the composition of the population of species containing the isotope to be separated.

20 Claims, 74 Drawing Sheets

300

SYSTEM AND METHOD FOR ISOTOPE SEPARATION

RELATED U.S. PATENT APPLICATION

This patent application is a continuation of U.S. application Ser. No. 11/564,855, filed Nov. 30, 2006 now U.S. Pat. No. 7,879,216, which is a continuation-in-part of U.S. application Ser. No. 11/439,932, filed May 23, 2006 now U.S. Pat. No. 7,879,206; all by the same Inventor.

BACKGROUND OF THE INVENTION

1. Field of the Invention

This invention relates to the separation of isotopes. In particular, the invention relates to the separation of isotopes by pulsed electrolysis using the mass isotope effect and the magnetic isotope effect.

2. Description of Related Art

Isotope separation may be used to isolate a single isotope, or may be used to enrich a mixture of isotopes with respect to one or more isotopes in the mixture. The difference in physicochemical behavior between isotopes allows a variety of processes to be used for their separation. Commercially, the most important application of isotope separation is the enrichment of uranium. In order to be useful as a fuel for nuclear reactors, uranium must typically be enriched in $^{235}U$ from a natural concentration of 0.7% to a concentration greater than about 2.5%.

Due to the relatively small difference in mass between $^{235}U$ and $^{238}U$ the enrichment of uranium is a difficult process. Although many processes have been demonstrated (e.g., laser separation) commercially viable enrichment is largely limited to centrifuge and diffusion techniques that employ uranium hexafluoride vapor as the working material.

Historically, gaseous diffusion has been the dominant process for uranium enrichment; however, the process is energy intensive and the gas centrifuge technique has been developed as a more energy efficient alternative. Although more efficient, centrifuges have the disadvantage of having a limited lifespan due to the high operational stresses to which they are exposed. Both diffusion and centrifuge techniques rely on the mass isotope effect.

Experimentally, the magnetic isotope effect has been shown to have potential as a basis for a separation process; however, with respect to uranium, commercialization has not been achieved. For many elements, the magnetic isotope effect has a greater potential for isotope separation than the mass isotope effect; however, problems such as isotope scrambling due to isotope exchange reactions have not been overcome. In order to minimize the deleterious effects of isotope exchange reactions, it is desirable to extract the products as soon as possible after formation. The prior art typically does not provide for rapid product extraction (e.g., less than one second).

Among the prior art techniques for isotope separation, one of the oldest is direct current electrolysis. Johnson and Hutchison, Urey, and others have demonstrated electrolytic reduction of lithium at a mercury cathode in both aqueous and non-aqueous electrolytes. More recently, isotope fractionation of iron has been disclosed by Kavner et al.

The boundary between a liquid electrolyte and an electrode typically has an associated region in the electrolyte adjacent to the electrode that separates the electrode from the bulk electrolyte. This region is often referred to as an interphase. Because of the influence of the electrode surface, the interphase has a composition that is different from the bulk electrolyte. The orientation of molecular dipoles and the concentrations of cationic and anionic species typically differ from the bulk.

Prior Art FIG. 1A shows a representation 100 of an interface between a metal and an electrolyte solution. Such an interface generally becomes electrified, with a net charge developing at the surface of the metal and a near surface region of excess ion concentration developing in the electrolyte solution. In the example of FIG. 1A, the excess charge in the metal is negative and the near surface region of the electrolyte solution has an excess concentration of cations.

Prior Art FIG. 1B shows a diagram 101 of the potential that is developed by the charge separation at interface between the metal and the electrolyte solution. The near surface region of the electrolyte solution is characterized by a "double layer" that is composed of a compact layer and a diffuse layer. The compact layer (or Helmholtz layer) is a thin region adjacent to the surface that typically contains adsorbed ions and oriented dipoles. The Helmholtz layer is also often further divided into two layers defined by an inner Helmholtz plane (IHP) and an outer Helmholtz plane (OHP). A discussion on electrode/electrolyte interfaces and the interphase is presented in "Modern Electrochemistry, Vol 2A, Fundamentals of Electrodics, Second Edition," by Bockris et al, Klewer Academic/Plenum Publishers (2000).

The Helmholtz layer typically has a thickness that is on the order of a nanometer. The diffuse layer has a less well-defined thickness that is frequently characterized by the Debye length ($L_D$). For a 1:1 electrolyte the Debye length ($L_D$) is given as:

$$L_D = \frac{1}{ze}\sqrt{\frac{\varepsilon_r \varepsilon_0 kT}{2c_0}} = \frac{6.3\times10^{-11}}{z}\sqrt{\frac{\varepsilon_r T}{c_0}}$$

T, z, e, $\in_r$, $\in_0$, k and $c_0$ are the temperature (Kelvin), valence number, electron charge, solvent relative permittivity, permittivity of free space, Boltzmann constant, and bulk electrolyte concentration (moles/$m^3$), respectively. For water with a relative dielectric constant taken as 78 at a temperature of 298K, a copper sulfate electrolyte solution at a concentration of one mol/$m^3$ the diffuse layer has a calculated Debye length of about 10 nm. Due to the variability of the dielectric constant of the solvent close to the electrode and other phenomena, the calculated Debye length is only approximate, but it serves to illustrate the fine scale of the interphase in an electrolytic cell.

For redox reactions to occur at an electrode surface in an electrolytic cell, the reactants and products must traverse the interphase. The rates of reaction and the nature of the reaction products are thus influenced by the state of the interphase. A particularly important feature of the interphase is that large electric fields can be developed by the application of an electric potential.

When an electric potential is applied to an electrolytic cell, the interphase will adjust to the applied potential through a variety of mechanisms. Contact adsorbed ions may become dislodged and or replaced by counterions, molecular dipoles may change orientation, and the concentration profiles of cations and anions may change. The interphase differs from the bulk electrolyte in that an electric field can have a relatively greater influence on mass transport than diffusion. Although the interphase has been studied to a considerable extent, precise manipulation of the interphase has not been adopted on a manufacturing scale.

The speed at which an ion in an electrolyte solution will travel when subjected to an electric field depends in part upon the characteristics of the ion, the solvent, and the intensity of the electric field. Concentration and other factors may also influence the speed at which an ion travels. Due to the extremely short distances associated with the interphase, the adjustments that occur in the interphase in response to an applied potential can occur in a very short period, on the order of a microsecond or less. Thus, a potential waveform applied to an electrolytic cell that is intended to control the makeup of the interphase should be capable of providing precise potential levels and fast transitions between potential levels.

Ideally, a system for controlling the interphase will be able to produce a square pulse at the electrode surface with minimal rise time, overshoot, fall time, and undershoot. For industrial applications, the square pulse should be able to retain its characteristics when applied to large area electrodes. In order to achieve such a waveform at the electrode surface, all circuit elements in the current path should be considered.

Prior Art FIG. 2 shows a general schematic 200 for an equivalent circuit of an electrolytic cell. The schematic shows the resistive and reactive components of an electrochemical cell and its connections to a power supply. $C_{shunt}$ is the parasitic capacitance that exists between the connections to the two electrodes in the cell. $C_{shunt}$ is generally very small in comparison to the double layer capacitance presented by the electrochemical cell, and is only of concern for systems with extremely small electrodes.

$R_{C1}$ and $R_{C2}$ are the resistances associated with the leads connecting the electrodes to the power supply. For industrial applications in which hundreds of amps may be used at low working voltages, the magnitude of $R_{C1}$ and $R_{C2}$ is a matter of concern. Efforts are typically made to minimize conductor length and to provide sufficient cross-sectional area for the anticipated load. Copper bus bars or cables are widely used.

$L_{C1}$ and $L_{C2}$ are the inductances associated with the connections between the power supply and the electrodes, and are largely ignored in equipment intended for use at DC or low frequency. Even in equipment that is intended for applications such as reverse pulse plating, inductance is ignored to a considerable extent.

For example, U.S. Pat. No. 6,224,721, "Electroplating Apparatus," Nelson et al., issued May 1, 2001, discloses the use of a coaxial conductor as a means for reducing inductance in a portion of the electrical distribution system for a plating bath. The preferred conductor assembly disclosed by Nelson is a loose circular coaxial configuration in which a tape-wrapped inner cathode conductor is placed in an outer anode conductor. Although preferred, the inductance of the coaxial segment is still on the order of 100 nanohenries. Further, Nelson does not address the inductance of the electrochemical cell itself or the requirements for control of the interphase in the electrolytic cell.

$L_{EL1}$ and $L_{EL2}$ are the inductances associated with the electrodes that are in contact with the electrolyte. The electrode inductance in industrial electrolytic cells is largely ignored, with factors such as current distribution and areal configuration taking precedence. $R_{EL1}$ and $R_{EL2}$ are the resistances associated with the electrodes that are in contact with the electrolyte. Typically, $R_{EL1}$ and $R_{EL2}$ are small compared to the resistance of the bulk electrolyte ($R_{BE}$). For non-metallic electrode materials such as carbon or ceramic, resistance may influence design for use with high-conductivity electrolytes.

$C_{DL1}$ and $C_{DL2}$ are the double-layer capacitances associated with the electrodes that are in contact with the electrolyte. $C_{DL1}$ and $C_{DL2}$ can be quite large, but are seldom a concern for low frequency or DC electrodeposition systems. Although $C_{DL1}$ and $C_{DL2}$ can be adjusted, electrode shape and electrolyte composition are usually determined by other factors, with $C_{DL1}$ and $C_{DL2}$ being tolerated as an inevitable nuisance. In contrast to electrodeposition systems, a large $C_{DL1}$ and $C_{DL2}$ may be designed into electrochemical energy storage systems.

$Z_{F1}$ and $Z_{F2}$ are faradaic impedances associated with the charge transfer involved in redox reactions at the electrode surfaces. $Z_{F1}$ and $Z_{F2}$ are nonlinear, and dependent upon the electrode potential, nature, and concentration of the reactive species. In some respects, a faradaic impedance resembles the behavior of a reverse-biased diode, with a redox reaction potential being analogous to a breakdown voltage.

$L_{BE}$ and $R_{BE}$ are the inductance and resistance of the bulk electrolyte, respectively. $L_{BE}$ is largely ignored in the design of electrolytic cells. The current distribution and nature of the charge carriers in an electrolyte volume can be altered to adjust $L_{BE}$, but they are usually adjusted in light of other design considerations. It is generally desired that $R_{BE}$ have a low value to reduce ohmic losses, and electrolyte composition often takes $R_{BE}$ into account. For example, sulfuric acid may be added to copper sulfate plating baths to reduce $R_{BE}$.

Systems for instrumentation and analysis typically use relatively small electrodes and thus handle relatively small currents. The switching of small currents does not produce large voltage transients and the compact size of instruments serves to provide an inherent limit on inductance. Analytical electrochemical systems have also shown a trend toward ultramicroelectrodes (UMEs) in order to avoid problems in dealing with double-layer capacitance. The prior art instrumentation approach of using miniaturization to deal with reactive circuit elements is of little use for systems that are to be scaled for manufacturing processes.

During direct current electrolytic isotope separation, equilibrium conditions are established in the interphase in a very short time, and a natural consequence of a high reaction rate for one isotope at the electrode surface is a relative increase in concentration at the surface for the slower-reacting isotope. This increase in relative concentration limits the separation factor that can be achieved under direct current conditions.

In general, stirring of the bulk is not effective for disturbing the electrolyte layer adjacent to the electrode surface, and although hydrogen evolution is capable of producing local stirring, it has disadvantages. In order to achieve an enhanced electrolytic isotope separation factor, the interphase must be modified in a controlled fashion so that the limiting effect of preferred species depletion can be avoided.

Thus, there is a need for an electrolytic system and method that will provide for the selective oxidation/reduction of isotopes. There is also a need for an electrolytic system that is capable of employing the magnetic isotope effect and providing for rapid product extraction to minimize isotope scrambling due to exchange reactions.

BRIEF SUMMARY OF THE INVENTION

Accordingly, a system for electrolytic isotope separation is described herein. A sequence of rapid pulses is applied to an electrode for selectively attracting species to an electrode for participation in a redox reaction.

In an embodiment of the present invention, an exclusion pulse is applied to an electrode to create a depletion zone adjacent to the electrode. The exclusion pulse increases the mean separation between the reactive isotope species and the electrode surface. An extraction pulse of opposite polarity is subsequently applied to attract anionic or cationic species to the electrode for participation in a redox reaction. In a particular embodiment, the reaction pulse is of short enough duration so that the reactive isotope concentration ratio is kept above the direct current electrolysis equilibrium value at the electrode surface.

In another embodiment of the present invention the electrode surface is fabricated with a liquid metal, allowing reduced species to be absorbed into the electrode surface. The liquid metal electrode surface may be stabilized by a perforated cover plate.

In an additional embodiment, a magnet is provided so that a static magnetic field is established in the interphase region adjacent to the electrode. A permanent magnet or an electromagnet may be used. The magnetic field may be used to adjust the spin conversion of reactant and product species associated with a photochemical reaction. An alternating magnetic field may also be applied, alone or in concert with a static magnetic field.

In yet another embodiment of the present invention, the isotopes being separated are uranium isotopes. The electrolyte may be molten salt, an aprotic solvent, or a room temperature ionic liquid (RTIL). Photolysis may be used in combination with the magnetic isotope effect to produce uranium complexes that may be selectively reduced or oxidized.

BRIEF DESCRIPTION OF THE DRAWINGS

Prior Art

Prior Art

Prior Art

FIG. 73 shows a perspective view of a solid dielectric coaxial anode/cathode assembly attached to a parallel plate transmission line in accordance with an embodiment of the present invention.

DETAILED DESCRIPTION OF THE INVENTION

Figure 1B:
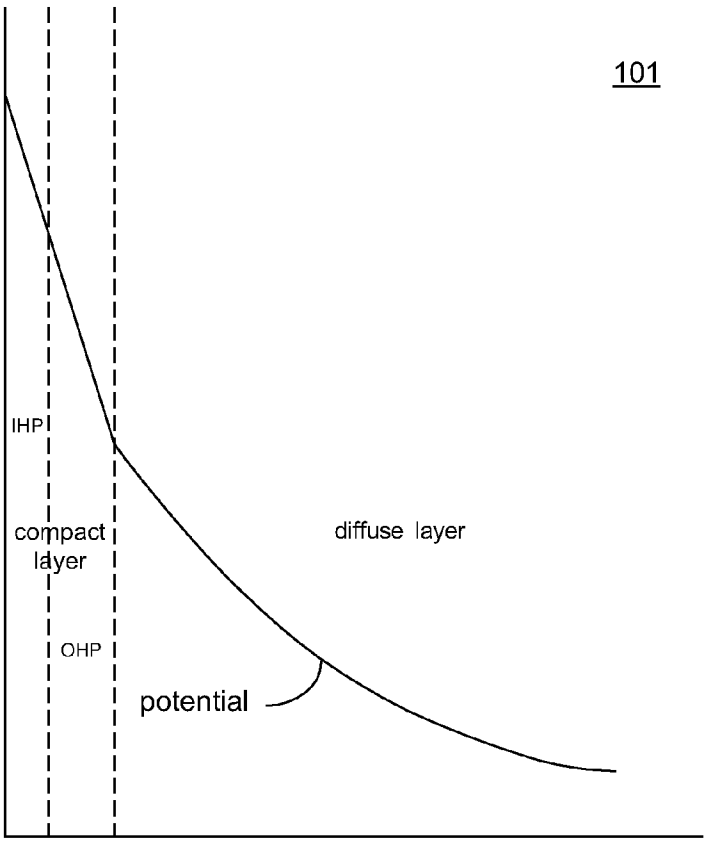
FIG. 1B (Prior Art)
FIG. 1B shows an electric potential diagram for an interphase at an electrode surface.
Figure 1A:
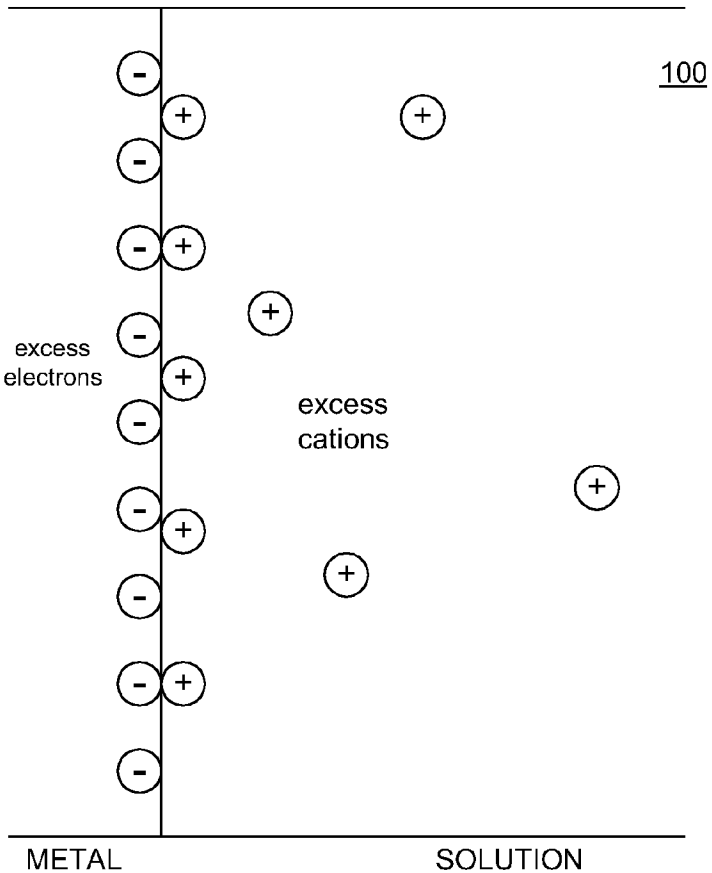
FIG. 1A (Prior Art)
FIG. 1A depicts a double layer at an electrode surface.
Figure 2:
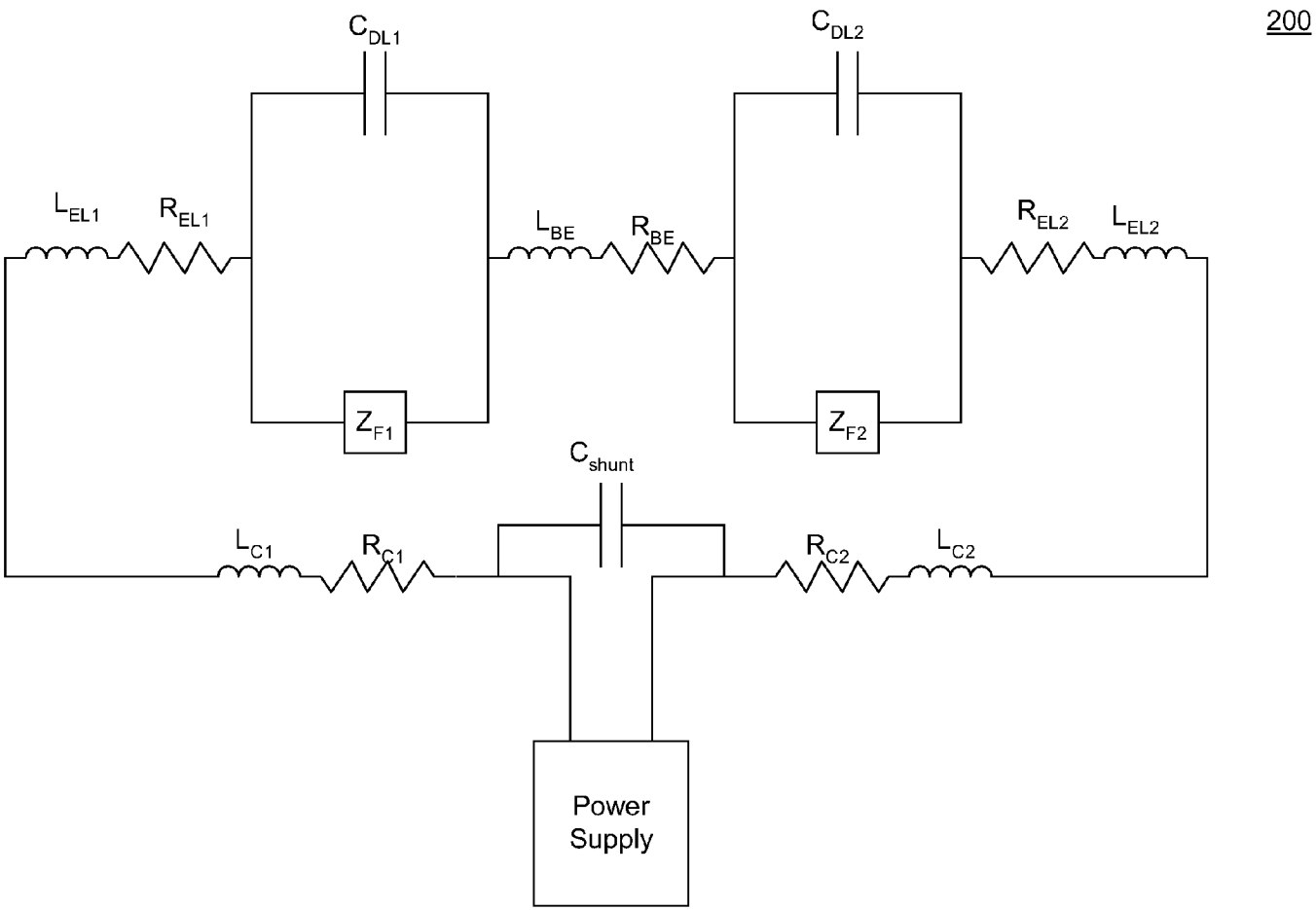
FIG. 2 (Prior Art)
FIG. 2 shows a general schematic for the equivalent circuit of an electrolytic cell.
Figure 3A:
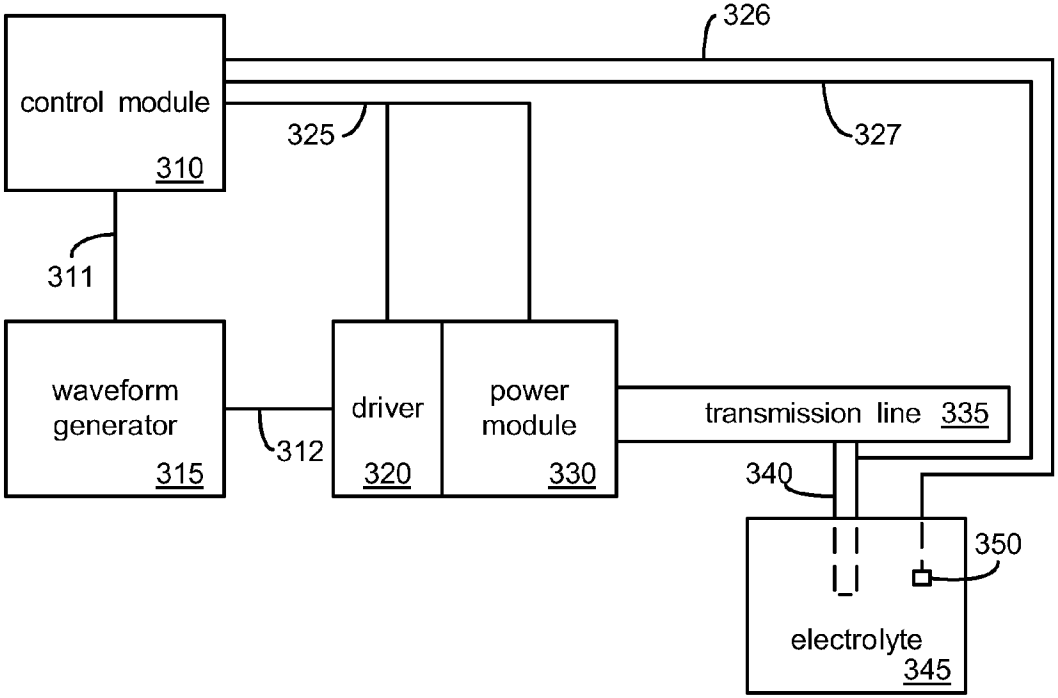
FIG. 3A shows a block diagram of an electrolytic cell interphase control system in accordance with an embodiment of the present invention.

FIG. 3A shows a block diagram 300 of an embodiment of an electrolytic cell interphase control system. A bus 311 couples a control module 310 to a waveform generator 315. The control module 310 transmits signals to the waveform generator 315 that set the parameters of an output waveform (e.g., duty cycle, amplitude, and period). The bus 311 may also provide feedback to the control module 310 with respect to the output of the waveform generator 315. The output waveform of the waveform generator 315 may include a unipolar signal that has a positive excursion referenced to ground and/or a bipolar signal with positive and negative excursions.

The waveform generator 315 is coupled to a driver 320 by a signal bus 312. The bus 312 may couple two nodes and carry a single waveform as the output of the waveform generator 315, or it may carry a number of distinct signals between more than two nodes. In a preferred embodiment the driver 320 is driven by an input signal in the range of 1-10 volts and has output rise and fall times of less than 50 nanoseconds. The driver 320 is coupled to the control module 310 by a bus 325 that allows the control module 310 to monitor the driver output and/or control the supply voltage for the driver 320.

The driver 320 is coupled to a power module 330 that is essentially a switched current supply that provides current to an electrode assembly 340 via a transmission line 335. The power module may include N-channel and/or P-channel MOSFETs (metal-oxide semiconductor field-effect transistors). In a preferred embodiment the power module includes multiple selectively switched MOSFETs coupled to three or more supply voltages. The power module 330 is coupled to the control module 310 by bus 325, allowing for control of the supply voltages to the MOSFETs. A bus 327 may be used to provide feedback to the control module 310 from the electrode assembly 340.

In addition to MOSFETs, JFETs (junction field effect transistors), BJTs (bipolar junction transistors), and IGBTs (insulated-gate bipolar transistors) may be used as switches in the power module 330. Generally, the turn-off speed of silicon BJTs and IGBTs is inferior to that of silicon MOSFETs. However, BJTs using materials such as gallium arsenide and indium phosphide and employing heterojunction structures can provide considerable improvements over silicon BJTs. JFETs may be preferred for low voltage applications.

The transmission line 335 is preferably a coaxial transmission line or a parallel plate transmission line, or may be a combination of the two. In a preferred embodiment, the gap between conductors in the transmission line is substantially filled with a solid dielectric. It is desirable that the two conductors be restrained from moving under the influence of the magnetic fields generated by the current flowing through them. If the two conductors are able to respond to the magnetic fields that are generated, they may act as an electromechanical transducer that presents a variable load to the power module 330, thus altering the waveform at the electrode surface. For coaxial conductors, a displacement of the axis of the center conductor with respect to the axis of the outer conductor does not affect the DC inductance; however, it can affect the inductance at high frequencies.

For purposes of this disclosure, a statically configured transmission line is defined as a restrained pair of conductors configured as a transmission line with a sufficiently small spacing between them such that if they were not restrained, one or both conductors would experience a displacement as a result of the electromagnetic force generated by an operational current flowing through the pair of conductors. Operational current is defined as a current that would flow through the conductors during normal operation.

The electrode assembly 340 is preferably a transmission line structure, with the anode and cathode serving as the two conductors in the transmission line in contact with electrolyte 345. In one embodiment, the gap between the anode and cathode is substantially filled with a solid dielectric. In another embodiment, the gap between the anode and cathode is substantially filled with electrolyte 345. Frequent reference will be made in this specification to an "electrode assembly" or an "anode/cathode assembly" with two electrodes. Unless specifically stated otherwise, either of the two electrodes may serve as anode or cathode, with a reference to one designation implying the substitution of the other as an alternative embodiment.

For purposes of this disclosure, an "electrode" is a conductor that is intended to be used in contact with an electrolyte, and may be either an anode or a cathode. A "bus" is a conductor that may be used to couple an electrode to a power source or signal source, but is itself not intended to be used in contact with an electrolyte. A "transmission line" may refer to either a parallel plate transmission line or a coaxial transmission line.

For purposes of this disclosure, in reference to a parallel plate transmission line, a preferred but not exclusive embodiment thereof is a pair of substantially flat rectangular conductors that have a spacing s and a width w such that the inductance per unit length L in Henries/meter is approximated by the equation:

$$L = 4\pi \times 10^{-7}\left(\frac{s}{w}\right)$$

In general, there are a number of spatial arrangements of conductors that can be used for transmission lines, such as parallel wires, parallel plates, and coaxial conductors. For purposes of this disclosure, in reference to a transmission line, a preferred but not exclusive embodiment thereof includes a spatial arrangement of conductors that is mechanically fixed to maintain the spatial arrangement under load.

Electrolyte 345 may be an aqueous or nonaqueous solvent containing dissolved ions. A nonaqueous solvent may be an aprotic solvent. The electrolyte 345 may include one or more molten salts such as an alkali metal fluoride or chloride. Electrolyte 345 may also include an ionic material that is a liquid at room temperature. In contrast to electrochemical energy storage devices, which may have closely spaced planar electrodes, the volume of electrolyte 345 in contact with the electrode assembly 340 is typically larger than the volume between the electrodes. An electrolytic cell that is used for a manufacturing process requires access to reactant species to replace those converted to product species.

For purposes of this disclosure, the term "accessible electrolyte volume" refers to the volume of electrolyte in an electrolytic cell that is in electrical contact with the anode and cathode. In a preferred embodiment for parallel plate or coaxial transmission line electrode assemblies, the accessible electrolyte volume is at least ten times greater than the volume swept out by the projection of one electrode onto the other.

A sensor 350 is in contact with the electrolyte 345 and coupled to the Control Module 310 by bus 326. Sensor 350 may be a reference electrode, temperature sensor or resistance measurement cell. Sensor 350 provides information feedback for process control by the Control Module 310.

Sensor 350 may provide information concurrent with the output of power module 330, or the output of power Module 330 may be suspended while Sensor 350 is operational.

Figure 3B:
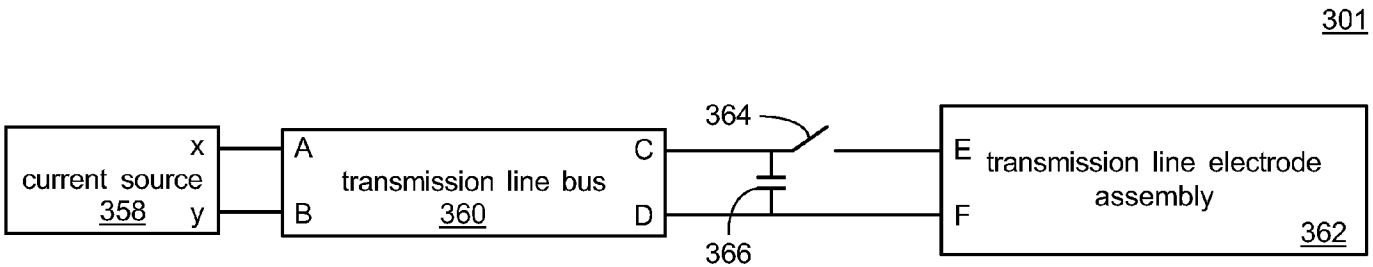
FIG. 3B shows a diagram of an interphase control circuit with a single-switched transmission line electrode assembly in accordance with an embodiment of the present invention.

FIG. 3B shows a diagram 301 of an interphase control circuit with a single-switched transmission line electrode assembly 362. Terminal F of transmission line electrode assembly 362 is coupled to terminal D of transmission line bus 360. Terminal E of transmission line electrode assembly 362 is coupled to terminal C of transmission line bus 360 by a switch 364. A bypass capacitor 366 couples terminal C of transmission line bus 360 to terminal F of transmission line electrode assembly 362 and to terminal D of transmission line bus 360. Bypass capacitor 366 is not required but is preferred for circuits in which large currents are switched. Terminals x and y of current source 358 are coupled to terminals A and B, respectively, of transmission line bus 360.

Figure 3C:
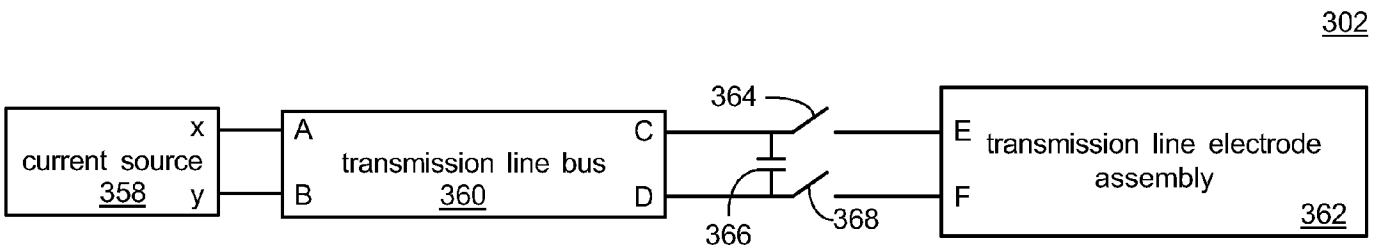
FIG. 3C shows a diagram of an interphase control circuit with a double-switched transmission line electrode assembly in accordance with an embodiment of the present invention.

FIG. 3C shows a diagram 302 of an interphase control circuit with a double-switched transmission line electrode assembly 362. Terminal F of transmission line electrode assembly 362 is coupled to terminal D of transmission line bus 360 by a switch 368. Terminal E of transmission line electrode assembly 362 is coupled to terminal C of transmission line bus 360 by a switch 364. A bypass capacitor 366 couples terminal C of transmission line bus 360 to terminal D of transmission line bus 360. Terminals x and y of current source 358 are coupled to terminals A and B, respectively, of transmission line bus 360.

Figure 3D:
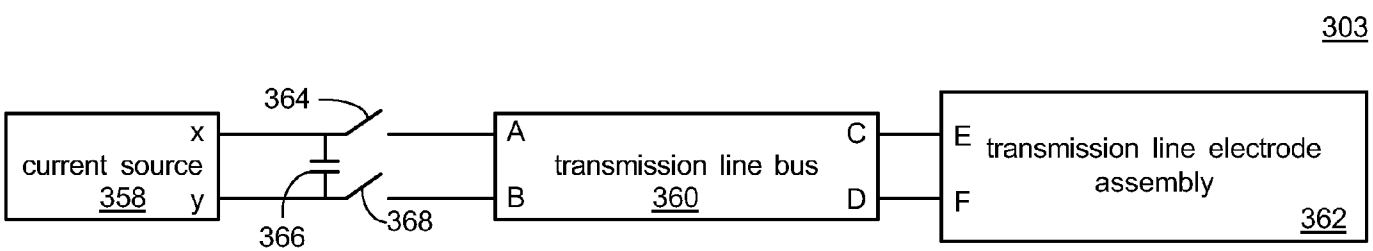
FIG. 3D shows a diagram of an interphase control circuit with a double-switched transmission line bus in accordance with an embodiment of the present invention.

FIG. 3D shows a diagram 303 of an interphase control circuit with a double-switched transmission line bus 360, Terminals A and B of transmission line bus 360 are coupled to terminals x and y of current source 358 by switches 364 and 368, respectively. Terminals E and F of transmission line electrode assembly 362 are coupled to terminals C and D, respectively, of transmission line bus 360. A bypass capacitor 366 couples terminals x and y of current source 358.

Figure 3E:
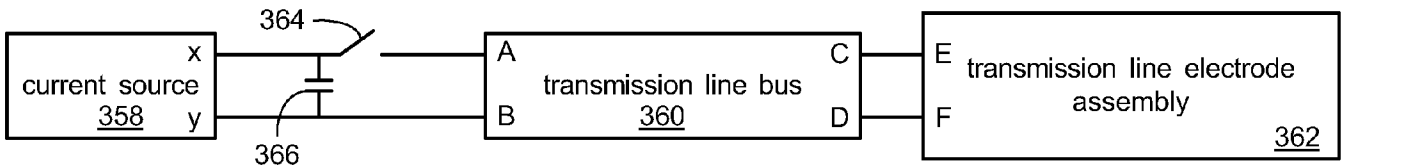
FIG. 3E shows a diagram of an interphase control circuit with a single-switched transmission line bus in accordance with an embodiment of the present invention.

FIG. 3E shows a diagram 304 of an interphase control circuit with a single-switched transmission line bus 360. Terminal A of transmission line bus 360 is coupled to terminal x of current source 358 by switch 364. Terminal B of transmission line bus 360 is coupled to terminal y of current source 358. Terminals E and F of transmission line electrode assembly 362 are coupled to terminals C and D, respectively, of transmission line bus 360. A bypass capacitor 366 couples terminals x and y of current source 358.

Figure 3F:
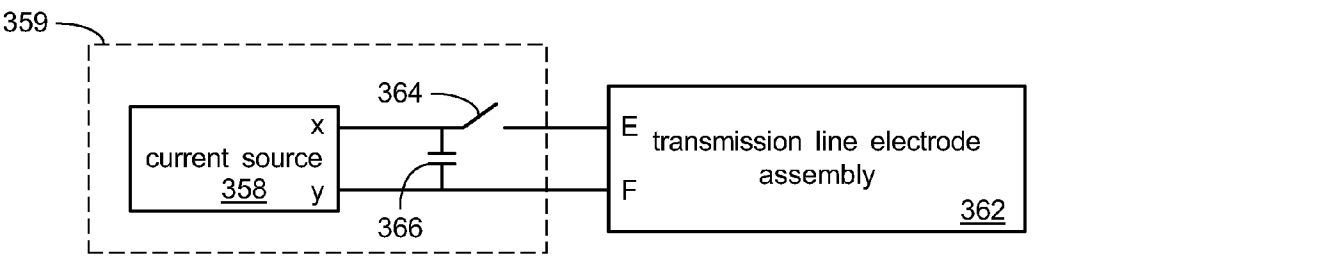
FIG. 3F shows a diagram of an interphase control circuit with a single-switched power supply in accordance with an embodiment of the present invention.

FIG. 3F shows a diagram 305 of a transmission line electrode assembly 362 with a single-switched current source 358. Terminal E of transmission line electrode assembly 362 is coupled to terminal x of current source 358 by switch 364 and terminal F of transmission line electrode assembly 362 is coupled to terminal x of current source 358. A bypass capacitor 366 is coupled to terminals x and y of current source 358. Switch 364, capacitor 366 and current source 358 may be combined into an integrated power supply 359.

Figure 3G:
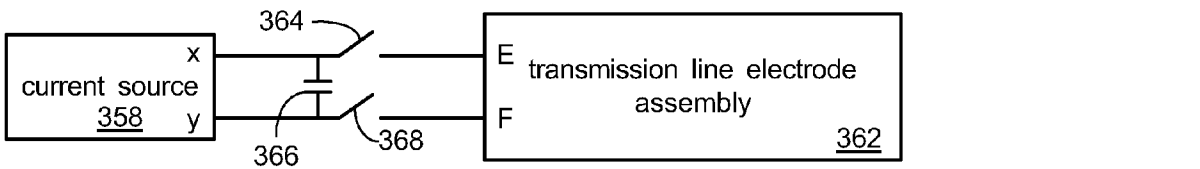
FIG. 3G shows a diagram of an interphase control circuit with a double-switched power supply in accordance with an embodiment of the present invention.

FIG. 3G shows a diagram 306 of a transmission line electrode assembly 362 with a double-switched current source 358. Terminal E of transmission line electrode assembly 362 is coupled to terminal x of current source 358 by switch 364 and terminal F of transmission line electrode assembly 362 is coupled to terminal y of current source 358 by switch 368. A bypass capacitor 366 couples terminals x and y of current source 358.

Figure 3H:
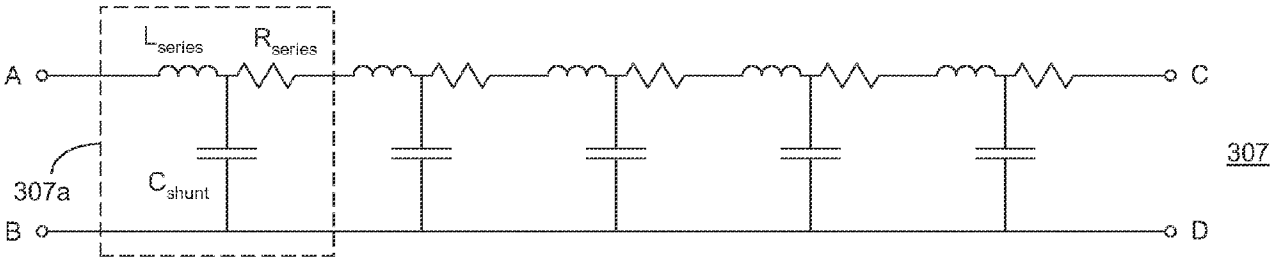
FIG. 3H shows a schematic diagram of a transmission line bus in accordance with an embodiment of the present invention.

FIG. 3H shows an electrical schematic diagram 307 of a transmission line bus similar to transmission line bus 360. Repeating unit 307*a* includes a series inductance $L_{series}$, a series resistance $R_{series}$, and a shunt capacitance $C_{shunt}$.

Figure 3I:
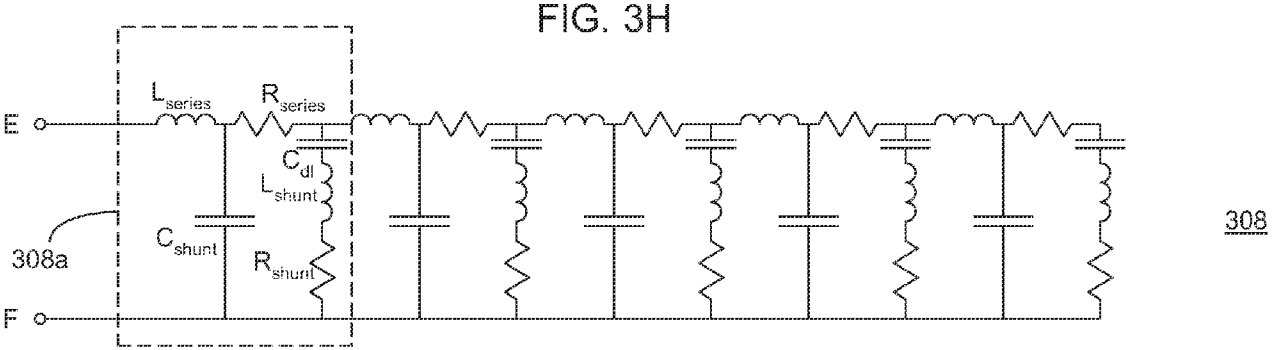
FIG. 3I shows a schematic diagram of a transmission line electrode assembly with a solid dielectric in accordance with an embodiment of the present invention.

FIG. 3I shows an electrical schematic diagram 308 of an embodiment of a transmission line electrode assembly. Repeating unit 308*a* includes a series inductance $L_{series}$, a series resistance $R_{series}$, and a shunt capacitance $C_{shunt}$. The repeating unit 308*a* also includes a $C_{dl}$, an $L_{shunt}$, and an $R_{shunt}$, that are associated with an electrolyte in contact with electrodes. The transmission line electrode assembly of diagram 308 may be considered a lossy transmission line stub.

Figure 3J:
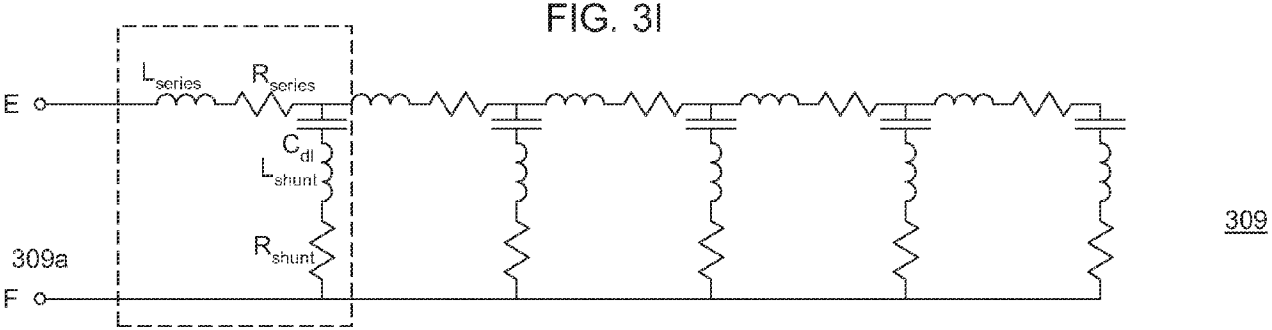
FIG. 3J shows a schematic diagram of a transmission line electrode assembly with an electrolyte dielectric in accordance with an embodiment of the present invention.

FIG. 3J shows an electrical schematic diagram 309 of an embodiment of a transmission line electrode assembly. Repeating unit 308*a* includes a series inductance $L_{series}$, a series resistance $R_{series}$, a $C_{dl}$ an $L_{shunt}$, and an $R_{shunt}$. The transmission line electrode assembly of diagram 309 is similar to that of diagram 308, except that it lacks a $C_{shunt}$ associated with a non-electrolyte dielectric.

Figure 3K:
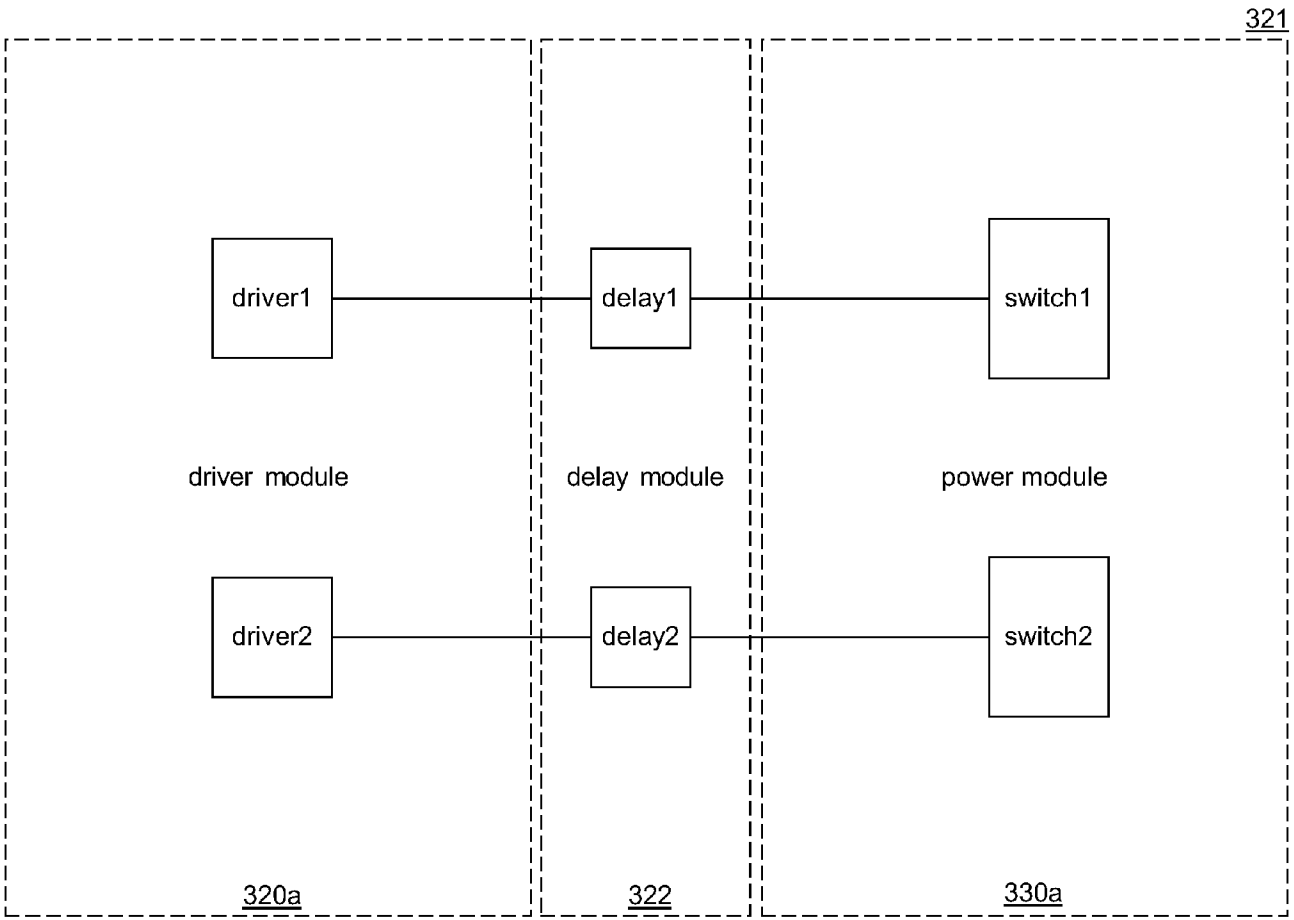
FIG. 3K shows a schematic diagram of a parallel driver module coupled to a parallel power module by a tunable delay module in accordance with an embodiment of the present invention.

FIG. 3K shows a schematic diagram of a parallel driver module 320*a* coupled to a parallel power module 330*a* by a tunable delay module 322. Driver 1 is coupled to switch 1 by a delay element delay 1 and driver 2 is coupled to switch 2 by a delay element delay 2. In order to obtain high currents, parallelism among drivers and switches may be required. Multiple individual driver circuits may be combined as driver 1 or driver 2. For example, both driver circuits on a dual integrated circuit (IC) may be combined to drive a single transistor. Although less common, more than one switch circuit may be combined to be driven by a single driver. When a large number of driver/switch combinations are combined in parallel, variation in switching behavior between driver/switch combinations will tend to degrade the output waveform.

The delay module 322 provides a tunable delay 1 between driver 1 and switch 1 and a tunable delay 2 between driver 2 and switch 2. For switches with logic level inputs (e.g., logic level input MOSFETs) a monostable multivibrator such as the 74VHC221A device manufactured by the Fairchild Semiconductor Corporation may be used. For switches requiring a high drive voltage, the MM74C221 monostable multivibrator from the Fairchild Semiconductor Corporation may be used. The delay may be tuned once during manufacturing, or it may be tuned periodically during operation. For operational tuning, a digital potentiometer such as the AD5222 manufactured by Analog Devices, Inc. may be used to set the RC time constant for a monostable multivibrator.

Delay 1 and/or delay 2 may be adjusted to minimize the distortion in the output waveform. Although only two driver/delay/switch combinations are shown, several may be used in an electrolytic cell interphase control system. In general, the greater the number of switches (e.g., transistors) configured in parallel, the greater the benefit of tunable delays. In a preferred embodiment the output rise and fall times of the power module 330*a* are less than 100 nanoseconds.

Figure 4A:
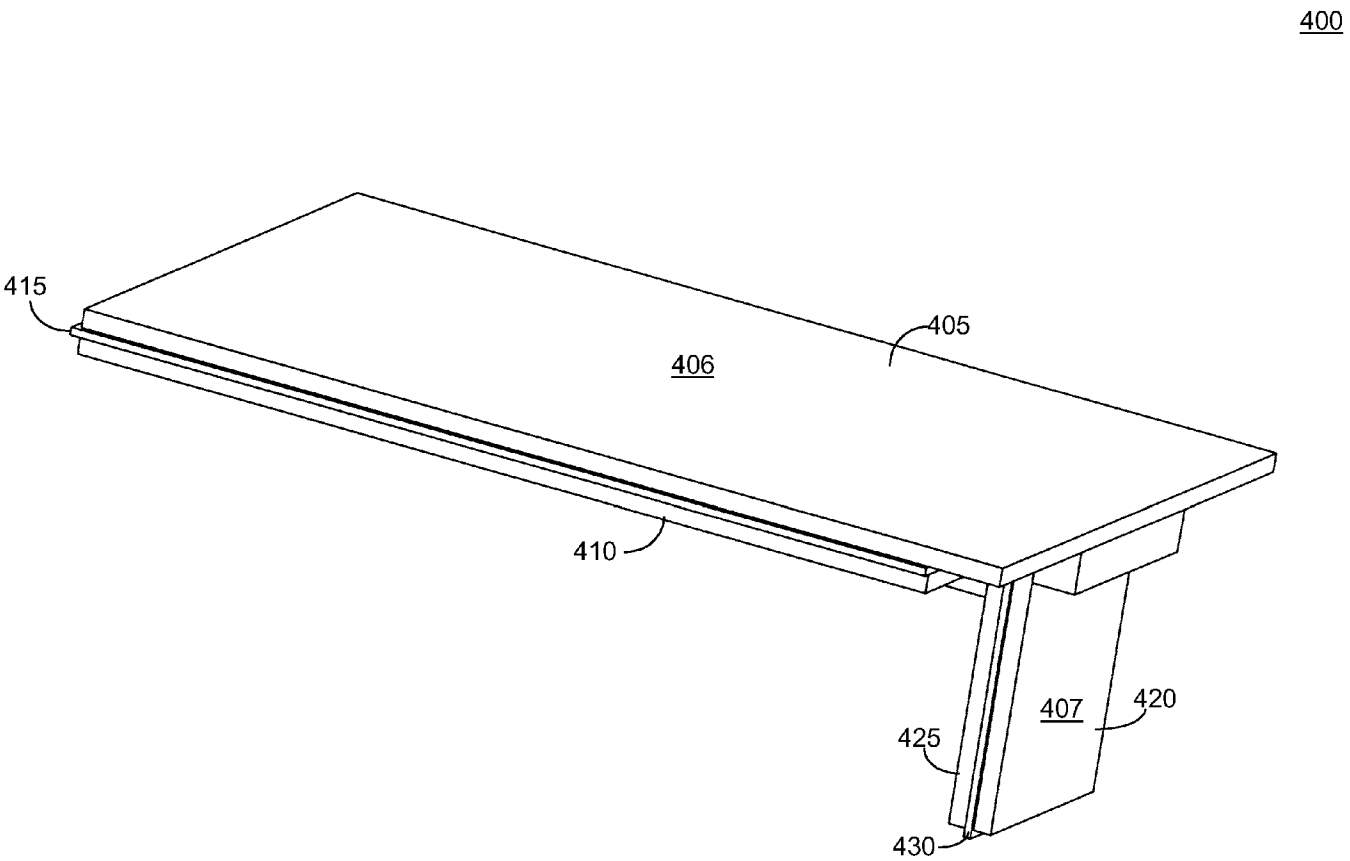
FIG. 4A shows a parallel plate transmission line with a solid dielectric filled gap in accordance with an embodiment of the present invention.

FIG. 4A shows a perspective view 400 of an embodiment of a parallel plate transmission line 406 coupled to a parallel plate transmission line anode/cathode assembly 407. The parallel plate transmission line 406 includes a top conductor plate 405, a dielectric sheet 415, and a bottom conductor plate 410. The top conductor plate 405 and the bottom conductor plate 410 may be adhesively bonded, clamped, or otherwise fixed to the dielectric sheet 415. For example, the parallel plate transmission line 406 may be fabricated from a copper-clad glass/epoxy composite.

Figure 4B:
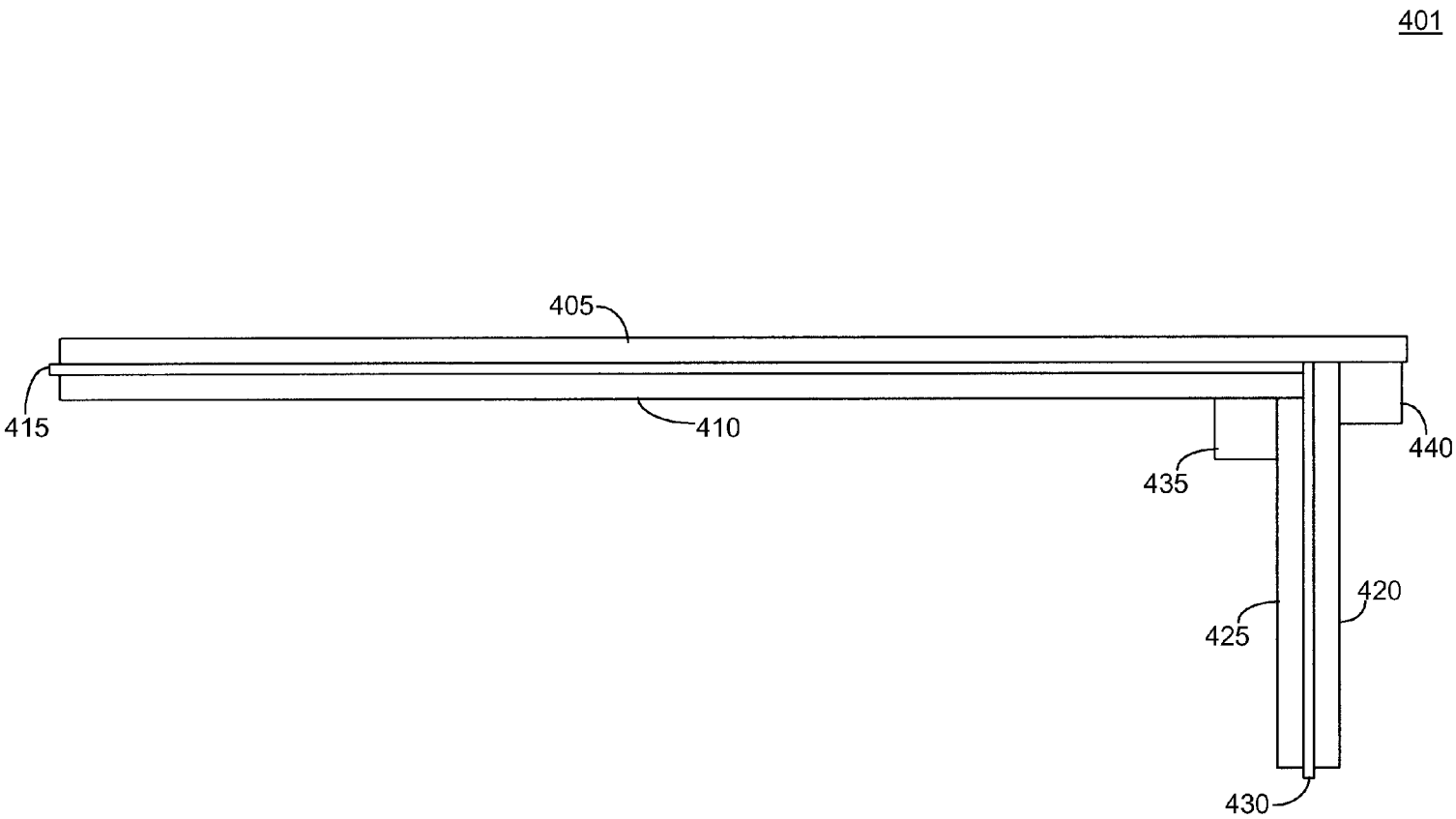
FIG. 4B shows a cross-section view of the parallel plate transmission line of FIG. 4A.

FIG. 4B shows a cross-section view 401 of the parallel plate transmission line 406 of FIG. 4A. A lower mounting block 435 couples the bottom conductor plate 410 to electrode 425 of the parallel plate transmission line anode/cathode assembly 407 and an upper mounting block 440 couples the top conductor plate 405 to electrode 420 of the anode/cathode assembly 407. Although the anode/cathode assembly 407 may be more or less permanently fixed to the parallel plate transmission line 406, it may be desirable to have a removable parallel plate transmission line anode/cathode assembly 407 that may be attached (e.g., bolted) to the upper mounting block 440 and lower mounting block 435. Either of the electrodes 420 and 425 may serve as anode or cathode, and more than one parallel plate transmission line anode/cathode assembly 407 may be coupled to the parallel plate transmission line 406.

Figure 4C:
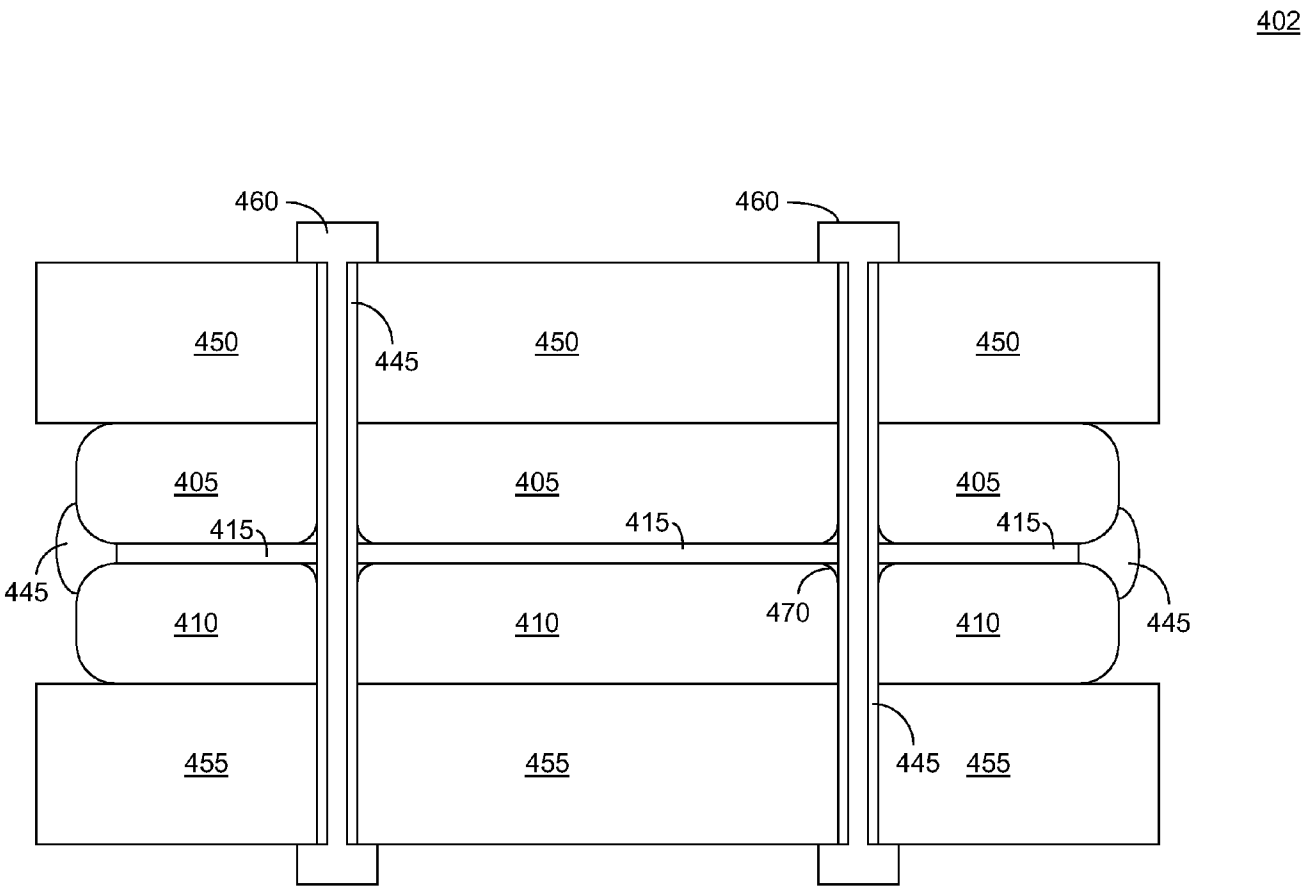
FIG. 4C shows a cross-section view of a construction for a parallel plate transmission line in accordance with an embodiment of the present invention.

FIG. 4C shows a cross-section view 402 of a construction for an embodiment of parallel plate transmission line. A top conductor 405 and bottom conductor 410 sandwich a dielectric sheet 415. For minimum inductance, it is desirable that the dielectric sheet 415 be thin so that the center-to-center spacing of top conductor 405 and bottom conductor 410 is minimized. Similarly, it is desirable that the conductors 405 and 410 be thin so that their center-to-center spacing is minimized. Although decreasing the thickness of the conductor results in an increase in resistance, the width can be increased to maintain the cross-sectional area while further reducing the inductance. In a preferred embodiment, the ratio of the center-to-center spacing to the width of top conductor 405 and bottom conductor 410 is greater than 1000.

For parallel plate transmission lines with thin, wide, conductors and dielectrics, a top backup plate 450 and/or a bottom backup plate 455 may be used. A fastener 460 (e.g., bolt) may be used to clamp top backup plate 450 and bottom backup plate 455 against top conductor 405, dielectric 415 and bottom conductor plate 410. A dielectric sleeve 445 may be used to insulate the fastener 460 if it is conductive. It is preferable that the top backup plate 450 and the bottom backup plate 455 be electrically isolated from top conductor 405 and bottom conductor 410, or that they be fabricated from a dielectric material.

The holes in top conductor 405 and bottom conductor 410 may have a chamfer 470 if dielectric 415 is very thin, or large voltages are applied to the transmission line. Conductor edges may also be provided with a radius to avoid high electric fields. A dielectric fill 445 may also be used to improve resistance to short circuits between top conductor 405 and bottom conductor 410. In general, it is preferable that materials with a high magnetic permeability be excluded from the transmission line assembly, except when specific magnetic field enhancement is desired.

In a preferred embodiment, a top backup plate 450, a top conductor 405, a bottom conductor 410, and a bottom backup plate 455 are bonded together using a filled epoxy adhesive. Examples of a suitable fill material are silica and alumina. The fill material particles may be sized to provide a minimum separation distance between top conductor 405 and bottom conductor 410. The assembly may be vacuum encapsulated to prevent voids.

The dielectric 415 may be fabricated from a variety of polymers such as fluorocarbons, polyesters, or other polymers that are used in the fabrication of film capacitors. Alternatively, the dielectric may be deposited as a film on top conductor 405 and/or bottom conductor 410 (e.g., from paraxylene).

Figure 4D:
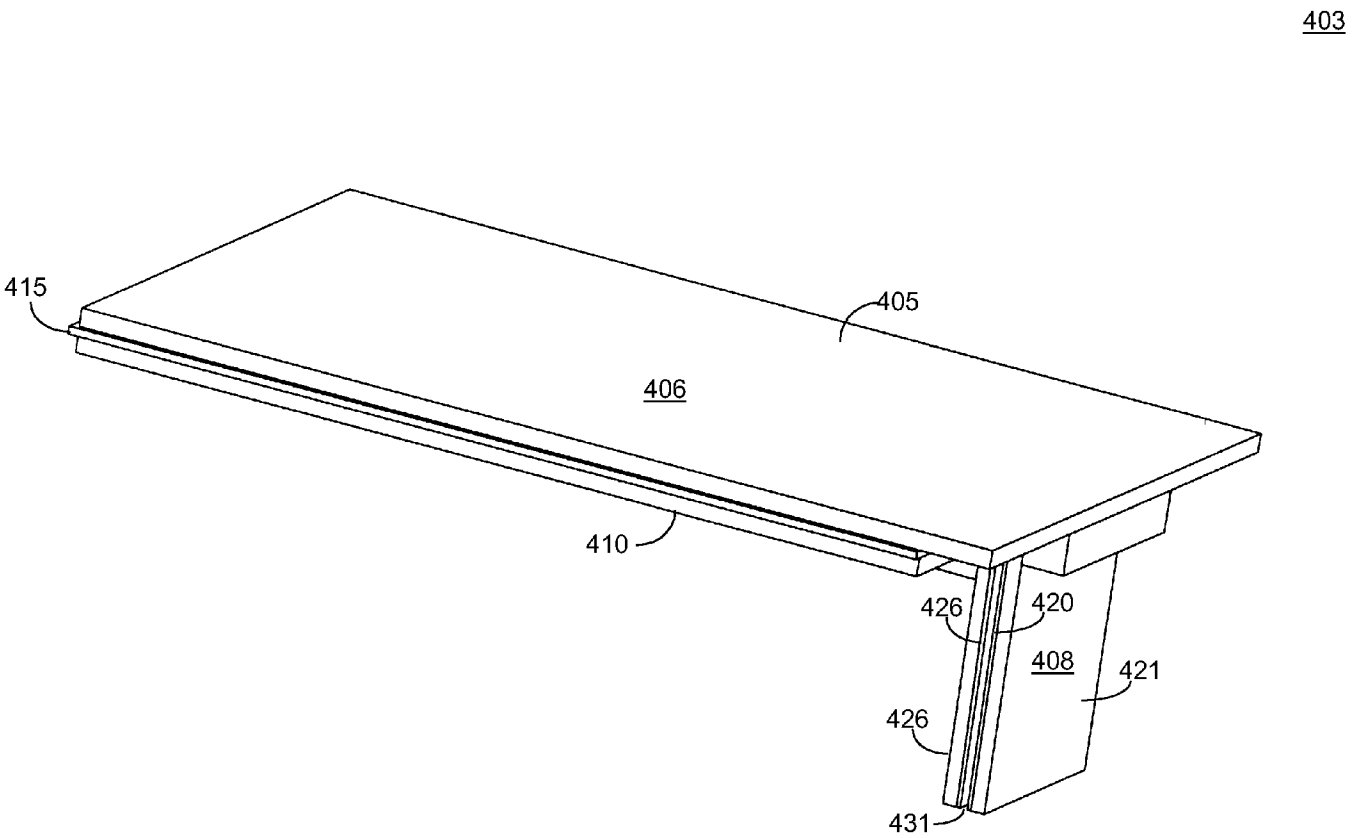
FIG. 4D shows a parallel plate transmission line with an electrolyte filled gap in accordance with an embodiment of the present invention.

FIG. 4D shows a perspective view 403 of parallel plate transmission line 406 coupled to a parallel plate transmission line anode/cathode assembly 408 with an electrolyte filled gap 431. In keeping with the preference of a low inductance, the thickness of the gap 431 and the thickness of electrodes 420 and 425 may kept small, in which case additional mechanical support may be required to resist electromagnetic forces. Electrode 420 and electrode 425 are shown with backup plates 421 and 426, respectively.

Figure 4E:
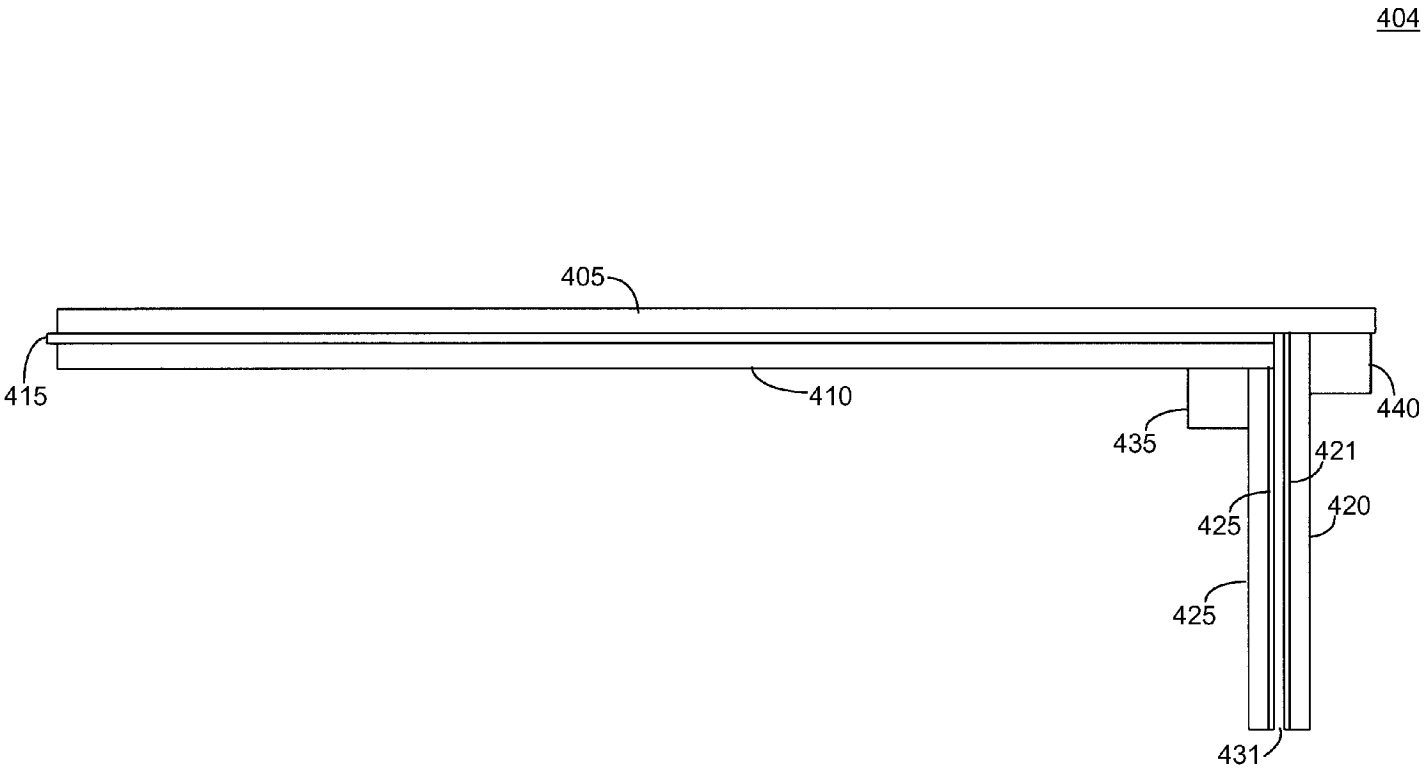
FIG. 4E shows a cross-section view of the parallel plate transmission line of FIG. 4C.

FIG. 4E shows a cross-section view of the parallel plate transmission line of FIG. 4C. It should be noted that although the substitution of the electrolyte filled gap 431 in parallel plate transmission line 408 for the solid dielectric filled gap in parallel plate transmission line 407 has no significant direct effect on the inductance, there is a considerable impact on the performance in an electrolytic cell due to the difference in behavior when immersed in an electrolyte. Parallel plate transmission line 408 will have a much lower resistance and a much more uniform current density at the wetted surfaces of electrodes 420 and 421. The difference in current distribution may also manifest itself as a difference in inductance due to the change in current distribution.

The RC time constant of an electrolytic cell is typically dominated by the bulk resistance of the electrolyte and the double-layer capacitance associated with the electrode surfaces. The double-layer capacitance may be decreased by limiting area, but this also limits the throughput of the cell. The double-layer capacitance and bulk resistance can also be reduced by altering the electrolyte composition, but this may also reduce throughput. The preferred approach to reducing the RC time constant of an electrolytic cell is to minimize the spacing between electrode 420 and electrode 426.

There are two primary disadvantages associated with a very narrow gap 431. First, there is the inhibition of the transport of reactants and products to and from the electrode surfaces. Second, if the electrolytic cell is used for an electrodeposition process, the gap spacing will change as deposition occurs. Mass transport may be improved by directing a flow of electrolyte into the gap under pressure. Narrowing of the gap 431 by electrodeposition may be dealt with by substitution using removable electrodes.

Figure 5A:
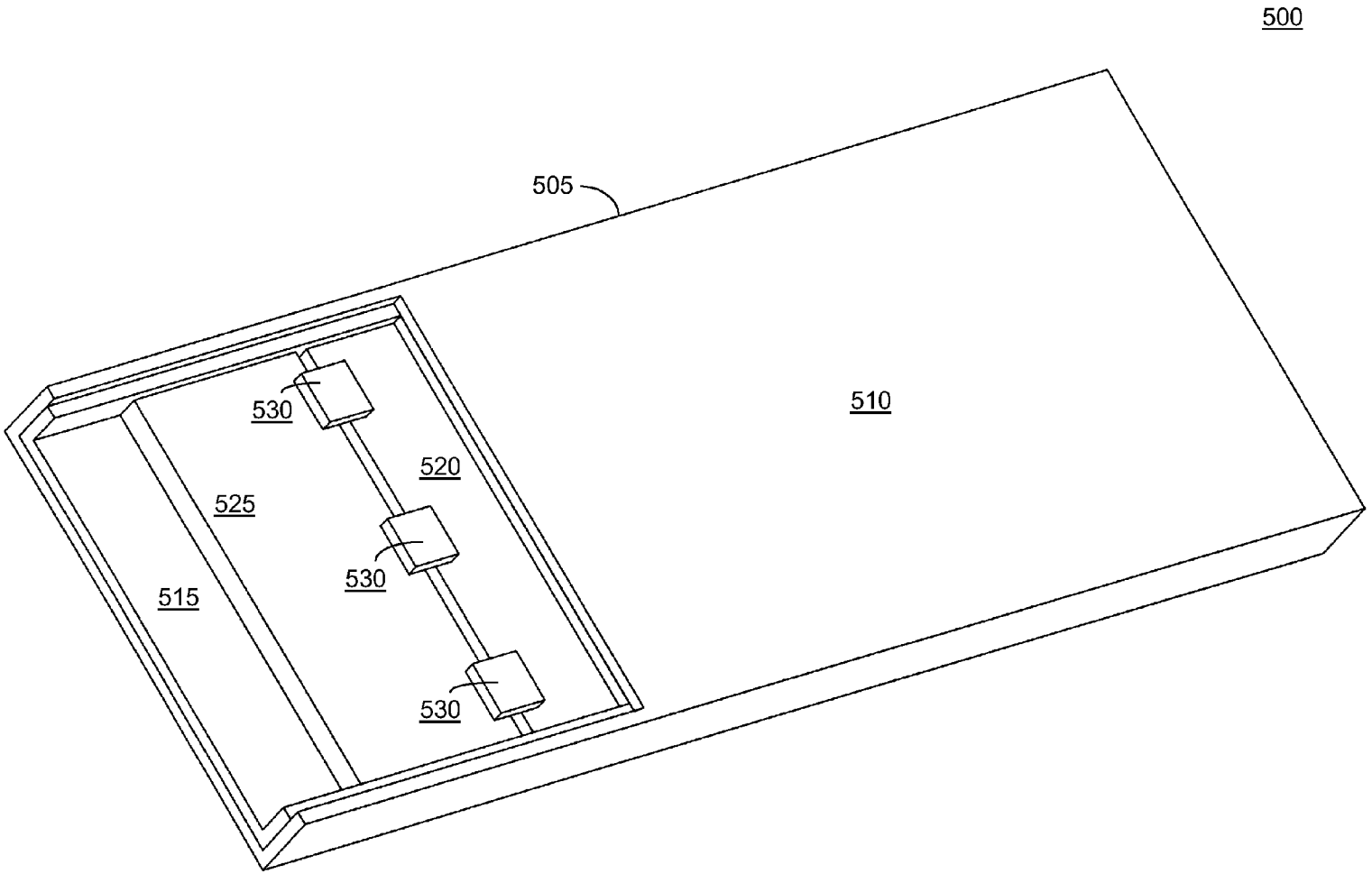
FIG. 5A shows a top perspective view of a switched coaxial transmission line bus in accordance with an embodiment of the present invention.

FIG. 5A shows a top perspective view 500 of an embodiment of a switched coaxial transmission line bus 505. An outer conductor 510 encloses a dielectric 515, which in turn encloses a center conductor 520. Switches 530 couple center conductor 520 to conductor plate 525.

Figure 5B:
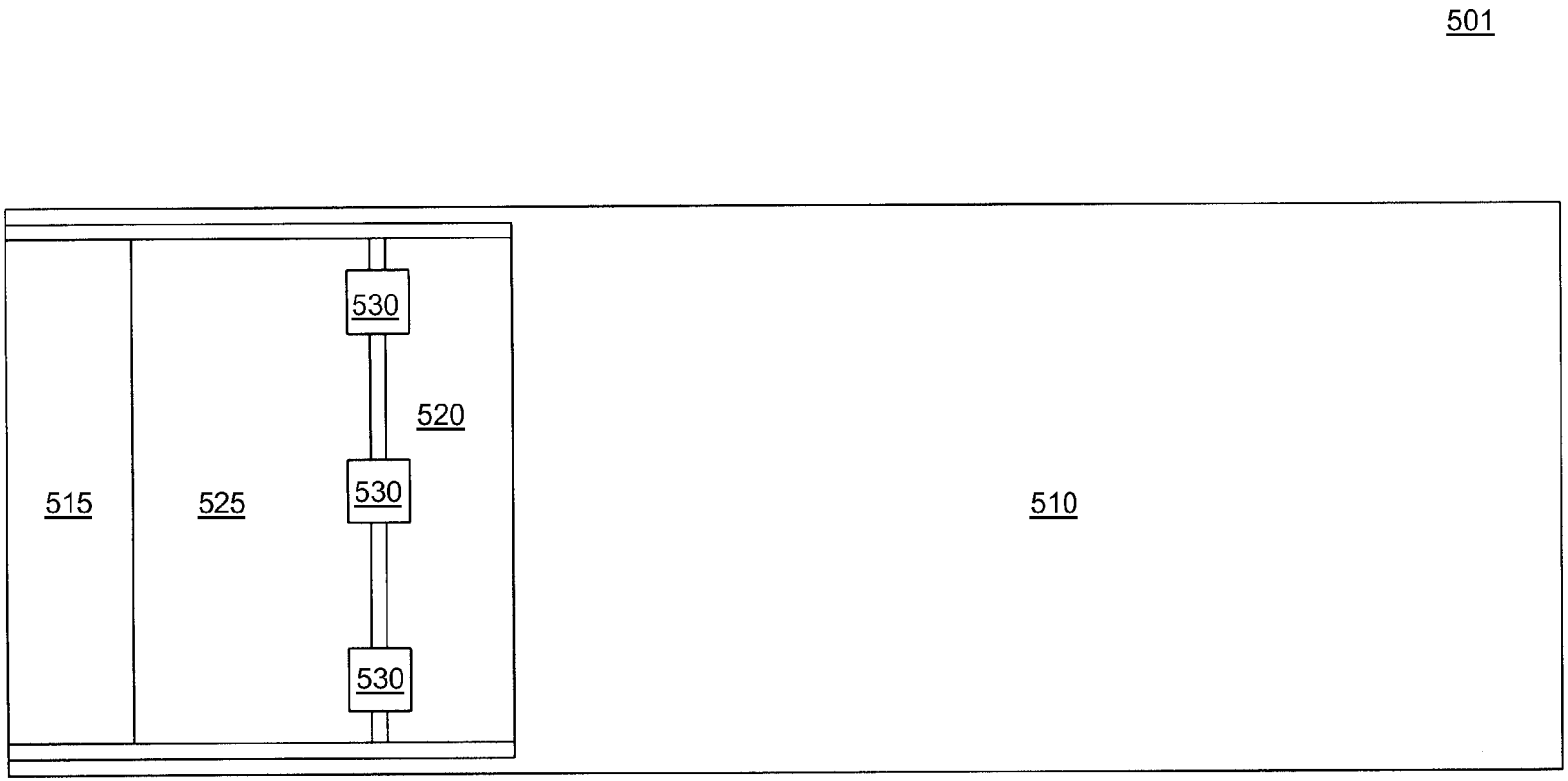
FIG. 5B shows a top view of the switched coaxial transmission line of FIG. 5A.

FIG. 5B shows a top view 501 of the switched coaxial transmission line of FIG. 5A. For clarity, dielectric 515 and outer conductor 510 are shown cut back to expose a portion of inner 520 and conductor plate 525. The exposed surface of conductor plate 525 may be used to mount circuit elements associated with the switches 530. In practice, dielectric 515 and outer conductor 510 may envelop a greater area of conductor plate 525 and inner conductor 520.

Figure 5C:
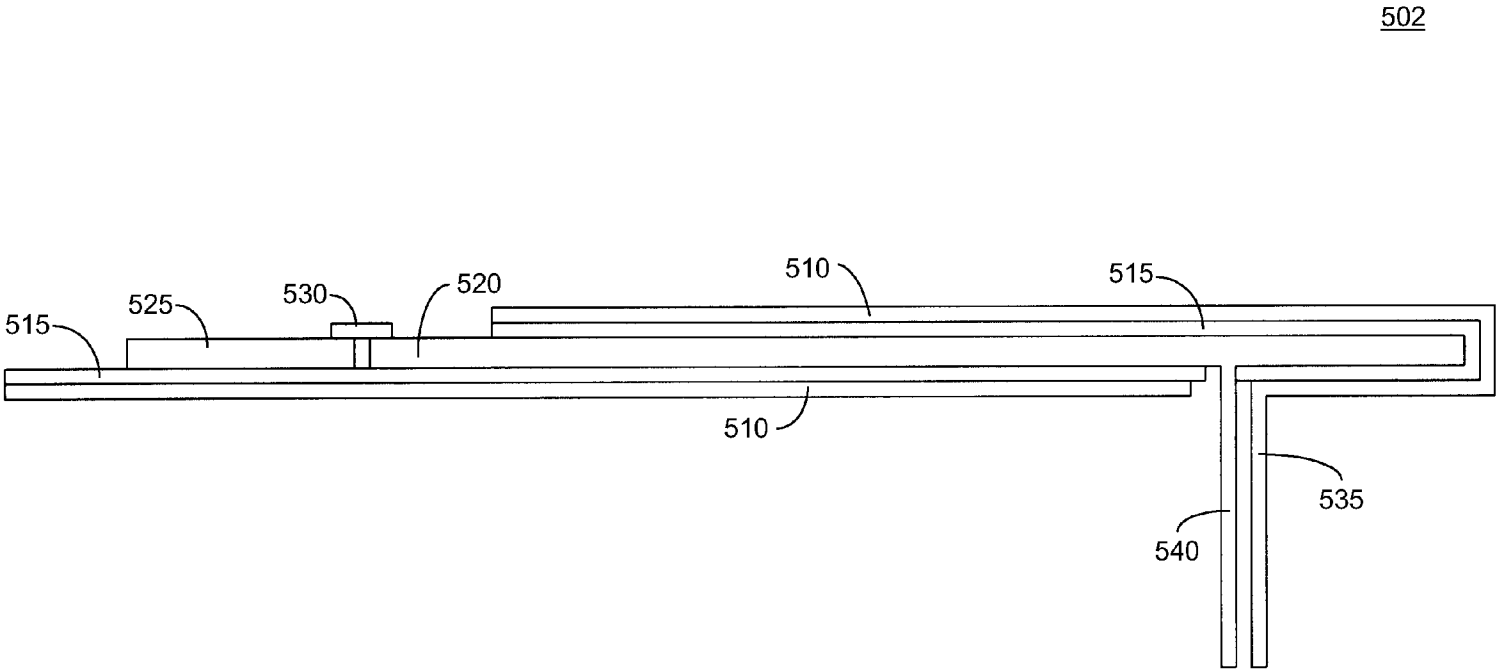
FIG. 5C shows a cross-section view a switched coaxial transmission line with an attached anode/cathode assembly in accordance with an embodiment of the present invention.

FIG. 5C shows a cross-section view 502 of the switched coaxial transmission line bus 505 of FIG. 5A with an integrated anode/cathode assembly including planar electrode 535 and planar electrode 540. It can be seen that the switched coaxial transmission line bus 505 could be converted into a switched parallel plate transmission line by removing portions of the dielectric 515 and 520, essentially creating a switched version of the parallel plate transmission line shown in FIG. 4A.

Figure 5D:
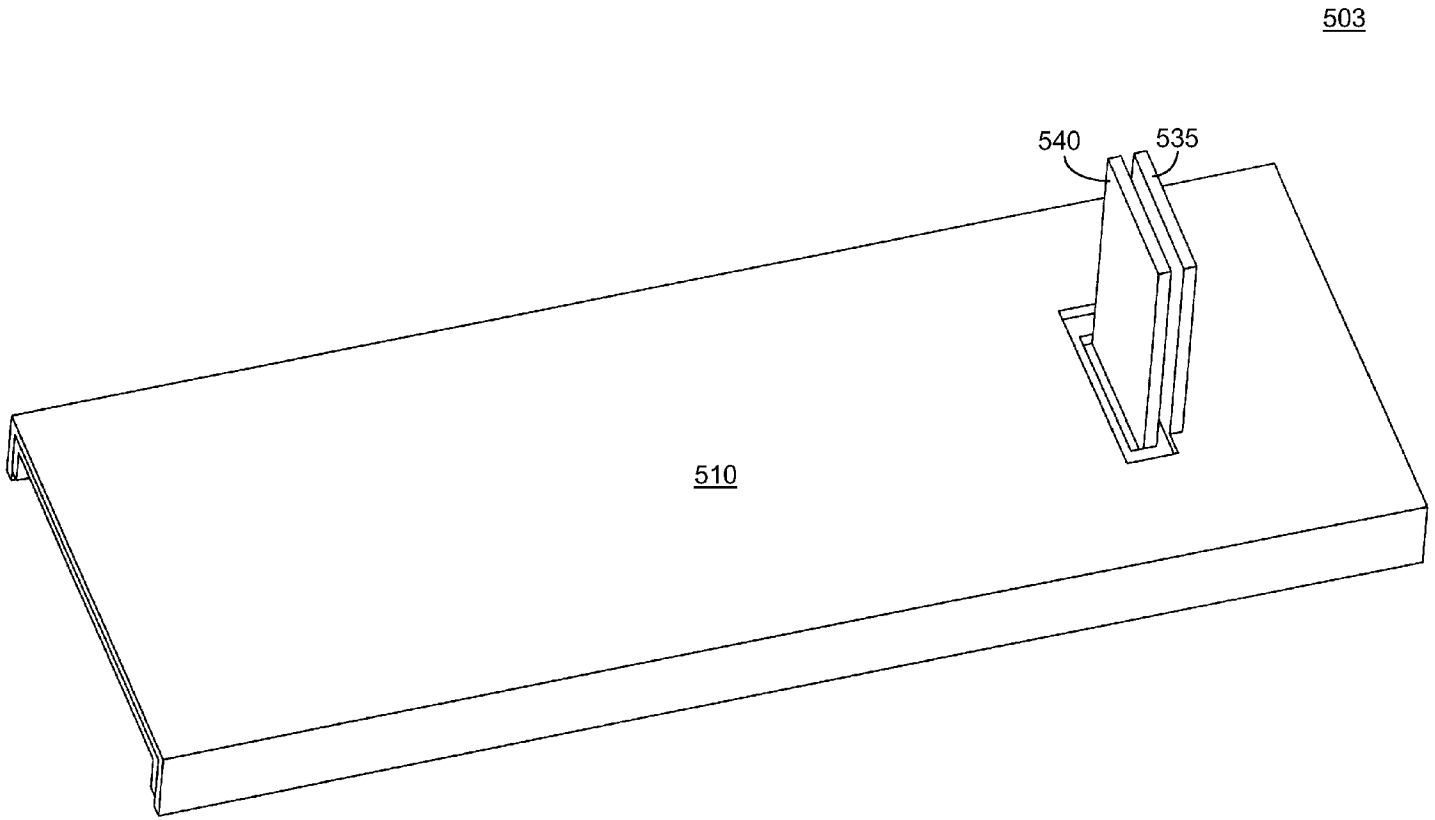
FIG. 5D shows a bottom perspective view of the switched coaxial transmission line of FIG. 5C.

FIG. 5D shows a bottom perspective view 503 of the switched coaxial transmission line of FIG. 5C. Planar electrode 540 and planar electrode 535 are shown without a dielectric. However, it should be noted that both filled and unfilled coaxial and parallel plate transmission lines may be used as anode/cathode assemblies and attached to coaxial and parallel plate transmission line busses using an orthogonal transition.

Figure 6A:
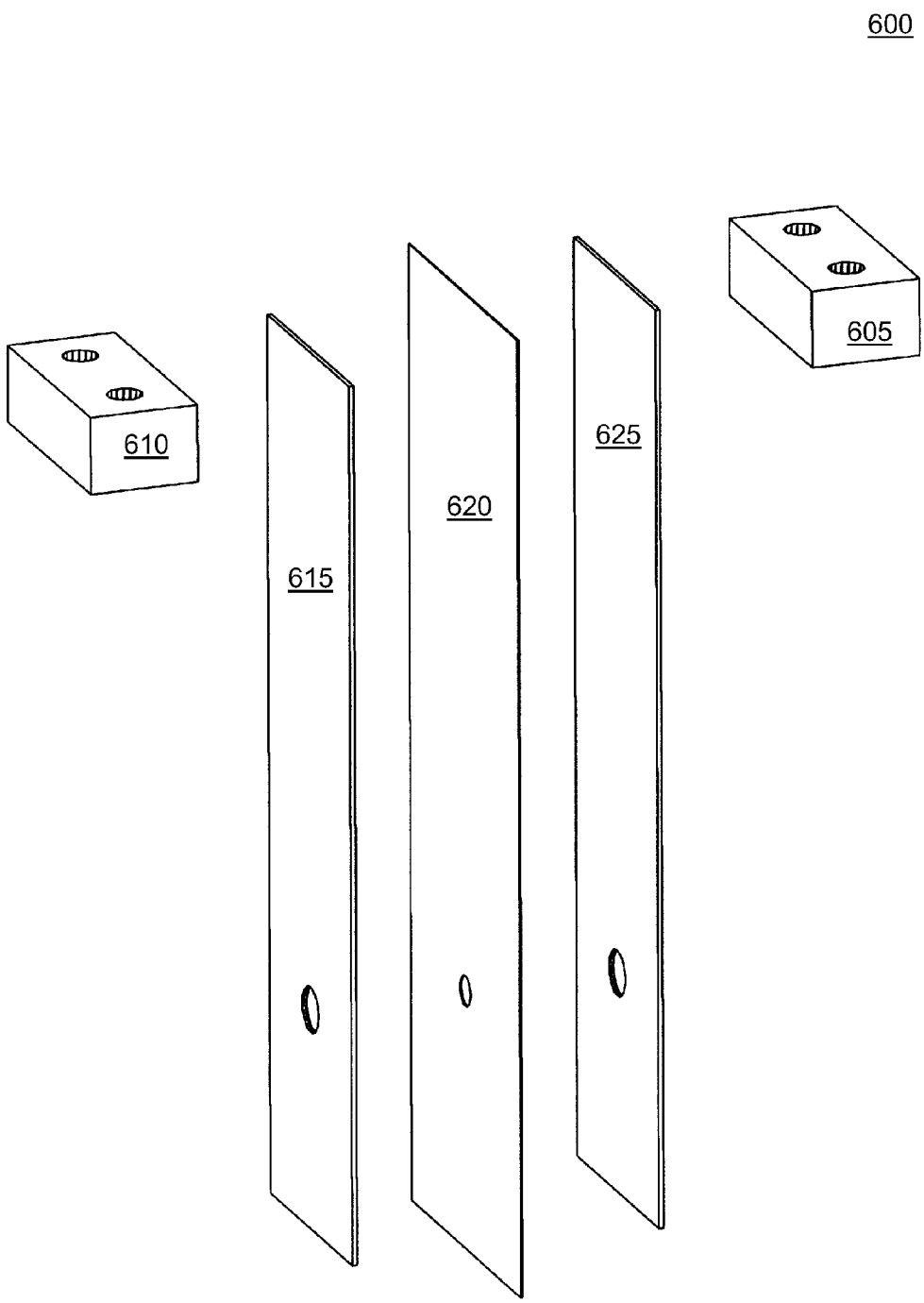
FIG. 6A shows an exploded view a parallel plate anode/cathode assembly in accordance with an embodiment of the present invention.

FIG. 6A shows an exploded view 600 of an embodiment of a parallel plate anode/cathode assembly. First and second mounting blocks 605 and 610 are provided for establishing an electrical connection to electrodes 625 and 615, respectively.

Mounting blocks 605 and 610 also provide a means for attaching the assembly to a parallel plate or coaxial transmission line bus.

Electrodes 625 and 615 are separated by a dielectric 620. The dielectric 620. Copper is a preferred material for electrodes 625, which may be coated with other metals (e.g., platinum) to provide a working surface with different properties. If a high permeability material such as nickel is used as a coating, it is desirable that the coating be kept thin to avoid an undue increase in inductance. The dielectric 620 may be a ceramic, a polymer, or a composite material. It may also be a sheet form that is bonded to electrodes 625 and 615. Alternatively, it may be a dielectric adhesive that is applied to electrode 625 and/or electrode 615.

Figure 6B:
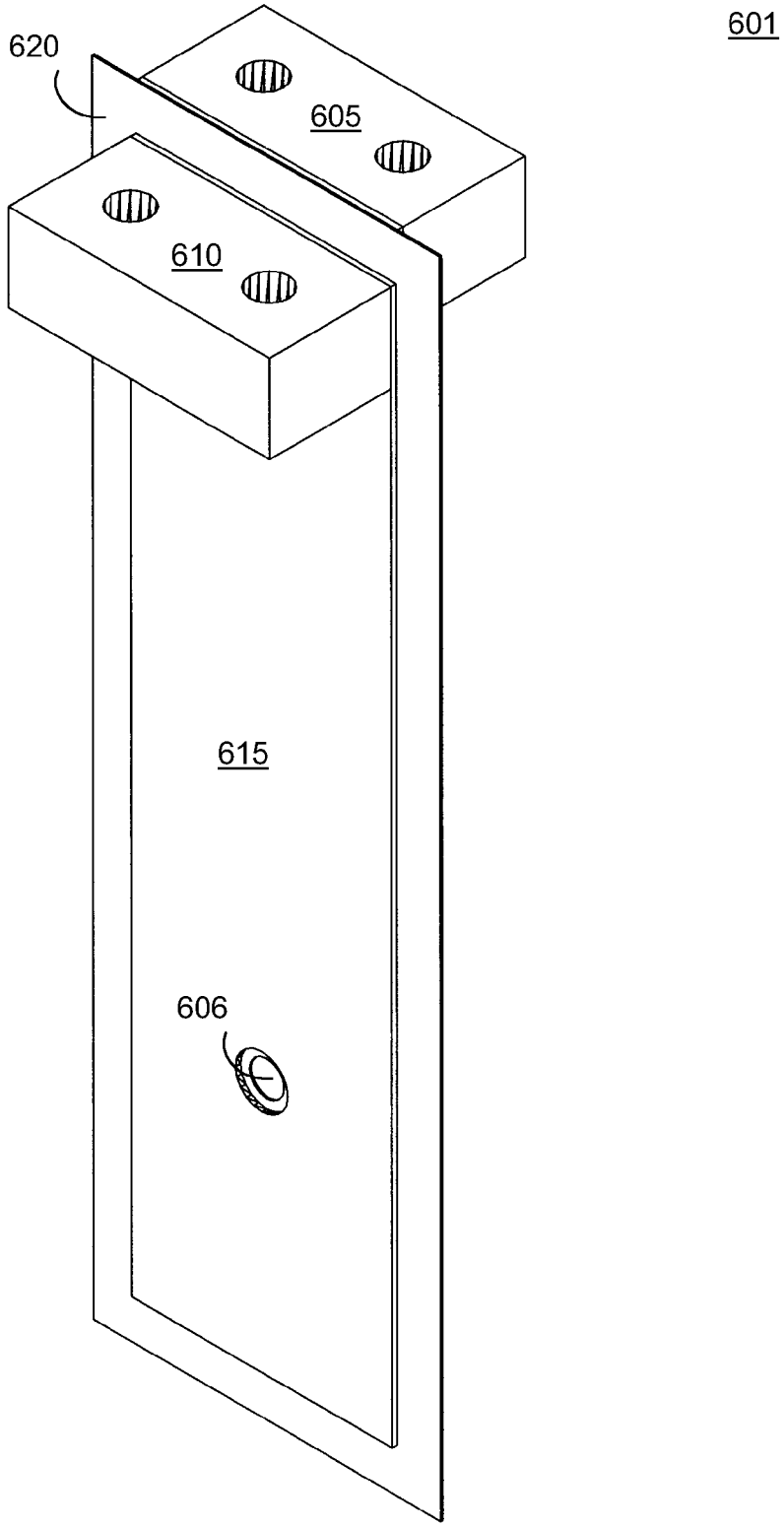
FIG. 6B shows an assembled view of the parallel plate anode/cathode assembly of FIG. 6A.

FIG. 6B shows an assembled view 601 of the parallel plate anode/cathode of FIG. 6A. The hole 606 provides a path for current and mass transport between the two electrode surfaces. More than one hole may be provided, depending upon the desired current distribution and mass transport between the electrode surfaces. The parallel plate transmission line with a solid dielectric and the parallel plate electrode with a gap can be viewed as the opposite ends of a spectrum of parallel plate electrode configurations, with perforated solid dielectric parallel plate electrodes falling in between. In one embodiment, the dielectric is a ceramic substrate and electrode 615 and 620 are deposited using thin film or thick film techniques such as those used for electronic circuits. Hole patterns in the ceramic substrate may be punched in green tape before firing.

Figure 6C:
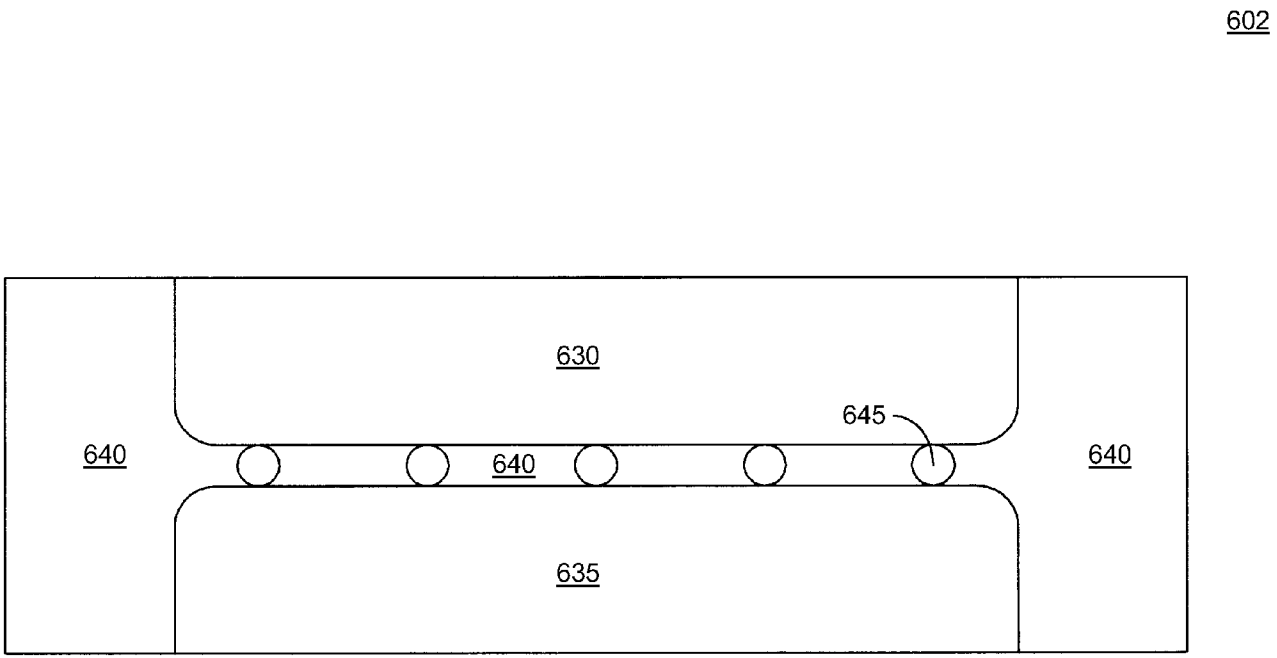
FIG. 6C shows a cross section view of a parallel plate anode/cathode assembly in accordance with an embodiment of the present invention.

FIG. 6C shows a cross section view 602 of an embodiment of a parallel plate anode/cathode assembly. An anode 630 and a cathode 635 are bonded together by a thermosetting polymer adhesive 640 that contains filler particles 645. The thermosetting polymer adhesive may be an epoxy and the filler particles may be silica, alumina, or other ceramic.

Figure 7A:
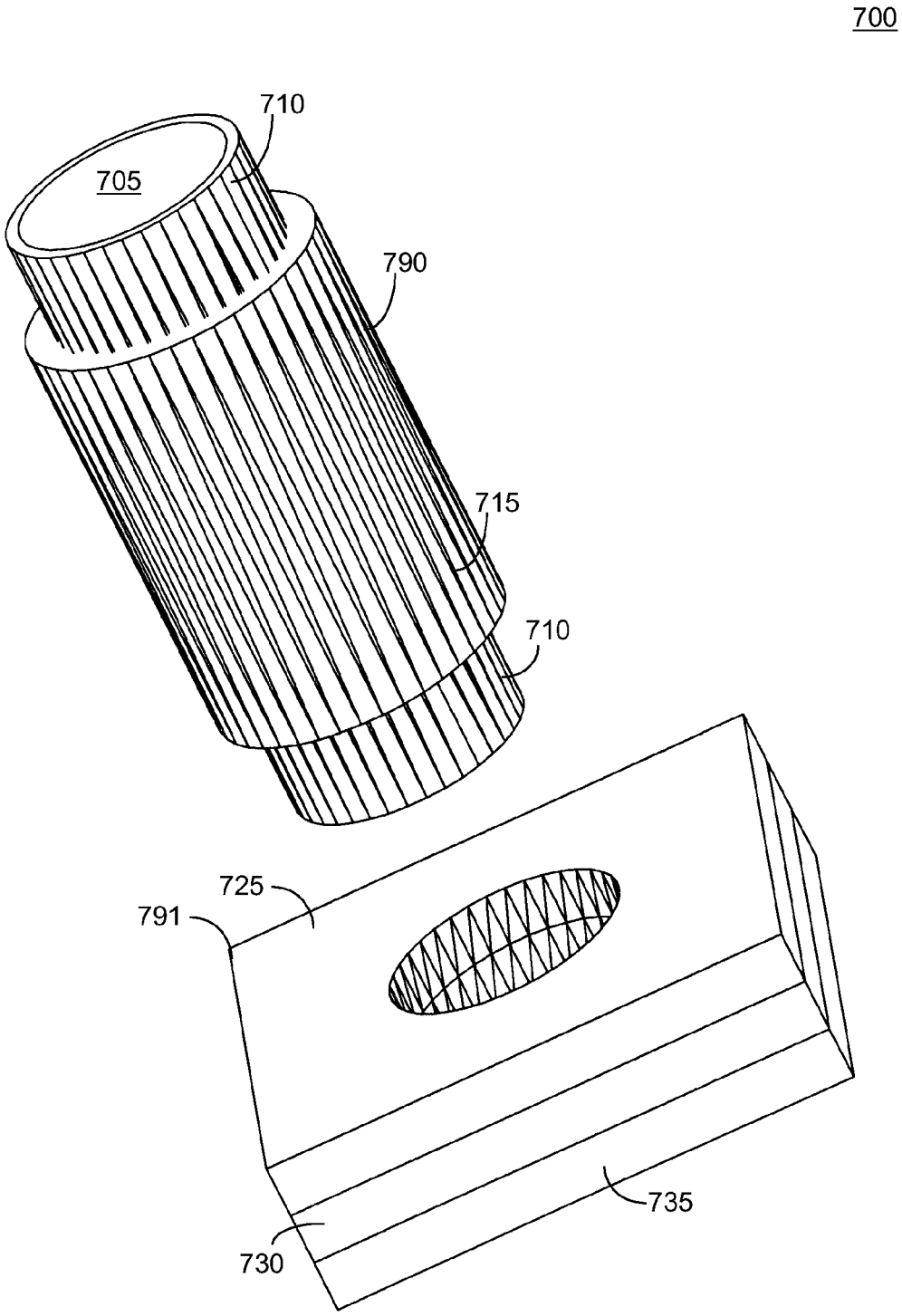
FIG. 7A shows an exploded view of a solid dielectric coaxial anode/cathode assembly in accordance with an embodiment of the present invention.

FIG. 7A shows an exploded view 700 of a solid dielectric coaxial anode/cathode assembly. A coaxial element 790 includes center electrode 705 and an outer electrode 715 that are separated by a dielectric 710. The cutback of the outer conductor 715 at the upper end provides a more uniform current distribution at the electrode surfaces. A first plate conductor 725, a dielectric 730, and a second plate conductor 735 make up a socket portion 791 of a parallel plate transmission line for connection to the coaxial element 701.

Figure 7B:
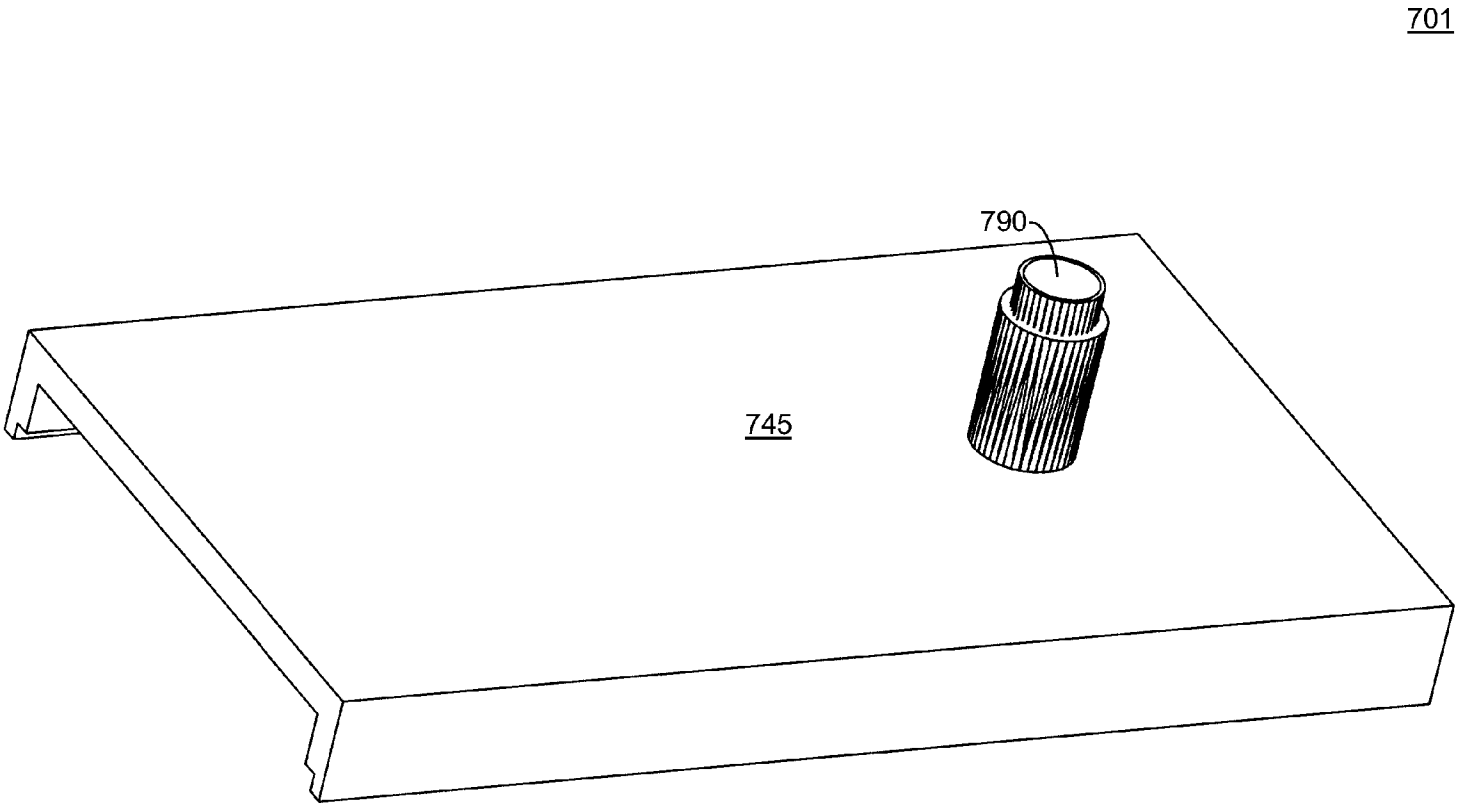

FIG. 7B shows a perspective view 701 of a solid dielectric coaxial anode/cathode assembly 790 attached to a switched coaxial transmission line 745. Switched coaxial transmission line 745 is similar to switched coaxial transmission line 505 shown in FIG. 5A. It should be noted that the orthogonal transition shown in FIGS. 7A and 7B may be used to connect a circular coaxial transmission line bus to a parallel plate transmission line electrode assembly. In practice, it is usually more straightforward to use a parallel plate transmission line or a coaxial transmission line with a rectangular cross-section since the switched current source typically has a planar layout to begin with.

Figure 8:
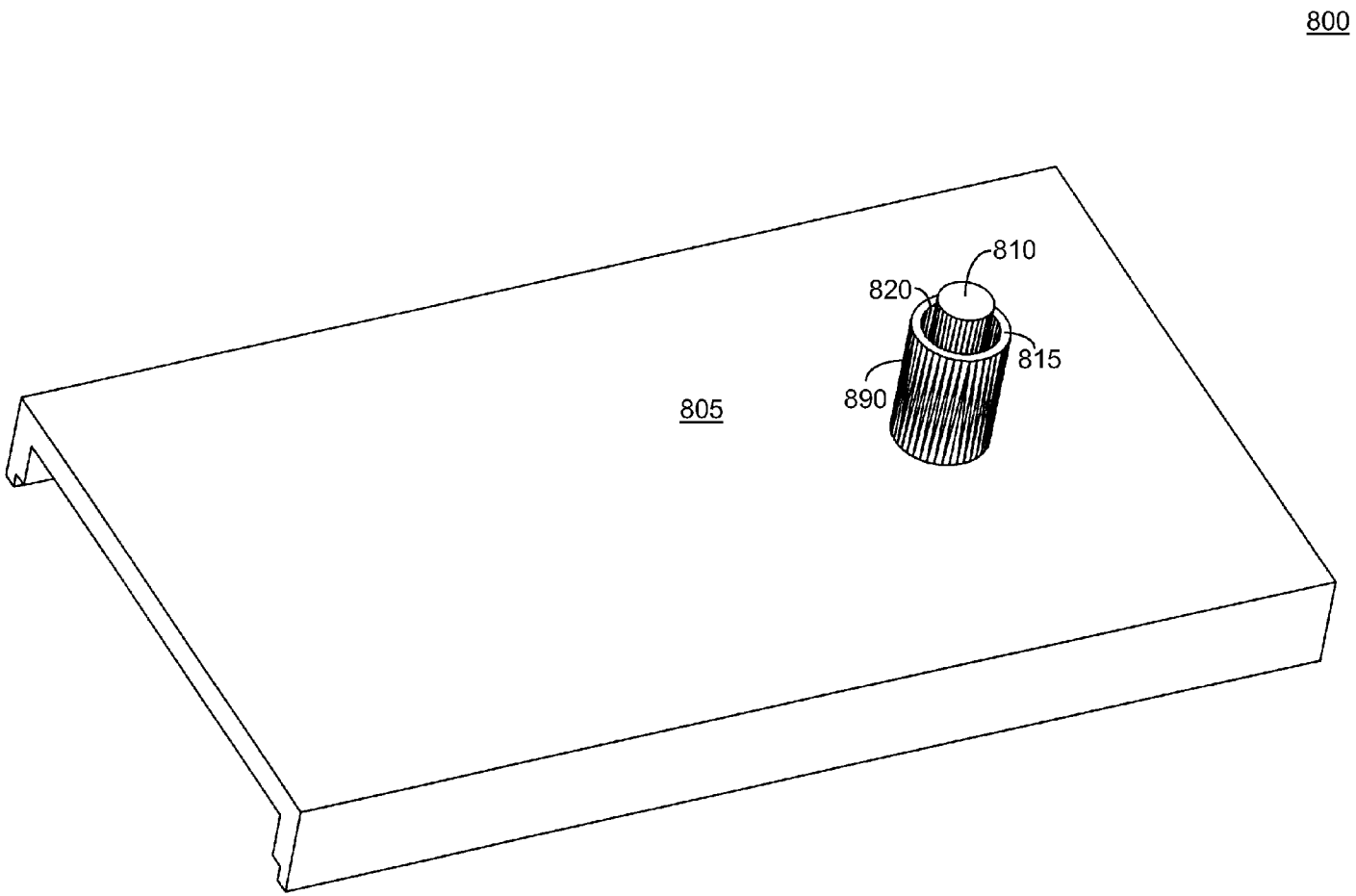
FIG. 8 shows a perspective view of a liquid dielectric coaxial anode/cathode assembly attached to a parallel plate transmission line in accordance with an embodiment of the present invention.

FIG. 8 shows a perspective view 800 of a coaxial anode/cathode assembly 890 attached to parallel plate transmission line 805. The coaxial anode/cathode assembly 890 has a center electrode 810 separated from an outer electrode 815 by a gap 820.

Figure 9A:
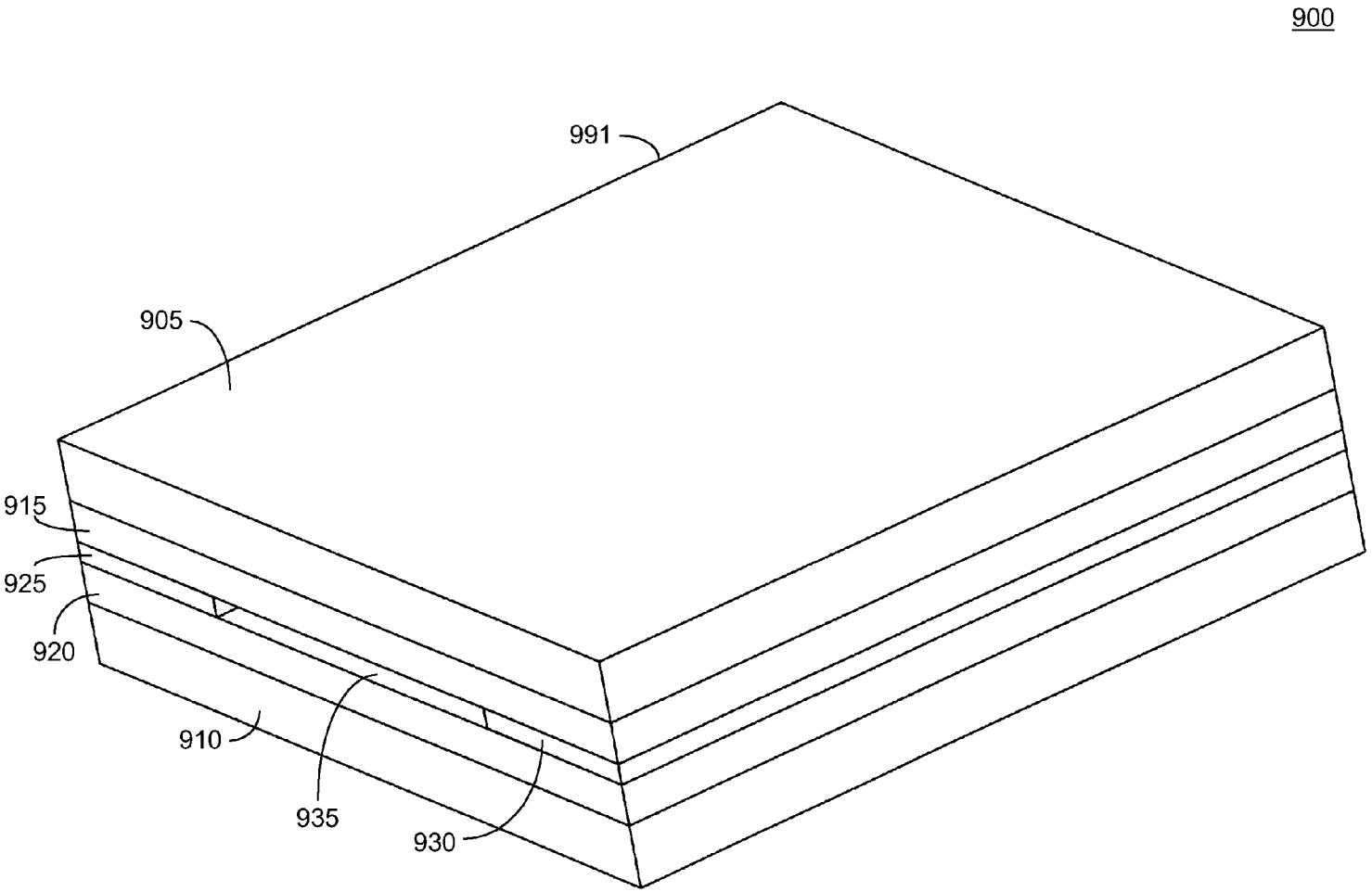
FIG. 9A shows a perspective view of a transmission line duct with opposing anode and cathode walls in accordance with an embodiment of the present invention.

FIG. 9A shows a perspective view 900 of a transmission line duct 991 with an anode wall 915 and an opposing cathode wall 920. As with other transmission line conductors discussed herein, the anode wall 915 and cathode wall 920 are preferably fabricated from a material with high electrical conductivity and low magnetic permeability such as copper. For applications where dimensional stability is desired, particularly at high temperatures, tungsten or molybdenum may be used. The base electrode may be coated with another metal to obtain particular surface characteristics. For a particular electrolyte, the surface coating may be chosen to provide a non-polarizable or low polarization electrode. Anode wall and/or cathode wall 920 may be partially masked to provide a desired ratio between the active areas of anode wall 915 and cathode wall 920.

A first dielectric wall 925 and a second dielectric wall are sandwiched between the anode wall 915 and the cathode wall 930, and their height determine the height of the duct channel 935. Dielectric wall 925 and 930 are preferably fabricated from a dielectric material that is inert with respect to the electrolyte contemplated for use. For very short walls, a stiff, creep resistant material such as silica, alumina, beryllia, or other ceramic is preferred to maintain dimensional stability. Non-oxide ceramics such as silicon nitride, boron nitride, silicon nitride, and aluminum nitride may be used.

Top backup plate 905 and bottom backup plate 910 are not required, but are preferred when the anode wall 915 and cathode wall 920 are thin and additional mechanical support is desired. The anode wall 910 and the cathode wall 915 may be fabricated on the top backup plate 905 and the bottom backup plate 910, respectively, using thin-film or thick film techniques such as those used for fabricating electronic circuits on ceramic substrates. Patterning may be done using photolithographic techniques. Single crystal and polycrystalline ceramic materials may be lapped and polished to provide backup plates with high dimensional accuracy. Thin gold metallization may be applied along with appropriate adhesion layers to provide diffusion bondable surfaces. Opaque and/or transparent ceramic materials may be used for backup plate 905 and/or backup plate 910.

The anode wall 910 and/or the cathode wall 915 may be fabricated by depositing transparent conductive materials on the top backup plate 905 and the bottom backup plate 910, respectively. Examples of suitable transparent conductive materials are antimony doped tin oxide and tin doped indium oxide. Transparent conductive materials may be deposited alone or in combination with a fine-line metal pattern for enhanced conductivity. Examples of materials that are suitable for use as top backup plate 905 and bottom backup plate 910 are sapphire and fused silica. For greater transmission in the IR region, sulfides, selenides and halides may be used. The use of transparent materials for the backup wall and anode/cathode walls enables the illumination of the electrode surfaces.

The flat surface surrounding the duct channel 935 provides an area against which a seal may be made to enable a forced fluid flow through the channel duct 935. Additional backup plates may be added to increase the seal surface area around the channel duct 935. A temporary seal may be made using gaskets or O-rings, and a more permanent seal may be made using adhesives. The use of ceramic materials and thin film techniques enables the construction of ducts with a height on the order of 0.001 inches or smaller and a width on the order of an inch or larger. For low profile transmission line ducts, adapters may be attached to facilitate plumbing connections. The transmission line duct 991 is an embodiment of a fundamental element of the present invention: an electrolytic cell with inherently low inductance that is achieved through closely spaced and substantially parallel electrodes with a separation that is small compared to the width of parallel plate electrodes. A transmission line duct with coaxial electrodes will have an electrode separation that is small in comparison to the cross-section perimeter of the center conductor. In a preferred embodiment of transmission line duct 991, the width to separation ratio of the anode wall 910 and the cathode wall 915 is at least 100. In a most preferred embodiment of transmission line duct 992, the width to separation ratio is at least 1000.

Figure 9B:
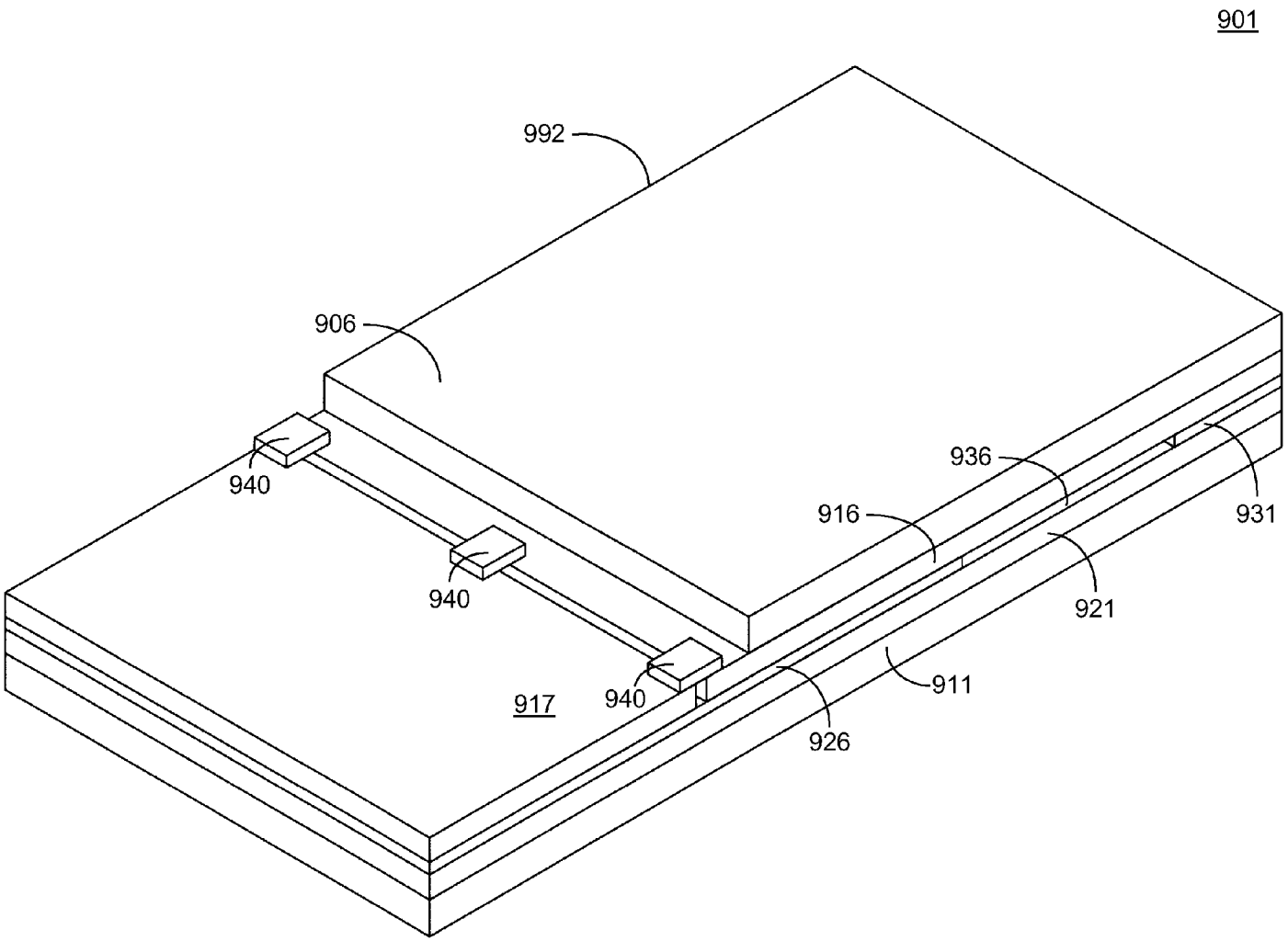
FIG. 9B shows a perspective view of a transmission line duct with opposing anode and cathode walls with integrated switches in accordance with an embodiment of the present invention.

FIG. 9B shows a perspective view 901 of an embodiment of a switched transmission line duct 992. An anode wall 916 and a cathode wall 921 are coupled to and separated by a dielectric wall 931 and a transmission line dielectric 926. The transmission line dielectric 926 is also coupled to a switch plate 917 and separates switch plate 917 from the cathode wall 921. The switch plate 917 is coupled to anode wall 916 by switches 940 (e.g., transistors). The switched transmission line duct 992 is essentially a union of two parallel plate transmission lines, with two of the conductors being directly coupled and the other two conductors being coupled by switches.

Figure 9C:
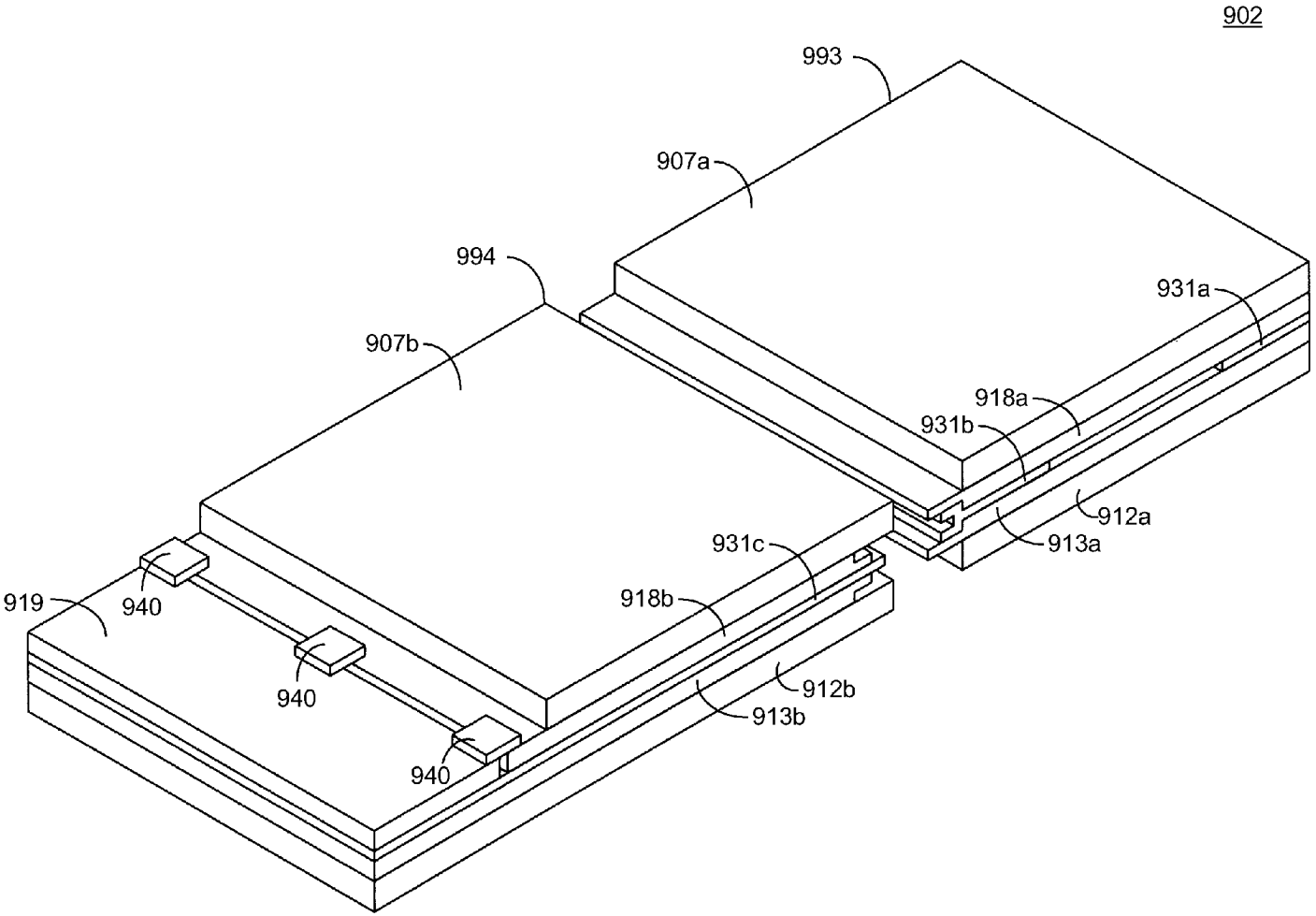
FIG. 9C shows a perspective view of a transmission line duct with opposing anode and cathode walls with a detachable switch module in accordance with an embodiment of the present invention.

FIG. 9C shows a perspective view 902 of an embodiment of a transmission line duct 993 with a detachable switch module 994. The transmission line duct 993 is similar to the transmission line duct 991 of FIG. 9A, but has been adapted for detachable coupling to the power module 994. Dielectric walls 931*a* and 931*b* are disposed between anode wall 918*a* and cathode wall 913*a*, which are in turn sandwiched between backup plate 907*a* and backup plate 912*a*.

The detachable switch module 994 has a lower conductor plate 913*b* and an upper conductor plate 918*b* that are separated by and coupled to a transmission line dielectric 931*c*. The transmission line dielectric 931*c* is also coupled to a switch plate 919 and separates switch plate 919 from the lower conductor plate 913*b*. The switch plate 919 is coupled to upper conductor plate 918*b* by switches 940 (e.g., transistors).

Figure 9D:
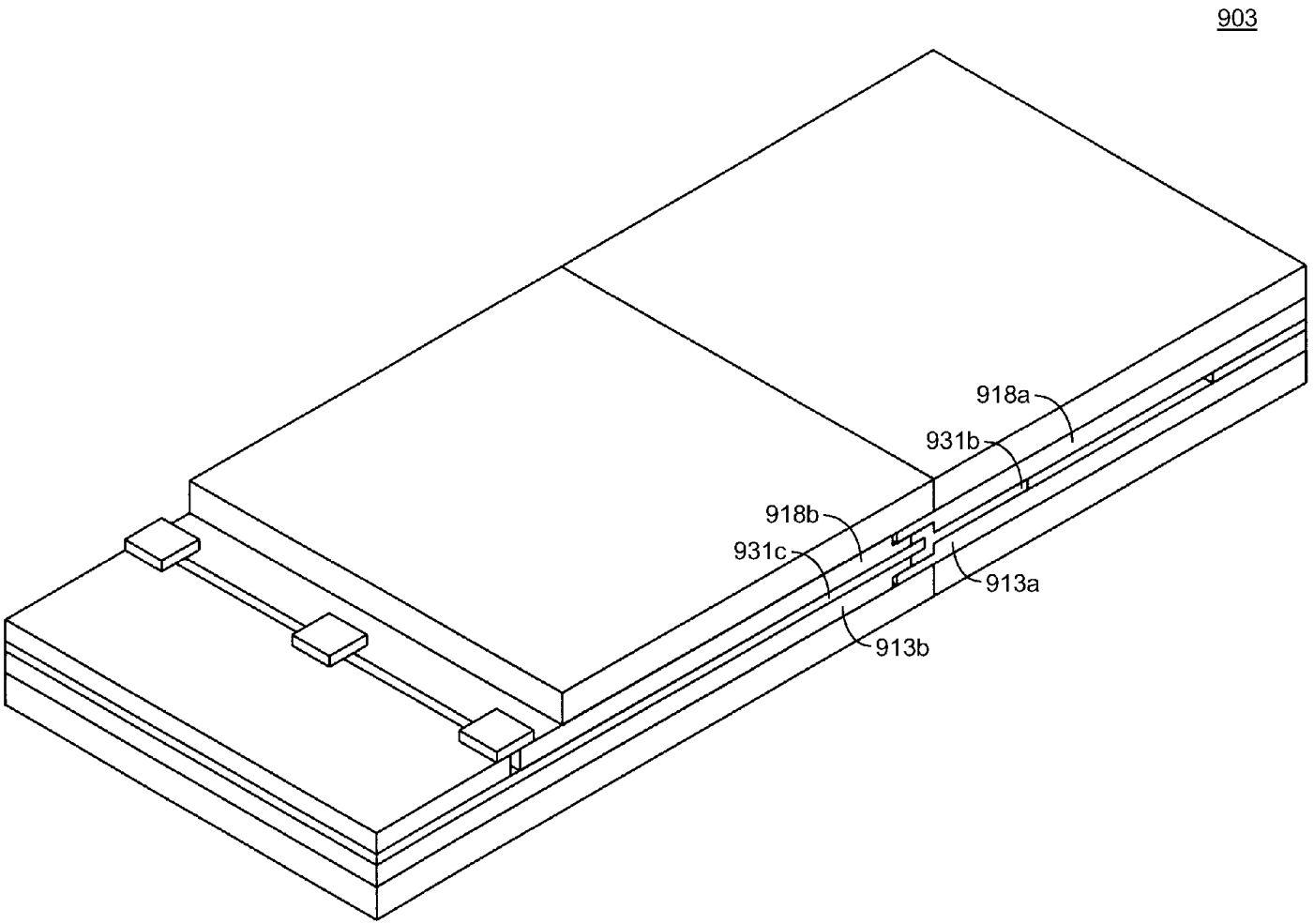
FIG. 9D shows a perspective view of a transmission line duct with opposing anode and cathode walls with a detachable switch module in an attached configuration in accordance with an embodiment of the present invention.

FIG. 9D shows a perspective view 903 of the transmission line duct 993 and detachable power module 994 of FIG. 9C in an attached configuration. Dielectric wall 931*b* and transmission line dielectric 931*c* interlock as a tongue-in-groove. Anode wall 918 overlaps upper conductor plate 918*b*, and cathode wall 913*a* overlaps bottom conductor plate 913*b*. The detachable power module is desirable when an array of transmission line ducts 993 are arranged in the same fluid electrolyte circuit. If a power module 994 fails, it can be replaced without disturbing the fluid electrolyte circuit.

In an electrolytic cell with an aqueous electrolyte, a nominal double-layer capacitance of 20 microfarads per square centimeter and an electrode area of 25 square centimeters, the average current required to charge the capacitance to one volt in one microsecond is on the order of 500 amperes. Faster charging times will require proportionally larger currents, with peak currents on the order of thousands of amperes.

For an electrolytic manufacturing process that requires large total electrode areas in order to obtain a reasonable throughput, driving a single large electrolytic cell (e.g., plating bath) will be very difficult. Thus, it is an aspect of the present invention to provide a compact module that combines an electrolytic cell with a local power supply. Another aspect of the invention is the combination of an array of compact modules to provide a large total electrode area.

The inductance of a circuit element increases with length. It is thus desirable to minimize the circuit path between the switch and the anode/cathode of a high-speed electrolytic cell. Instead of increasing the size of a power supply and the electrolytic cell it serves, the electrolytic cell can be divided into a plurality of smaller cells, each with a dedicated power supply. To reduce the overall load capacitance and thus reduce the peak current, an array of electrolytic cells may be configured in series. The smaller capacitance will reduce the charging current that is required; however, the overall applied voltage will be increased.

Figure 10A:
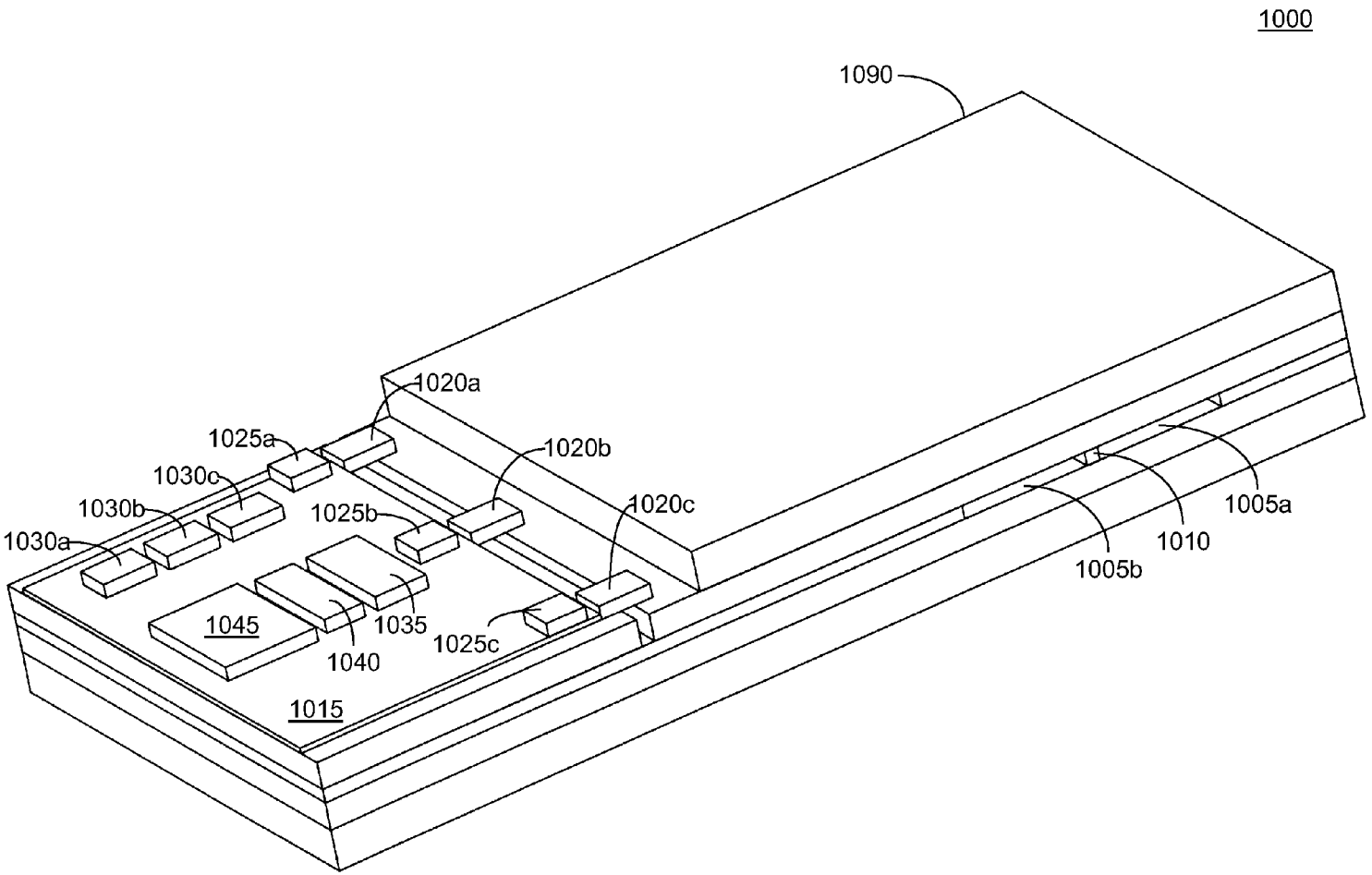
FIG. 10A shows a perspective view of a dual duct transmission line with an integrated power supply in accordance with an embodiment of the present invention.
Figure 10B:
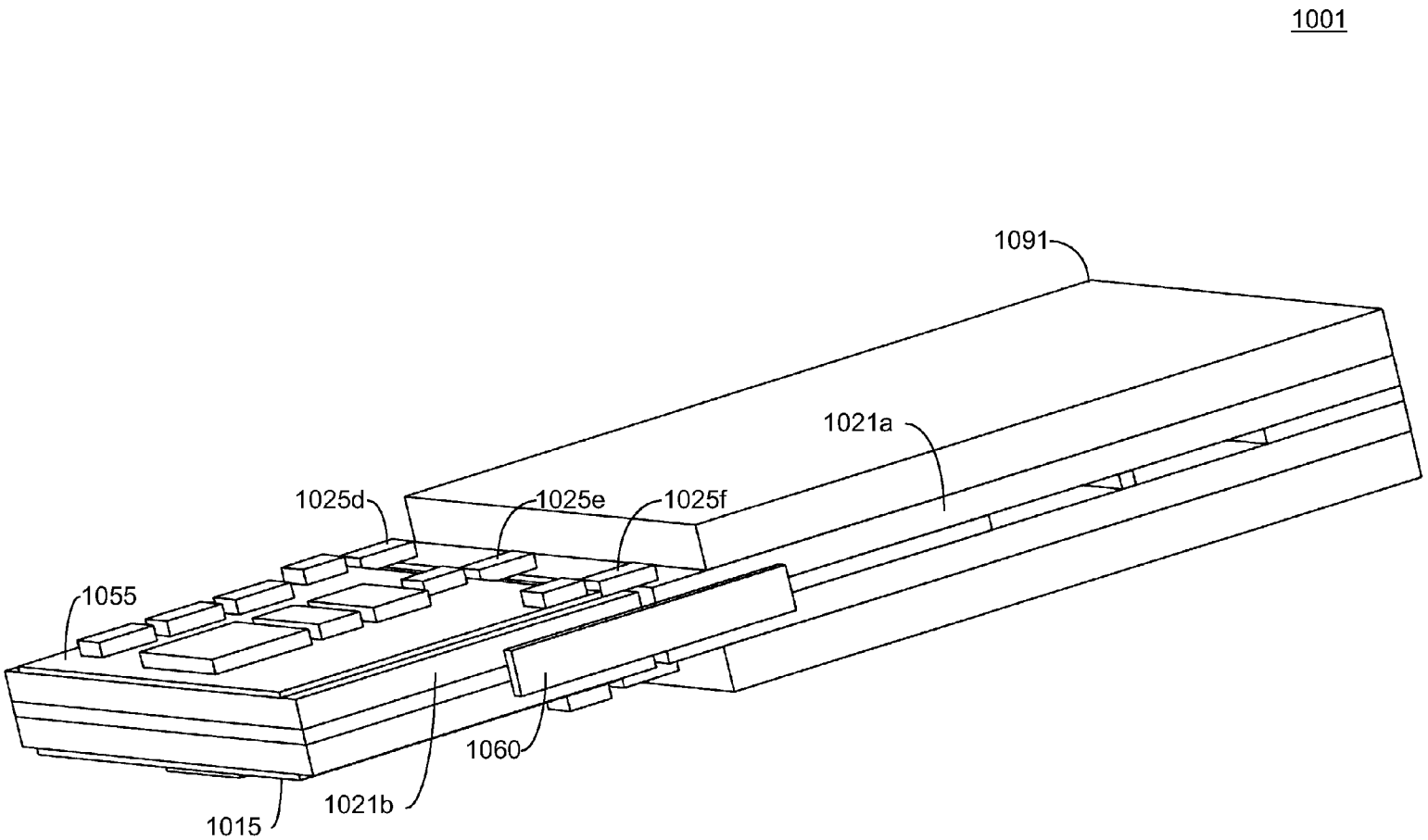
FIG. 10B shows a perspective view of a dual duct transmission line with an integrated power supply and dual switching in accordance with an embodiment of the present invention.

FIG. 10A shows a perspective view 1000 of an embodiment of an electrolytic module 1090 that is derived from the transmission line duct 992 shown in FIG. 9B. The duct channel 936 of transmission line duct 992 has been subdivided by a septum 1010 to produce two adjacent duct channels 1005*a* and 1005*b*. Septum 1010 may be used to provide additional dimensional stability and accuracy for closely spaced anodes and cathodes. A control circuit board 1015 has also been added. Vias may be used to connect circuit elements on the circuit control board 1015 to the transmission line conductors.

Control circuit board 1015 provides a number of control functions for the switch transistors 1020*a*, 1020*b*, and 1020*c*. Bypass capacitors 1025*a*, 1025*b*, and 1025*c* are in close proximity to switch transistors 1025*a*, 1025*b*, and 1025*c*, and serve to minimize voltage drops at turn-on. Bypass capacitors 1025*a*, 1025*b*, and 1020*c* preferably have a low equivalent series resistance. Multiple capacitors may be used in parallel for each transistor. Transistor driver 1035 provides the drive signal to switch transistors 1020*a*, 1020*b*, and 1020*c*. Transistor driver 1035 may be a MOSFET driver, and more than one may be used to drive the switch transistors 1020*a*, 1020*b*, and 102*c*. Waveform generator 1040 provides the waveform that is amplified by transistor driver(s) 1035. Voltage regulators 1030*a*, 1030*b*, and 1030*c* provide the supply voltages to switch transistors 1020*a*, 1020*b*, and 1020*c*.

Microcontroller 1045 controls the output voltages of voltage regulators 1030*a*, 1030*b*, and 1030*c*. Microcontroller 1045 may have a built-in Analog-to-digital conversion capability that provides for adjustment of the voltage regulators in response to measured 1-V characteristics of the anode and cathode. Microcontroller 1045 may also have a communications capability that allows it to be networked with a master controller, thus allowing a central master controller to control an array of electrolytic modules 1090. Examples of devices suitable for use as microcontroller 1045 are the Z8 Encore!® 8K Series of 8-bit microcontrollers manufactured by Zilog, Inc.

The functions described in relation to circuit board 1015 may be provided by different configurations of integrated circuits and discrete devices. Field programmable gate arrays (FPGAs) or application specific integrated circuits (ASICs) may also be used. Additional switch transistors, bypass capacitors, and voltage regulators may be added to provide more complex output waveforms.

FIG. 103 shows a bottom perspective view 1001 of an embodiment of a double-switched electrolytic module 1091 that is derived from the electrolytic module 1090 shown in FIG. 10A. The cathode wall 921 of electrolytic module 1090 has been divided into a cathode wall 1021*a* and a switch plate 1021*b*, which are coupled by switching transistors 1025*d*, 1025*e*, and 1025*f*. A circuit board 1055 is coupled to switch plate 1021*b*, and serves to drive switching transistors 1025*d*, 1025*e*, and 1025*f*. The use of two sets of switches allows both terminals of the electrolytic cell to be driven, thus enabling the use of a bridge configuration. Circuit board 1055 may be configured as a slave circuit, with circuit board 1015 serving as a master. In slave mode, circuit board 1055 may or may not include a microcontroller and/or waveform generator. Stiffener 1060 has been added to prevent the loss mechanical integrity that may occur from the division of the cathode wall. Modifications to the location of the switched gaps and to the backup plates may also be made to improve mechanical integrity.

Figure 10C:
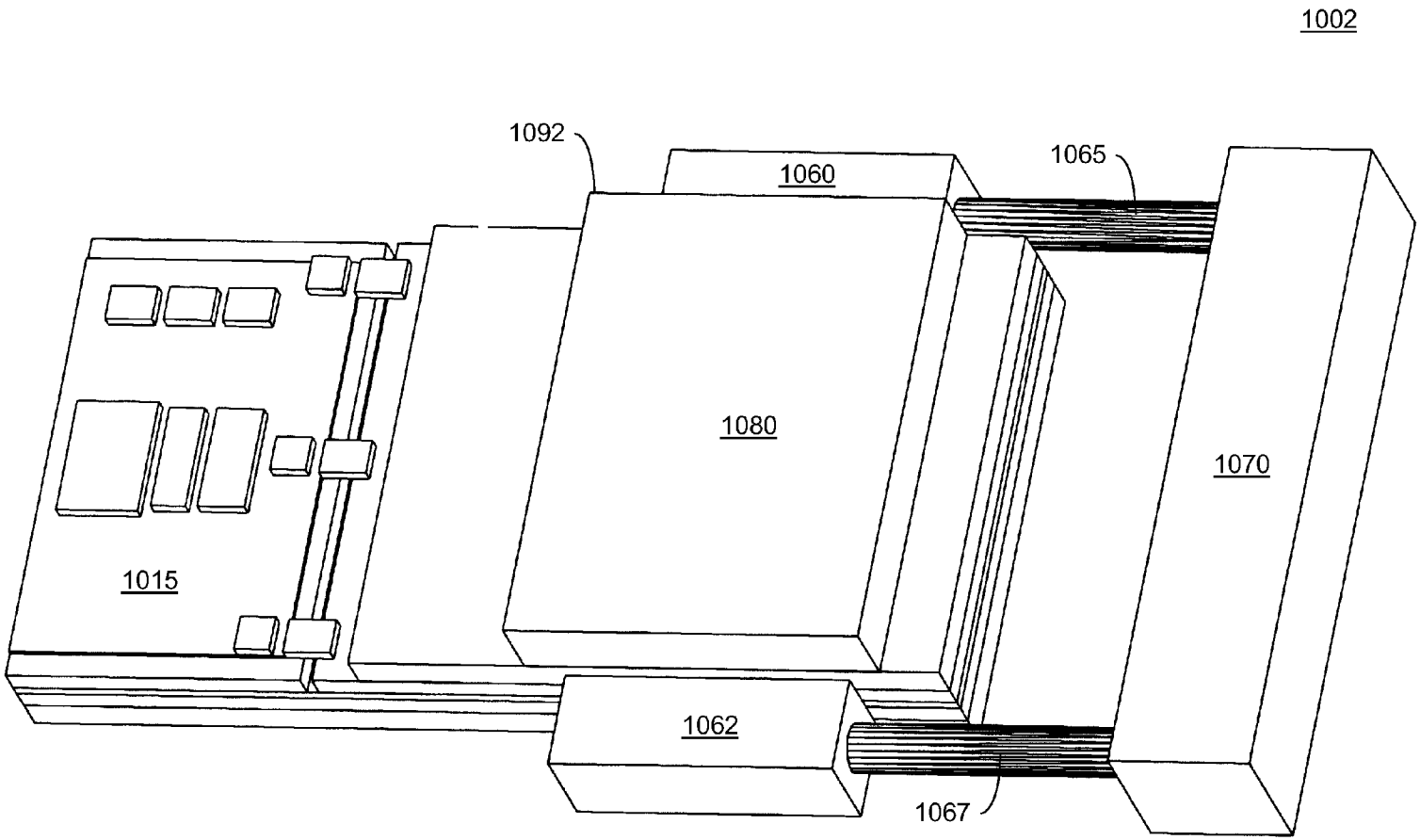
FIG. 10C shows a perspective view of an illuminated transmission line duct coupled to an electrolyte circulation system in accordance with an embodiment of the present invention.

FIG. 10C shows a perspective view 1002 of an illuminated electrolytic module 1092 that is derived from the electrolytic module 1090 of FIG. 10A. An input adapter 1060 and an output adapter 1062 are coupled to a circulation pump 1070 by conduits 1065 and 1067, respectively. Input adapter 1060 and output adapter 1062 are coupled to opposite ends of the channel duct of electrolytic module 1092 to provide forced flow of electrolyte through the channel duct.

Illumination module 1080 may be provided as a photon source for use with transparent backup plate/electrode assemblies to provide radiation at an electrode surface to assist redox reactions. The illumination module may be a continuous source or it may be a pulsed source. The illumination module may be controlled by the circuit board 1015. As a pulsed source, the illumination module may be synchronized with a switch driver waveform output by the circuit board 1015.

The illumination module 1080 may be a monochromatic light source or a filtered light source for providing a limited spectrum. Light emitting diodes (LEDs) and/or laser diodes may be used as elements in the illumination module 1080. The illumination module 1080 may include fiber optics or other transmission means to couple the electrolytic module 1092 to a remote photon source (e.g., a tunable dye laser).

Figure 11:
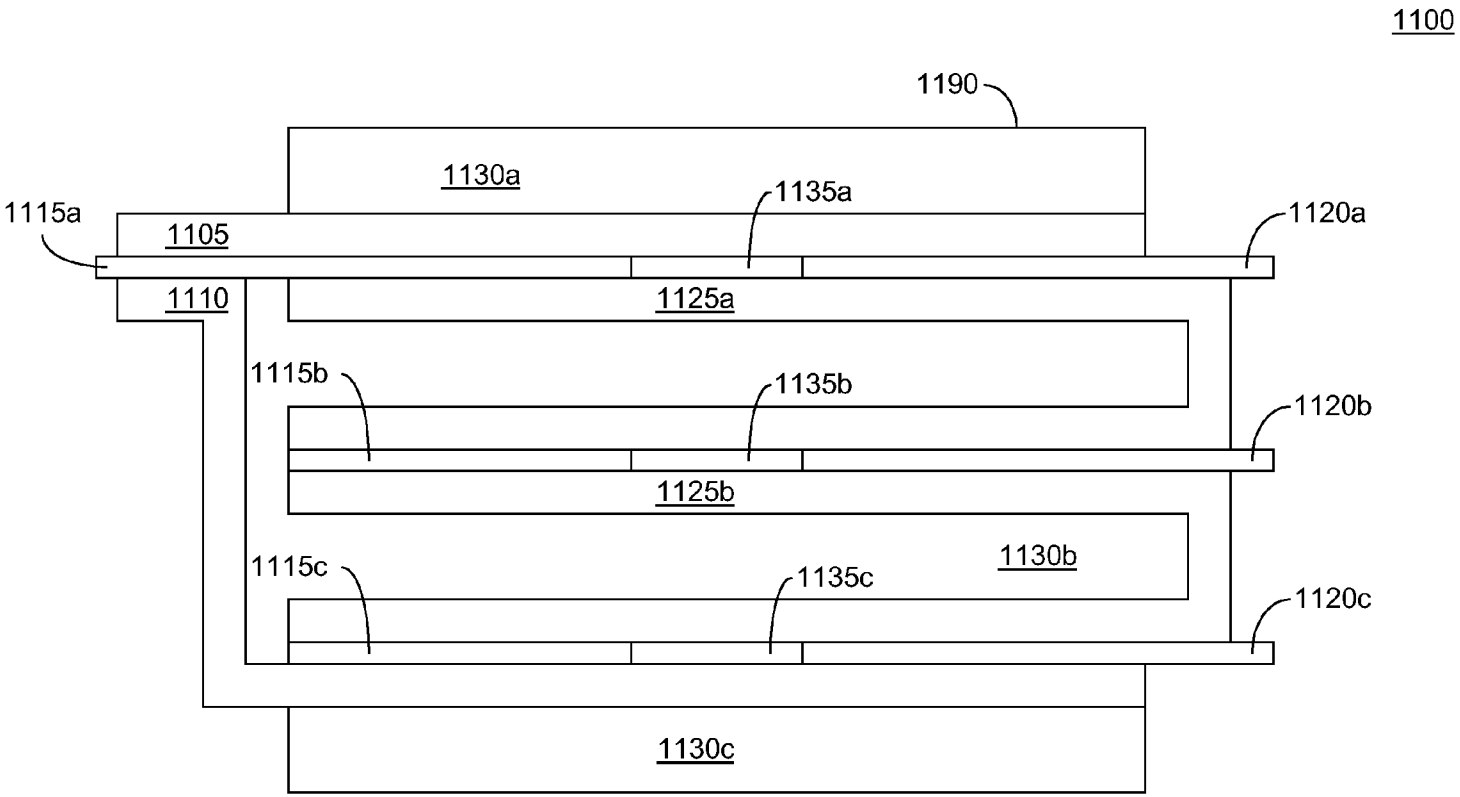
FIG. 11 shows an electrolytic module with multiple channel ducts in a series configuration in accordance with an embodiment of the present invention.

FIG. 11A shows a cross-section view 1100 of an embodiment of an electrolytic module 1190 that includes an array of transmission line ducts that are electrically connected in series. The electrolytic module 1190 is constructed using the transmission line duct 991 of FIG. 9A as a basic building block. The dielectric and conductive elements have been modified to provide the serial configuration shown in FIG. 11.

Anode 1105 and cathode 1110 provide terminals for connection to a power supply. Anode 1105 is separated from composite electrode 1125*a* by dielectric walls 1115*a* and 1120*a*. Composite electrode 1125*a* is separated from composite electrode 1125*b* by dielectric walls 1115*b* and 1120*b*. Cathode 1110 is separated from composite electrode 1125*b* by dielectric walls 1115*b* and 1120*b*. Composite electrodes 1125*a* and 1125*b* each serve as an anode to one electrolytic cell, and as a cathode to an adjacent cell. Backup plate structures 1130*a*, 1130*b*, and 1130*c* support the electrodes and provide mechanical integrity. Backup plate structures 1130*a*, 1130*b*, and 1130*c* may be in part fabricated by vacuum encapsulation or injection molding around a stack of components.

The serial connection of the electrodes in electrolytic module 1190 requires that the electrolyte volumes with each of the duct channels 1135*a*, 1135*b*, and 1135*c*, be electrically isolated from each other. It is also important that each channel duct have the same electrode areas so that the potential applied to the electrolytic module 1190 will be evenly divided across the duct channels 1135*a*, 1135*b*, and 1135*c*. This may be achieved by the use of photolithographic techniques and thin film deposition on ceramic substrates.

The RC time constant of the electrolytic module 1190 is substantially the same as that for a single transmission line duct. Although the serial connection reduces the net capacitance, the capacitance reduction is offset by the series resistance increase. However, the increased complexity of the electrolytic module 1190 allows for the use of smaller drive currents at higher voltages. This reduces the voltage transients associated with fast switching.

Figure 12A:
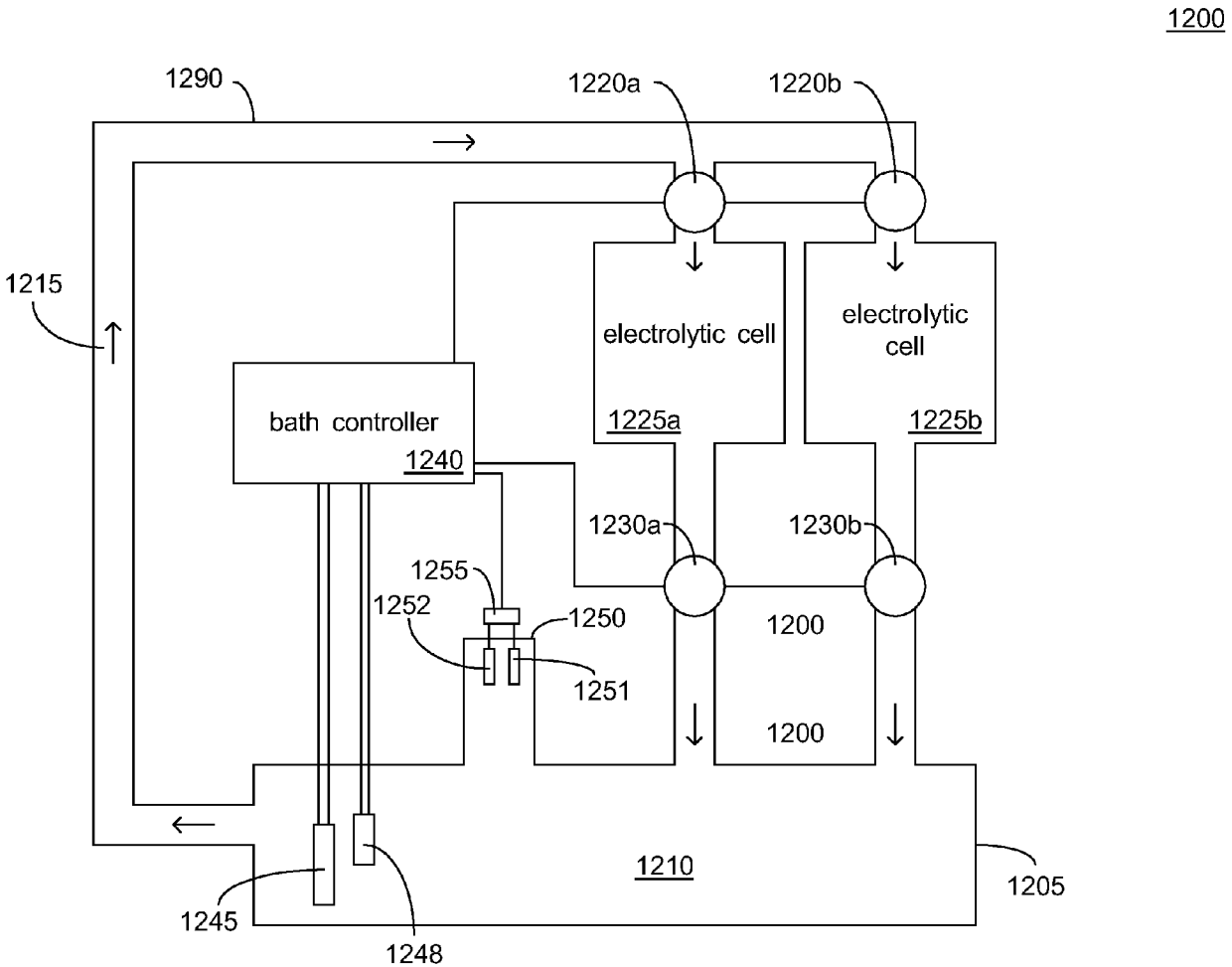
FIG. 12A shows a schematic view of an electrolyte recirculation system with electrically isolated cells in accordance with an embodiment of the present invention.

FIG. 12A shows a schematic view 1200 of an electrolyte recirculation system 1290. An electrolyte reservoir 1205 contains an electrolyte volume 1210. A sensor array 1245 and a heating module are immersed in the electrolyte volume. 1210 and coupled to a bath controller 1240. The sensor array 1245 provides information to the bath controller 1240 regarding the bath conductivity and/or composition. The heating module 1248 maintains the temperature of the electrolyte volume. An electrolyte conduit 1215 couples the electrolyte volume to pumps 1220*a* and 1220*b*, which are controlled by bath controller 1240. Pumps 1220*a* and 1220*b* may be isolation pumps that provide isolation between the conduit 1215 and electrolytic cells 1225*a* and 1225*b*, respectively.

Electrolytic cells 1225*a* and 1225*b* preferably include transmission line ducts similar to those previously described. In a preferred embodiment, the electrodes of electrolytic cells 1225*a* and 1225*b* are connected in series in a manner similar to that shown in FIG. 11. Output isolators 1230*a* and 1230*b* may be isolation pumps or they may be passive piston/cylinder/valve configurations that provide a discontinuity in the ionic conductance path while maintaining electrolyte flow. Although electrolytic cells 1225*a* and 1225*b* could be provided with independent electrolyte fluid circuits, better process uniformity may be obtained by using a mixed common electrolyte and electrical isolation of the cells.

Figure 12B:
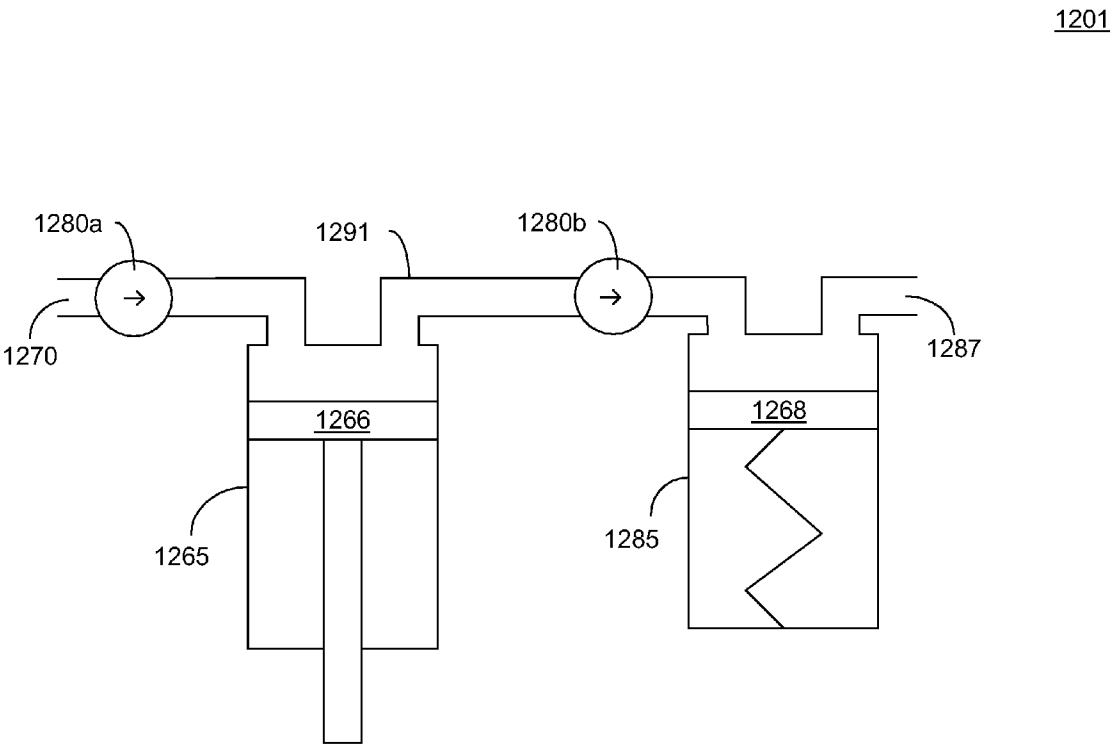
FIG. 12B shows a schematic view of an isolation pump for an electrolyte recirculation system in accordance with an embodiment of the present invention.

A secondary electrolytic cell 1250 provides for modification of the electrolyte composition and is coupled to bath controller 1240. Anode 1251 and cathode 1252 are controlled by the bath controller 1240 and are immersed in the electrolyte 1210. Anode 1251 may be a consumable anode. Secondary electrolytic cell 1250 may be used to provide redox reactions that may or may not involve electrodeposition. Anode 1251 may be a consumable anode FIG. 12B shows a schematic diagram 1201 of an embodiment of an isolation pump 1291. A first check valve 1280*a* has an electrolyte inlet port 1270 and an output coupled to the input of a first stage pump cylinder 1265. The output of the first stage pump cylinder is coupled to a second check valve 1280*b*. The output of check valve 1280*b* is coupled to the input of a snubber 1285. The output of snubber 1285 is the electrolyte output port 1287. Snubber piston 1268 provides damping of the output fluctuations.

Check valves 1280*a* and 1280*b* are controlled to allow only one valve to be open at one time. A dead zone may also be employed so that there is a minimum period of time during which both valves are kept closed before either is opened. The dead zone eliminates transient completion of an ionic conduction path. The wetted parts of check valves 1280*a* and 1280*b* are preferably constructed of dielectric materials (e.g., a fluorocarbon polymer) so that electrical conduction does not occur between the input and output connections.

An operation cycle for the isolation pump 1291 begins with both valves closed and the piston stationary in the up position. After valve 1280*a* is opened, a piston downstroke is made then valve 1280*a* is closed. After the dead zone period, valve 1280*b* is opened and the piston upstroke is made then valve 1280*b* is closed.

Figure 13A:
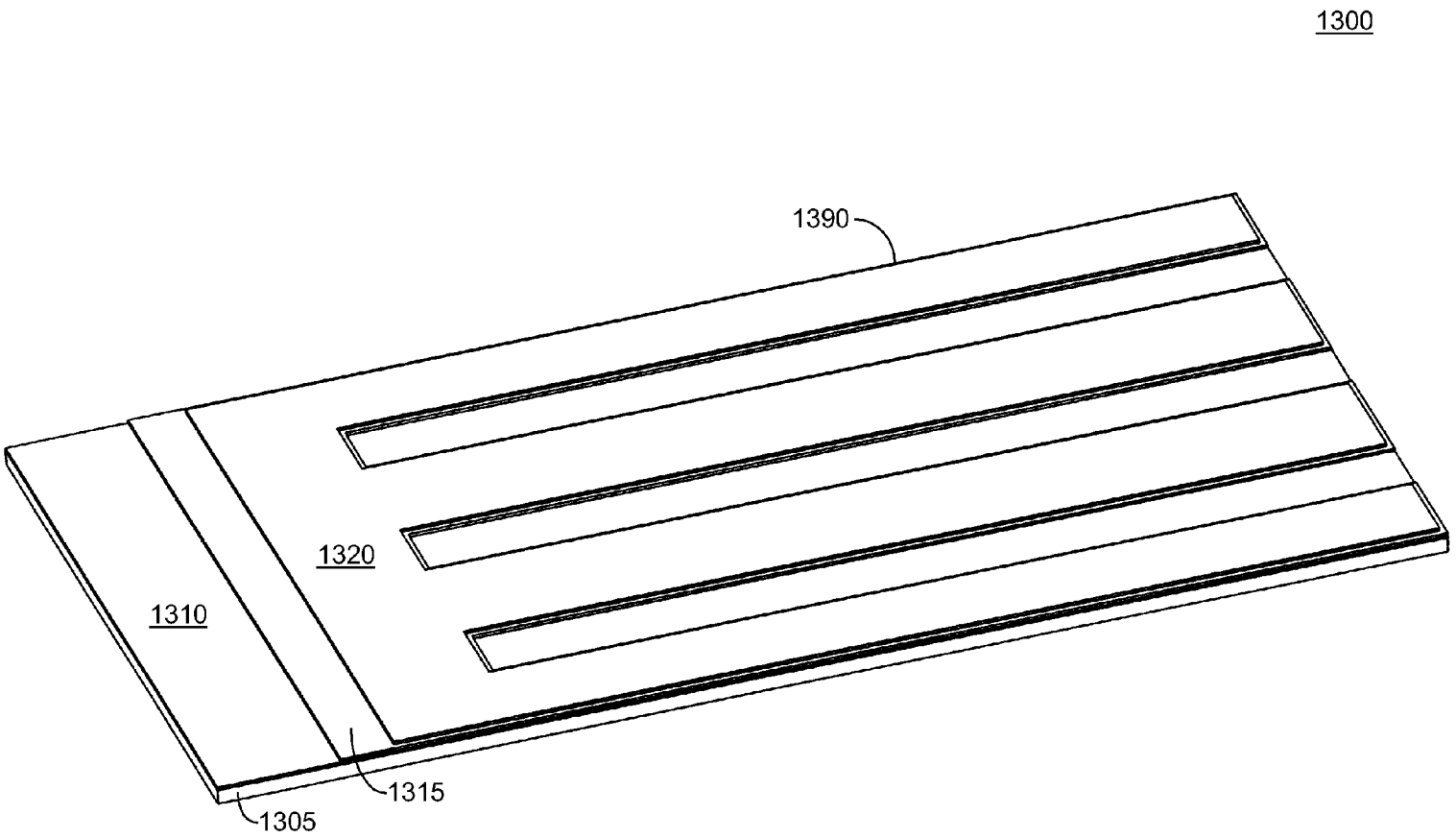
FIG. 13A shows a perspective view of a parallel plate transmission line anode/cathode assembly on a dielectric substrate in accordance with an embodiment of the present invention.

FIG. 13A shows a perspective view 1300 of an embodiment of a parallel plate (microstrip) transmission line 1390 including an anode 1310, a dielectric 1315 and a cathode 1320 on a dielectric substrate 1305. The dielectric substrate 1305 may be a ceramic material, or it may be silicon substrate with a dielectric coating such as silicon dioxide or silicon nitride.

Figure 13B:
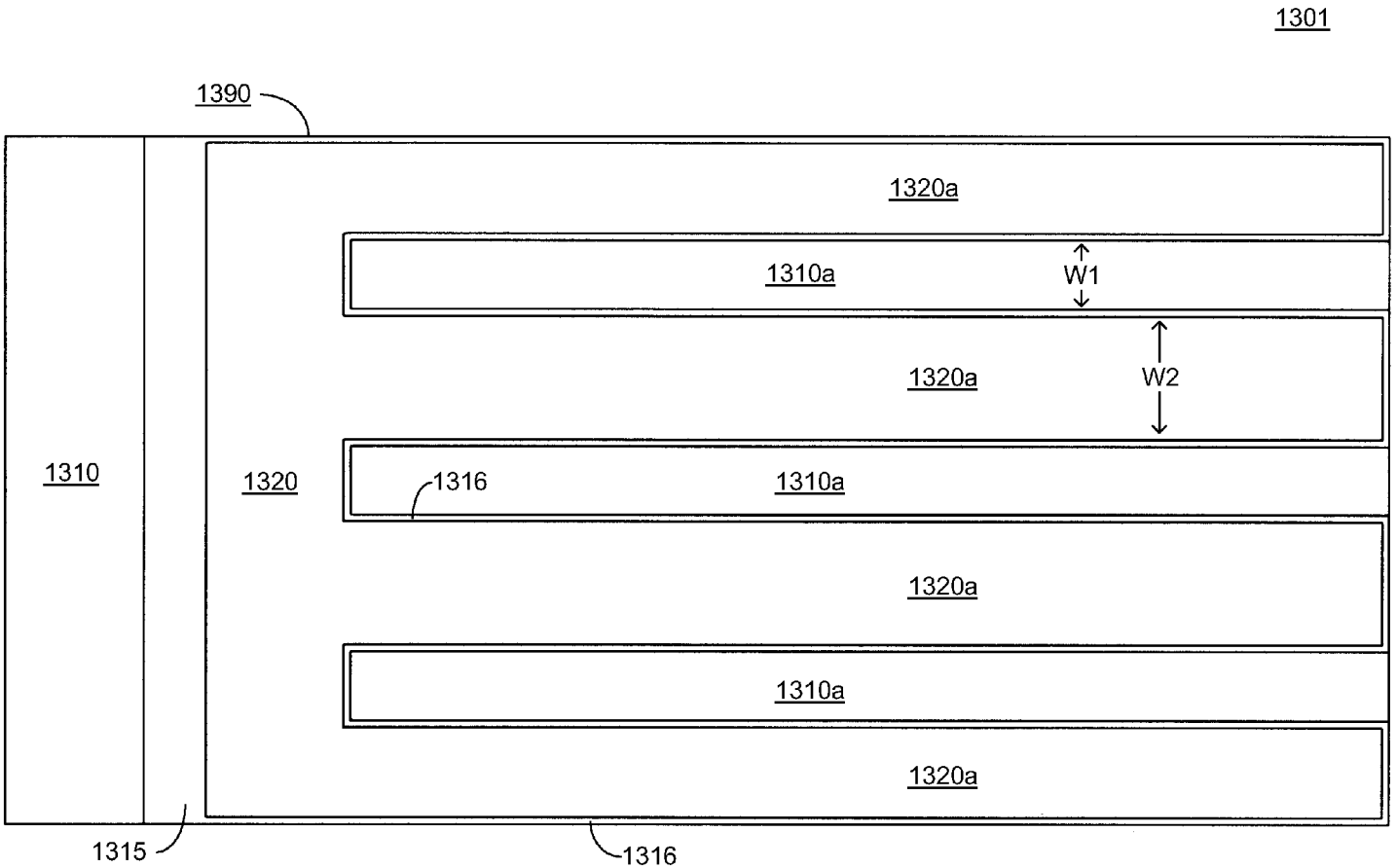
FIG. 13B shows a top view of the parallel plate anode/cathode assembly of FIG. 13A.

FIG. 13B shows a top view 1301 of the parallel plate transmission line 1390 of FIG. 12A. The anode 1310 is essentially a continuous sheet of conductive material deposited on the surface of dielectric substrate 1305. A deposited dielectric film 1315 separates the anode 1310 from the cathode 1320. The dielectric 1316 has an apron region 1316 extending out from the edge of the cathode 1320. The cathode 1320 includes an array of fingers 1320*a* having a width W2, adjacent to anode stripes 1310*a* having a width W1. The ratio W1/W2 may be varied to adjust the electrode area ratio. For a given substrate area, decreasing W1 and W2 decreases the total resistance between the anode 1310 and the cathode 1320. The pattern 1390 may stepped and repeated over a large area with bus connections to each pattern. W1 and W2 may be on the order of a micron.

Due to a large resistance or a large capacitance, or both, the RC time constant of an electrolytic cell may prevent the voltage across the double-layer capacitance in the cell from rising quickly enough to suit a particular process. In this instance, a voltage greater than the desired working cell voltage may be applied for a short duration to accelerate charging or discharging of the double-layer capacitance.

Figure 14:
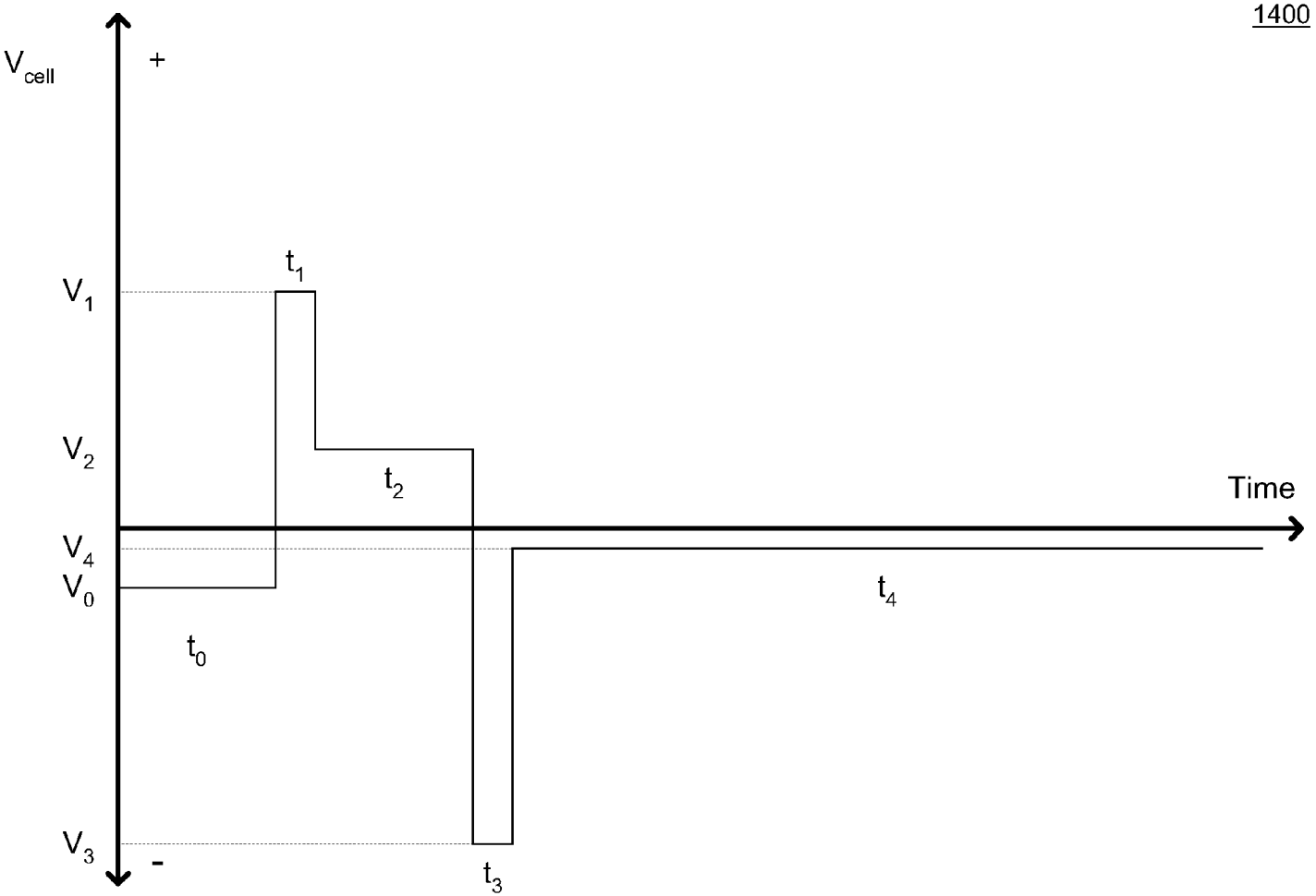
FIG. 14 shows an electrolytic cell power supply output waveform in accordance with an embodiment of the present invention.

FIG. 14 shows a diagram 1400 for an embodiment of a waveform applied to an electrolytic cell for control of an interphase in an electrolytic cell. It is important to note that $V_{cell}$ is the voltage applied to the electrolytic cell as a whole. At the beginning of an electrolytic process a voltage $V_0$ is applied for a period $t_0$. The application of $V_0$ establishes a concentration profile for each of the charged species within the interphase at the electrodes of the electrolytic cell. The length of period $t_0$ is preferably sufficient for the concentration profiles of the species of interest to equilibrate. $V_0$ is generally a voltage at which no intended redox reactions occur, although a small current may be observed due to redox reactions involving impurities. Although $V_0$ is shown to be opposite in polarity to $V_1$ and $V_2$, it may be of the same polarity. The waveform of FIG. 14 may be produced by the system shown in FIG. 3A.

For example, if the intended electrolytic process is a reduction reaction at the cathode, the application of $V_0$ to the electrode serving as the anode will produce a positive charge at the cathode. This positive charge will lower the cation concentration within the interphase at the cathode surface and increase the anion concentration in the interphase at the cathode surface. The mean distance between the cathode surface and the cations within the interphase will be increased.

Subsequent to period $t_0$, a voltage $V_1$ is applied for a period $t_1$. $V_1$ is a voltage that is greater in magnitude than the voltage $V_2$ at which the intended reaction will occur. For systems including a solvent and a dissolved electrolyte, $V_1$ may be equal to or greater than the cell potential at which the solvent is oxidized and/or reduced. For embodiments in which the electrolyte has a low conductivity, it is preferred that $V_1$ be greater than the voltage at which solvent electrolysis occurs.

It is important that $V_1$ and $t_1$ are closely controlled, since overcharging of the double-layer capacitance may occur. In processes where $V_1$ is greater than the voltage at which solvent electrolysis occurs, electrolysis is inevitable if $t_1$ is not sufficiently limited. The purpose of the ($V_1$, $t_1$) pulse is to overcome the RC time constant of the electrolytic cell. Ideally, at the end of $t_1$, the potential across the double-layer capacitance is equal to the desired process potential associated with the cell voltage $V_2$, and has been reached in a time $t_1$ that is less than the time it would have taken if $V_2$ were applied directly.

The change in polarity from $V_0$ to $V_1$ and the magnitude of $V_1$ may result in large currents during the initial charging of the double-layer capacitance. It is important that the power supply providing $V_1$ have a low inductance and a low internal resistance so that current lag and limiting are minimized.

$V_2$ is the cell voltage at which the desired reaction (e.g., reduction at the cathode) occurs. $V_2$ may be the voltage associated with the onset of the reaction, but is preferably one hundred millivolts or more higher. Due to the small distances and short timescales involved with the interphase, it is desirable to carry out redox reactions with large overpotentials so that charge transfer kinetics are not a limiting factor. It is preferable that $V_2$ provide a sufficiently large reaction overpotential so that the time required for migration of a cation to the electrode is large compared to the time required for its reduction.

During the application of ($V_1$, $t_1$) and ($V_2$, $t_2$), cations will migrate toward the cathode, and their velocity will be influenced by charge, mass, and solvation. Not all cations will have the same velocity under the influence of the applied voltage, thus there will be a degree of segregation between the cations. Segregation may occur between cations with the same mass and different charge, or between cations with the same charge and different mass. The first species to arrive at the cathode will tend to be those with the greatest mobility. The period $t_2$ may be ended shortly after the first reduction reactions occur, thus limiting reaction participation to the initially closer and faster cations.

At the end of period $t_2$ a voltage $V_3$ is applied for a period $t_3$. The purpose of $V_3$ is to quickly remove the charge acquired by the double-layer capacitance during the application of $V_1$ and $V_2$. This charge removal helps to reset the electrolytic cell so that another pulse cycle can be applied. The application of $V_3$ for the period $t_3$ may be omitted from the waveform; however, the discharge of the double-layer capacitance may require a longer time. For processes involving the application of a series of pulses, the ($V_3$, $t_3$) segment may be used to increase the pulse rate, and thus the throughput of the process.

At the end of period $t_3$ voltage $V_4$ is applied for a period $t_4$. In this instance, $V_4$ is shown as being different from $V_0$; however, $V_4$ may be equal to $V_0$. In the application of a series of pulses, the ($V_0$, $t_0$) segment may be absent altogether (e.g., V0=0). In addition, $V_4$ is shown as being of opposite polarity from $V_1$ and $V_2$; however, $V_4$ may be of the same polarity as $V_1$ and $V_2$. $V_4$ serves as a reference voltage at which the electrolytic cell is allowed to equilibrate before the next application of $V_1$. In one embodiment, the period $t_4$ is at least ten times greater than the sum of $t_1$ and $t_2$. In another embodiment, the period t4 is at least 100 times greater than the sum of $t_1$ and $t_2$. Since cation diffusion can be significantly slower than cation migration in a large electric field, a relatively long period may be required for the equilibrium concentration of the cationic species being reduced to be restored in the interphase and the adjacent region in the bulk electrolyte.

Figure 15:
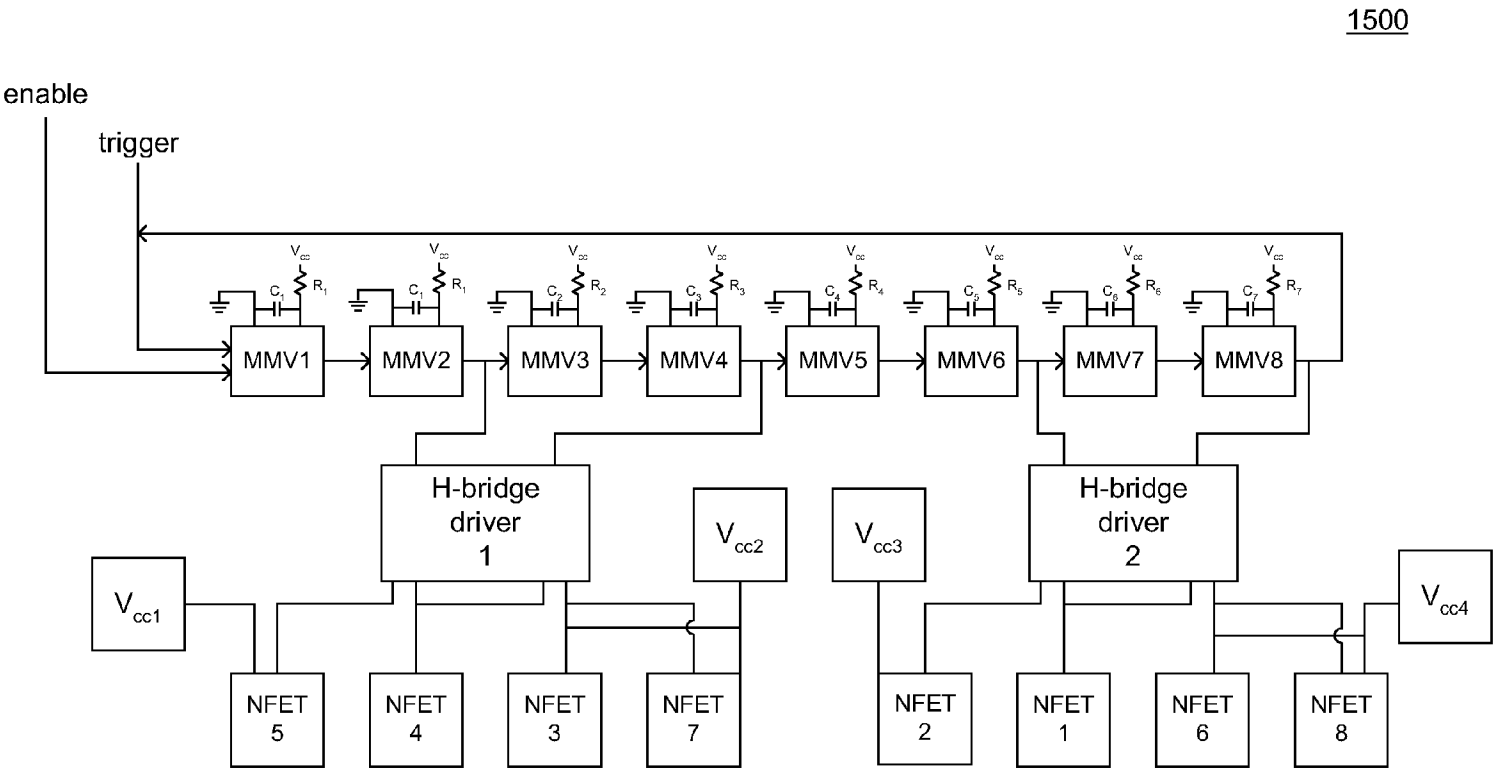
FIG. 15 shows an electrolytic cell power supply circuit schematic diagram in accordance with an embodiment of the present invention.

FIG. 15 shows a block schematic view 1500 of an embodiment of an electrolytic cell power supply. A cascade of monostable multivibrators MMV1, MMV2, MMV3, MMV4, MMV5, MMV6, MMV7, and MMV8 form a tapped ring oscillator in which each of the multivibrators MMV1, MMV2, MMV3, MMV4, MMV5, MMV6, MMV7, and MMV8 produces an output pulse with a length that is determined by the time constants $R_1C_1$, $R_2C_2$, $R_3C_3$, $R_3C_3$, $R_3C_3$, $R_4C_4$, $R_5C_5$, $R_6C_6$, $R_7C_7$ and $R_8C_8$, respectively. The output pulse of MMV1 provides a delay between the output pulses from MMV8 and MMV2 to avoid shoottrough in the NFETs. The output pulse of MMV2 drives a first high input and a first low input of H-bridge driver 1. The output pulse of MMV3 provides a delay between output pulse from MMV2 and MMV4 to avoid shoottrough in the NFETs. The output pulse of MMV4 drives a second high input and a second low input of H-bridge driver 1. An example of a monostable multivibrator suitable for use in the ring oscillator is the TC7WH7123FU from the Toshiba Corporation.

The output pulse of MMV5 provides a delay between the output pulses from MMV4 and MMV6 to avoid shoottrough in the NFETs. The output pulse of MMV6 drives a first high input and a first low input of H-bridge driver 2. The output pulse of MMV7 provides a delay between output pulse from MMV6 and MMV8 to avoid shoothrough in the NFETs. The output pulse of MMV8 drives a second high input and a second low input of H-bridge driver 1.

A first pair of outputs of H-bridge driver 1 drives high side NFET5 and low side NFET4. A second pair of outputs of H-bridge driver 1 drives high side NFET3, high side NFET7, and low side NFET4. A first pair of outputs of H-bridge driver 2 drives high side NFET8 and low side NFET1. A second pair of outputs of H-bridge driver 2 drives high side NFET6, high side NFET8, and low side NFET1.

The circuit of FIG. 15 can be turned on and off by TTL level signals at the enable and trigger input. One or more of resistors $R_1$, $R_2$, $R_3$, $R_4$, $R_5$, $R_6$, $R_7$, and $R_8$ may be digitally controlled potentiometers to allow for altering the pulse width of the monostable multivibrators by a digital signal (e.g., from a microcontroller). Digital potentiometers frequently have a parasitic capacitance, and it must be taken into account when selecting the value for the timing capacitors $C_1$, $C_2$: $C_3$, $C_4$, $C_5$, $C_6$, $C_7$, and $C_8$. An example of a digital potentiometer suitable for use is the AD5222 Dual Digital Potentiometer manufactured by Analog Devices, Inc.

A suitable device for use as H-bridge driver 1 and H-bridge driver 2 in FIG. 15 is the HIP4081A manufactured by the Intersil Corporation. A bridge driver circuit such as the HIP4081A is preferred as a driver for MOSFETs since the use of PFETs can be avoided, allowing all of the output MOSFETs to be NFETs. A Hosting gate drive for the high side NFETs allows the supply voltages $V_{cc1}$, $V_{cc2}$, $V_{cc3}$, and $V_{cc4}$ to be significantly larger than the gate-to-source voltage ($V_{gs}$) on the high side NFETs. $V_{gs}$ is typically less than or equal to 15 volts.

Figure 16:
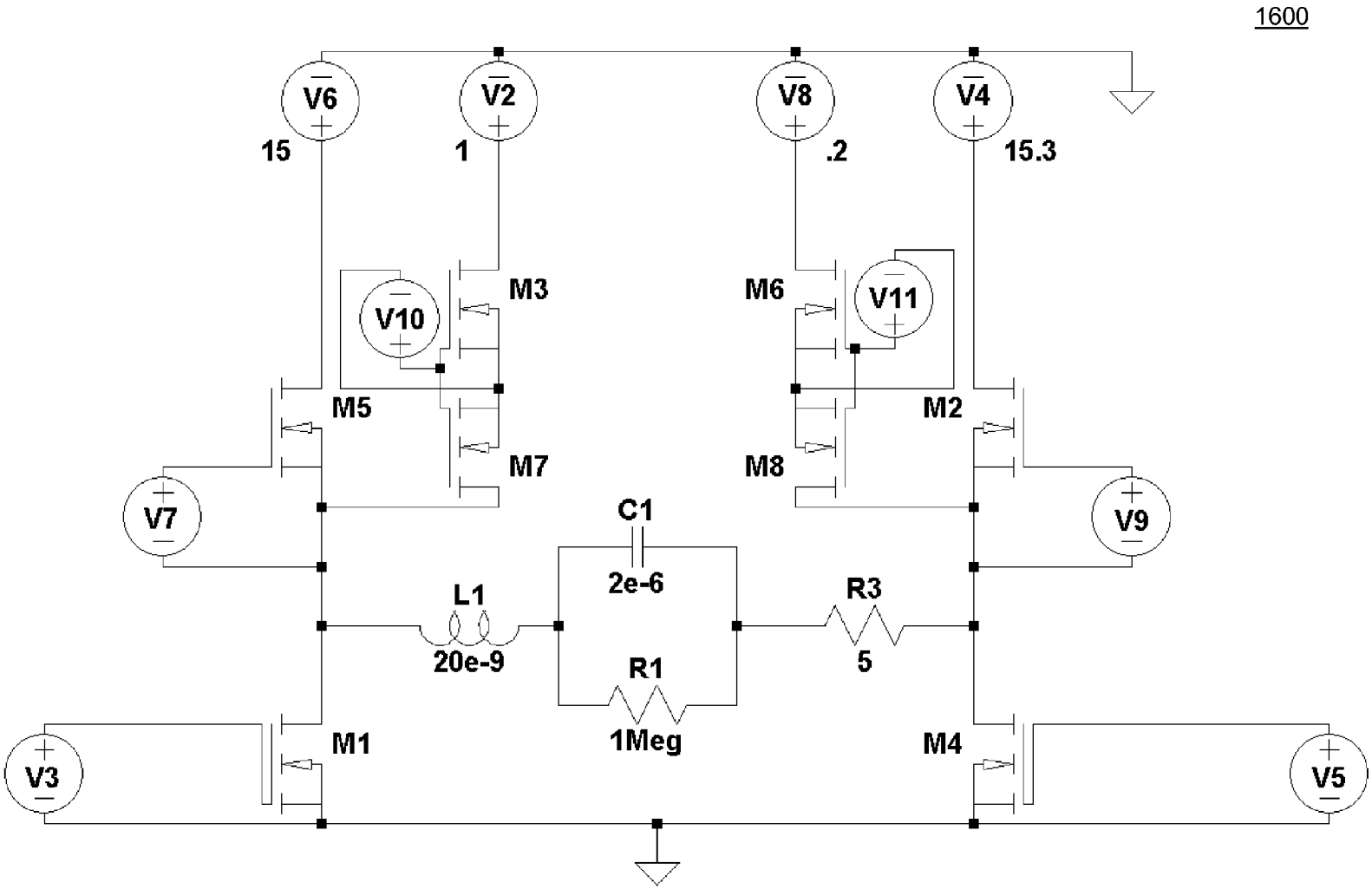
FIG. 16 shows a schematic diagram of an output stage of an electrolytic cell power supply in accordance with an embodiment of the present invention.

FIG. 16 shows an electrical schematic diagram 1600 of an embodiment of an NFET output stage of an electrolytic cell power supply. Transistors M1, M2, M3, M4, M5, M6, M7, and M8 correspond to NFET1, NFET2, NFET3, NFET4, NFET5, NFET6, NFET7, and NFET8, respectively of schematic diagram 1500. A bad circuit consisting of C1=2 microfarads, R1=one megohm, and R3=5 ohms represents an arbitrary bad model of an electrolytic cell. An inductance of L1=20 nanohenries is in series with the electrolytic cell. The value for R1=one megohm represents a leakage current. The model is intended to illustrate the charging and discharging behavior of C1, and no appreciable redox reactions are involved.

Low side NFETs M1 and M4 are driven by sources V3 and V5 respectively, High voltage NFETs M5 and M2 are driven by sources V7 and V9, respectively. Low voltage NFETs M7 and M3 are driven by source V10. NFETs M7 and M3 are configured back-to-back to prevent diode conduction when M5 is on. Similarly, Low voltage NFETs M6 and M8 are driven by source V10 and are configured back-to-back to prevent diode conduction when M2 is on. As an alternative, the back-to-back NFET combination could be replaced by a NFET in series with an external diode at the expense of the diode forward voltage drop.

Figure 17A:
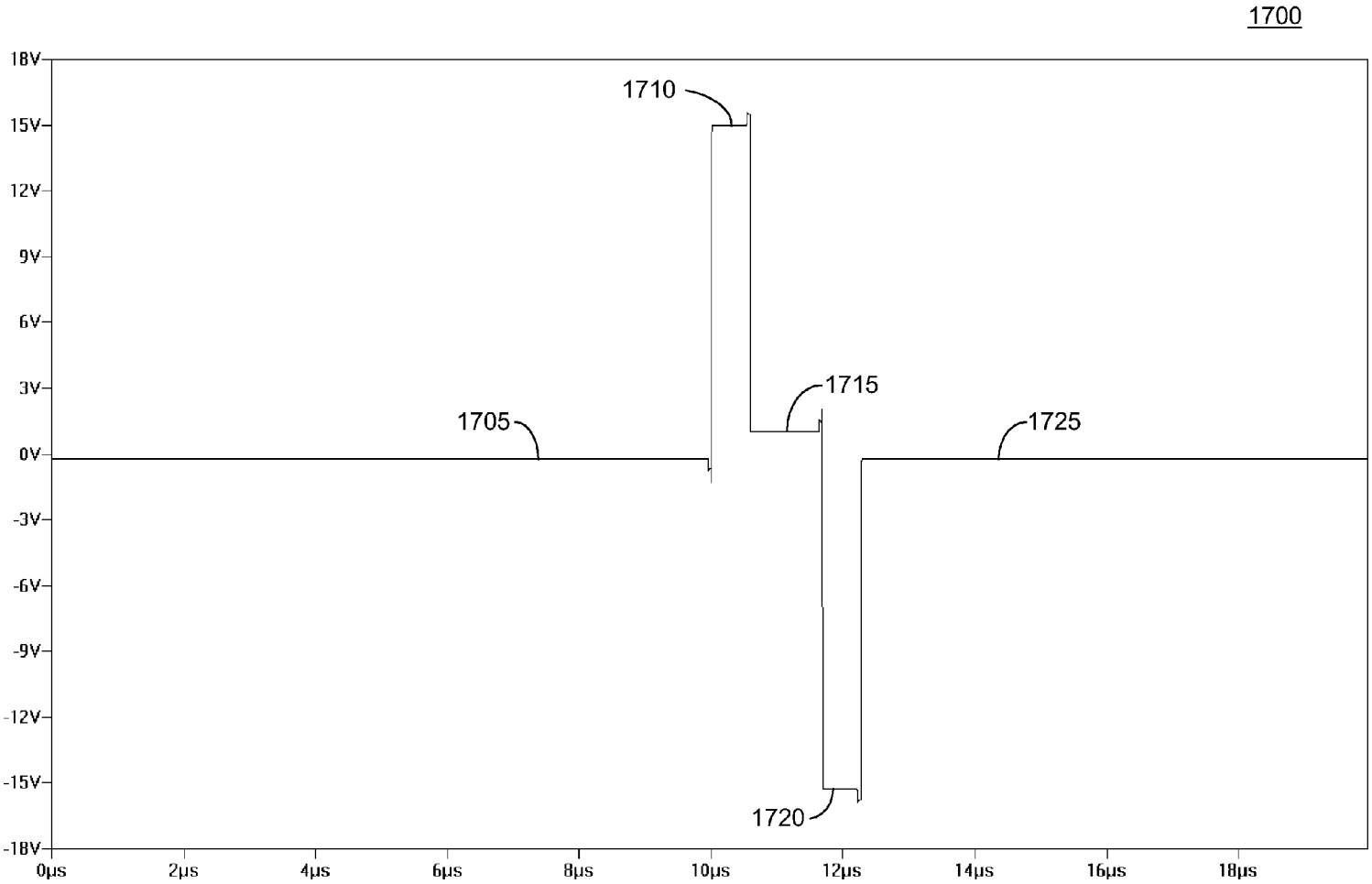
FIG. 17A shows a diagram of the modeled open circuit response of the circuit of FIG. 15.

FIG. 17A shows a diagram of the modeled open circuit response of the circuit of FIG. 16. Voltage levels 1705, 1710, 1715, 1720, and 1725 correspond to V8=0.2 volts, V6=15 volts, V2=1 volt, V4=15.3 volts, and v8=0.2 volts, respectively. The NFET used in the model is the Si4850EY manufactured by Vishay Intertechnology, Inc. The Si4850EY NFET was selected to show the response of an electrolytic cell over a range of voltages. In practice, different devices would typically be chosen for different loads and operating voltages for optimal performance. The response was modeled with LTspice version 2.17 g, from the Linear Technology Corporation. The ringing at the voltage level transitions is due to reactive components in the model that are not associated with the load (e.g., the parasitic capacitances in the NFETs).

Figure 17B:
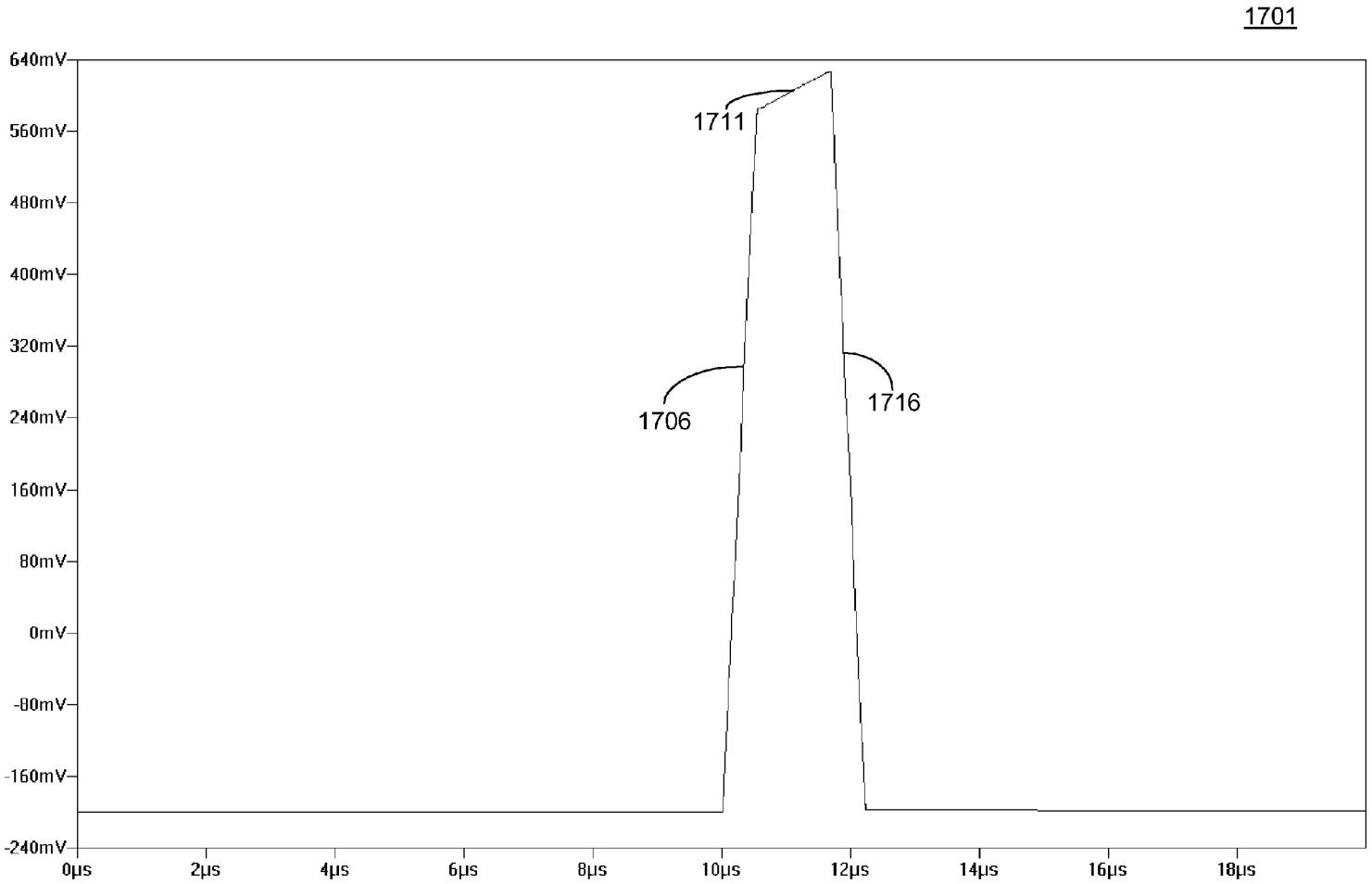
FIG. 17B shows a diagram of the modeled response of the circuit of FIG. 15 with a small capacitance load.

FIG. 17B shows a diagram 1701 of the modeled response of the voltage across the double-layer capacitance C1 of circuit FIG. 15 with the parameters shown in FIG. 16: L1=20 nanohenries, C1=2 microfarads, R1=1 Megohm, and R3=5 ohms, V8=0.2 volts, V6=15 volts, V2=1 volt, and V4=15.3 volts. The rising edge 1706 shows the rapid pullup of the voltage across C1 under the influence of the application of V6=15 volts. The ramp segment 1711 shows the gradual increase of the voltage across C1 during the application of V2=1 volt. The falling edge 1716 shows the rapid pulldown of the voltage across C1 under the influence of the application of V4=15.3 volts.

Figure 17C:
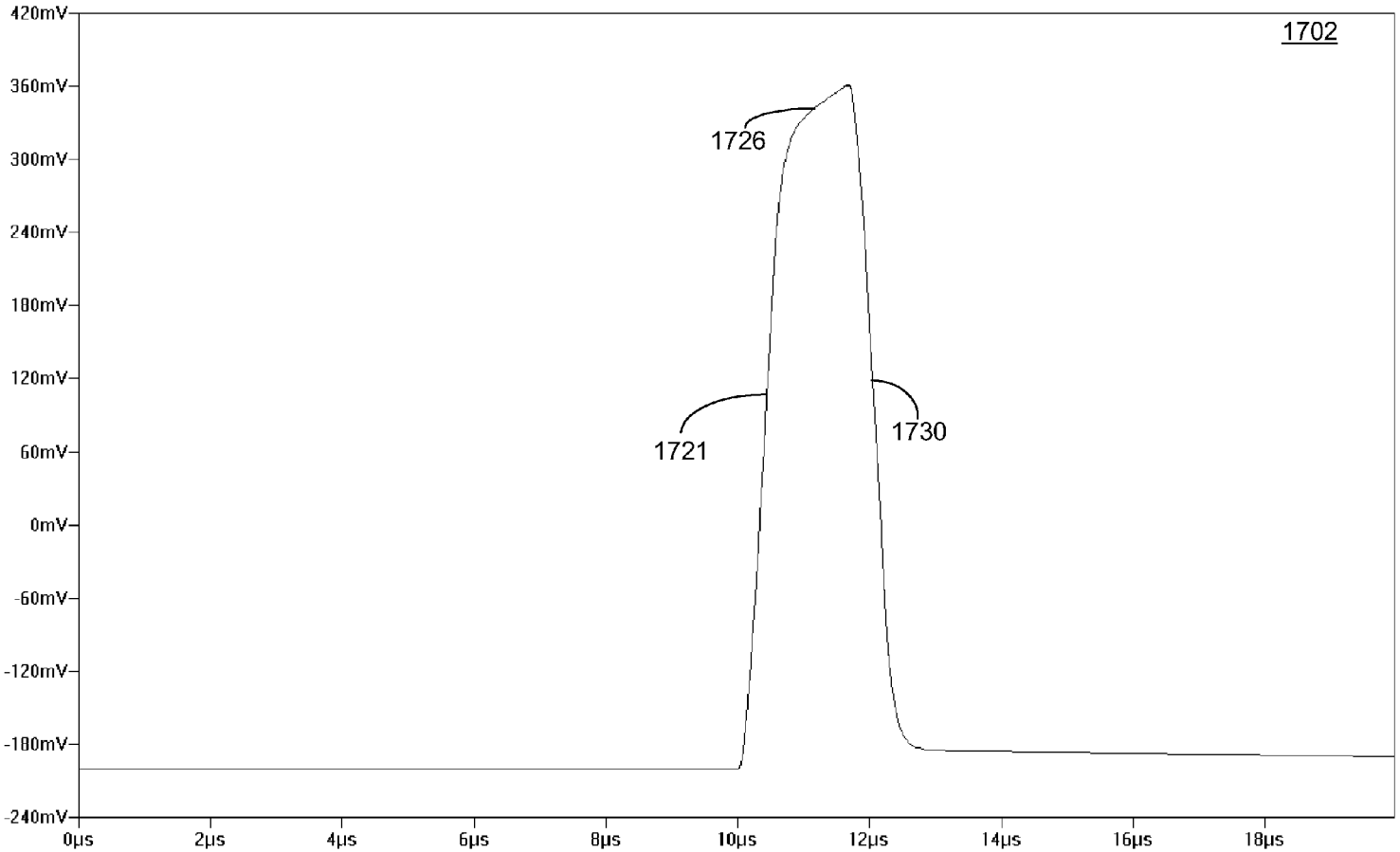
FIG. 17C shows a diagram of the modeled response of the circuit of FIG. 15 with an increased capacitance and a decreased resistance.

FIG. 17C shows a diagram 1702 of the modeled response of the voltage across the double-layer capacitance C1 of circuit FIG. 15 with the following parameters: L1=20 nanohenries, C1=100 microfarads, R1=1 Megohm, and R3=0.1 ohms, V8=0.2 volts, V6=15 volts, V2=1 volt, and V4=15.3 volts. It should be noted that the load RC time constant is the same for response 1701 and response 1702; however, the internal resistance of the NFETs has been manifested by a reduction in the peak voltage across C1, with a decrease of over 200 millivolts. In addition, rising edge 1721, ramp segment 1726, and falling edge 1730 slightly rounded off.

Figure 17D:
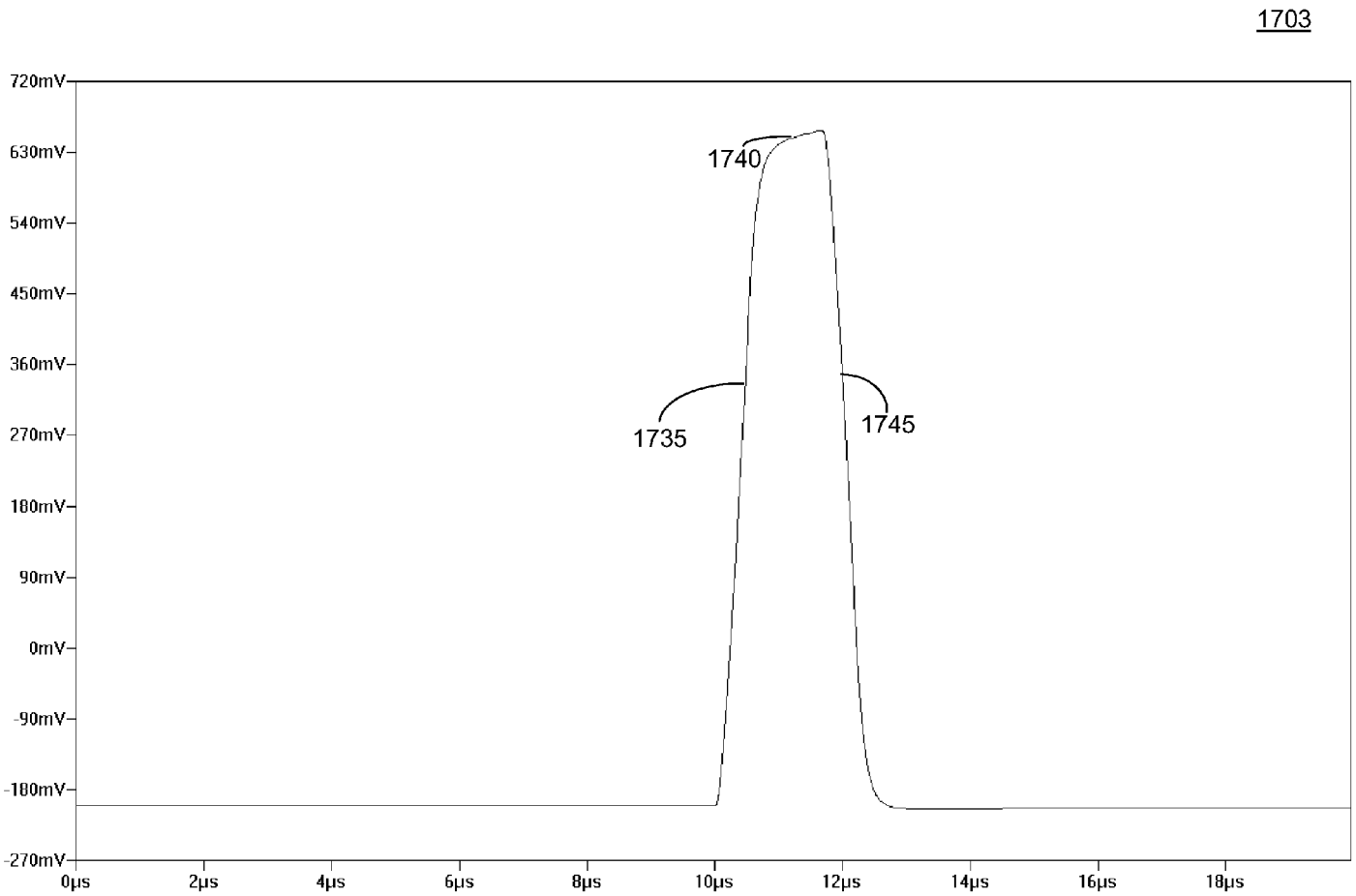
FIG. 17D shows a diagram of the modeled response of the circuit of FIG. 15 with an increased capacitance and a decreased resistance and increased supply voltages.

FIG. 17D shows a diagram 1703 of the modeled response of the voltage across the double-layer capacitance C1 of circuit FIG. 15 with the following parameters: L1=20 nanohenries, C1=100 microfarads, R1=1 Megohm, and R3=0.1 ohms, V8=0.2 volts, V6=24 volts, V2=1 volt, and V4=24 volts. In comparison to diagram 1702, V6 and V4 have been increased from 15 volts and 15.3 volts to 24 volts. The increased supply voltage has increased the voltage across C1 to a value close to that of diagram 1701; however, rising edge 1735, ramp segment 1740, and falling edge 1745 are still slightly rounded off.

Figure 17E:
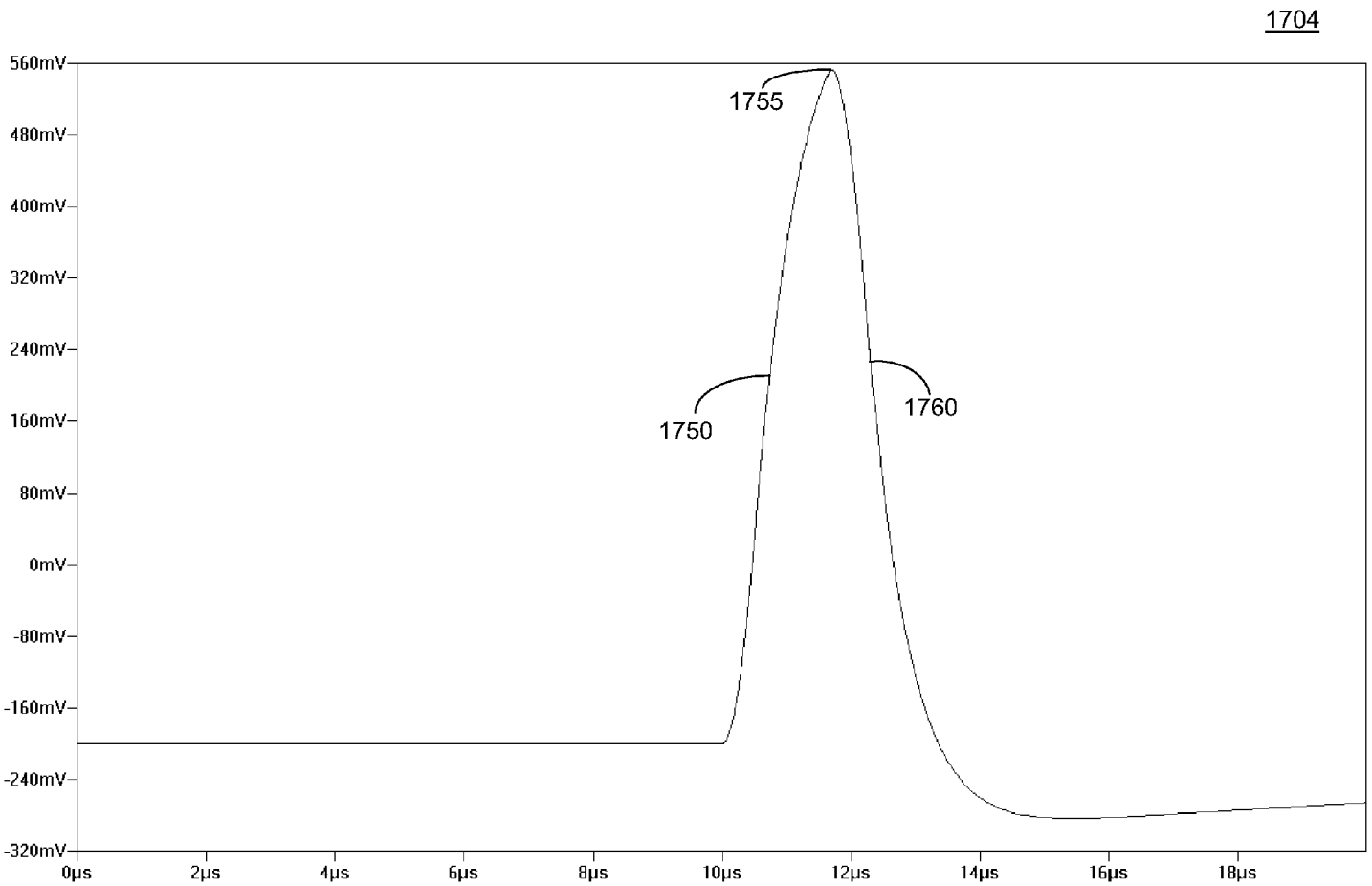
FIG. 17E shows a diagram of the modeled response of the circuit of FIG. 15 with an increased inductance.

FIG. 17E shows a diagram 1704 of the modeled response of the voltage across the double-layer capacitance C1 of circuit FIG. 15 with the following parameters: L1=100 nanohenries, C1=100 microfarads, R1=1 Megohm, and R3=0.1 ohms, V8=0.2 volts, V6=24 volts, V2=1 volt, and V4=24 volts. In comparison to diagram 1703, the series inductance L1 has been increased from 10 nanohenries to 100 nanohenries. The ramp segment 1725 has been replaced by a sharp and slightly reduced peak 1755 and the rising edge 1750 and falling edge 1760 are slightly less steep. It should be noted that 100 nanohenries is still much lower than the inductance of a typical electroplating system.

Figure 17F:
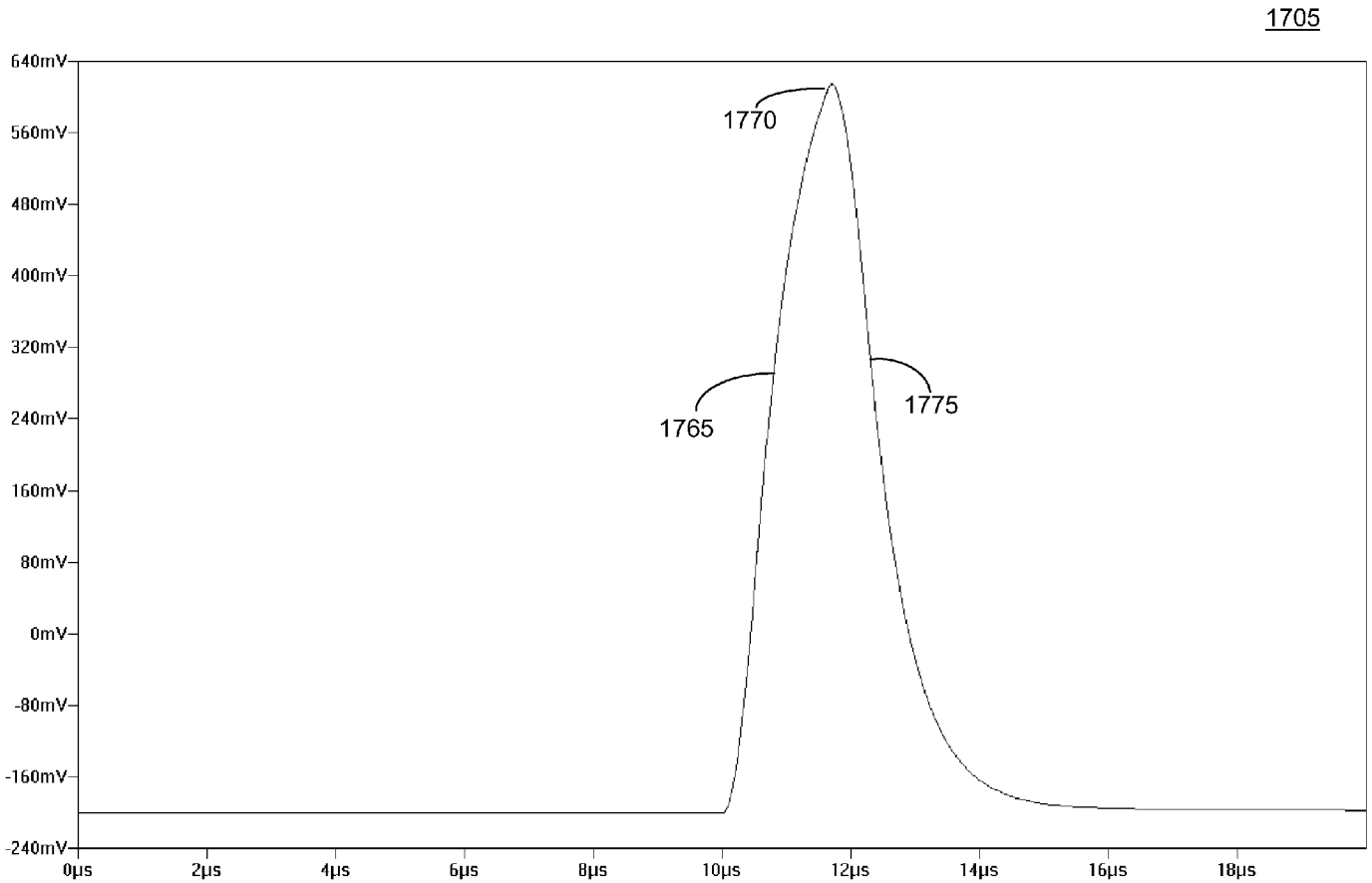
FIG. 17F shows a diagram of the modeled response of the circuit of FIG. 15 with an increased inductance and increased supply voltages.

FIG. 17F shows a diagram 1705 of the modeled response of the voltage across the double-layer capacitance C1 of circuit FIG. 15 with the following parameters: L1=100 nanohenries, C1=100 microfarads, R1=1 Megohm, and R3=0.1 ohms, V8=0.2 volts. V6=26 volts, V2=1 volt, and V4=23 volts. In comparison to diagram 1704, V6 and V4 have been increased from 15 volts and 15.3 volts to 26 volts and 23 volts, respectively. The peak amplitude has been restored at close to 630 millivolts; however, the rising edge 1765, falling edge 1775, and peak 1770, have not been restored.

Figure 17G:
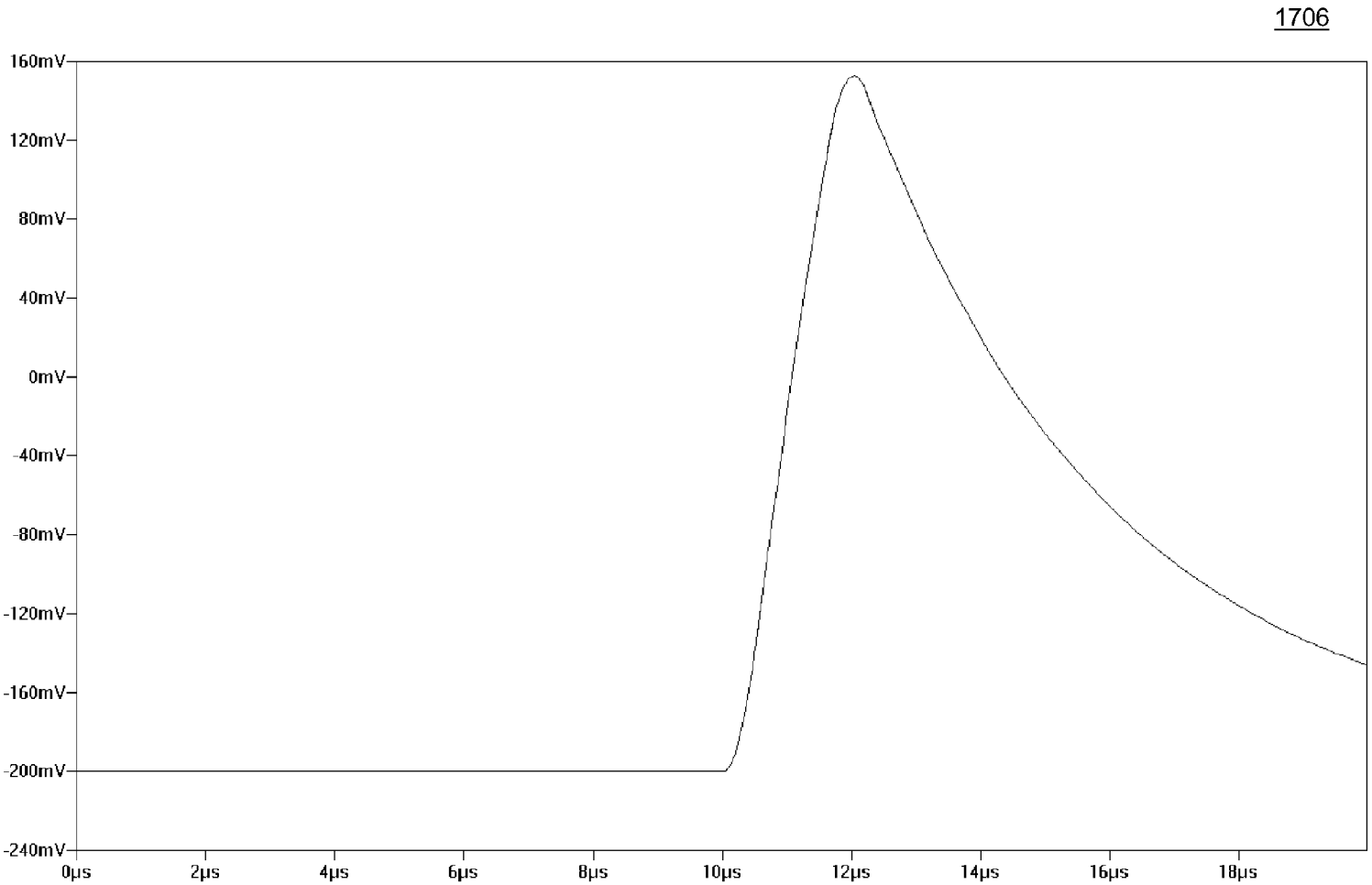
FIG. 17G shows a diagram of the modeled response of the circuit of FIG. 15 with a further increase in inductance and increased supply voltages.

FIG. 17G shows a diagram 1706 of the modeled response of the voltage across the double-layer capacitance C1 of circuit FIG. 15 with the following parameters: L1=500 nanohenries, C1=100 microfarads, R1=1 Megohm, and R3=0.1 ohms, V8=0.2 volts, V6=24 volts, V2=1 volt, and V4=24 volts. In comparison to diagram 1703, the series inductance L1 has been increased from 100 nanohenries to 500 nanohenries. The peak amplitude has been reduced to less than 160 millivolts, and the pulse has widened considerably.

Figure 17H:
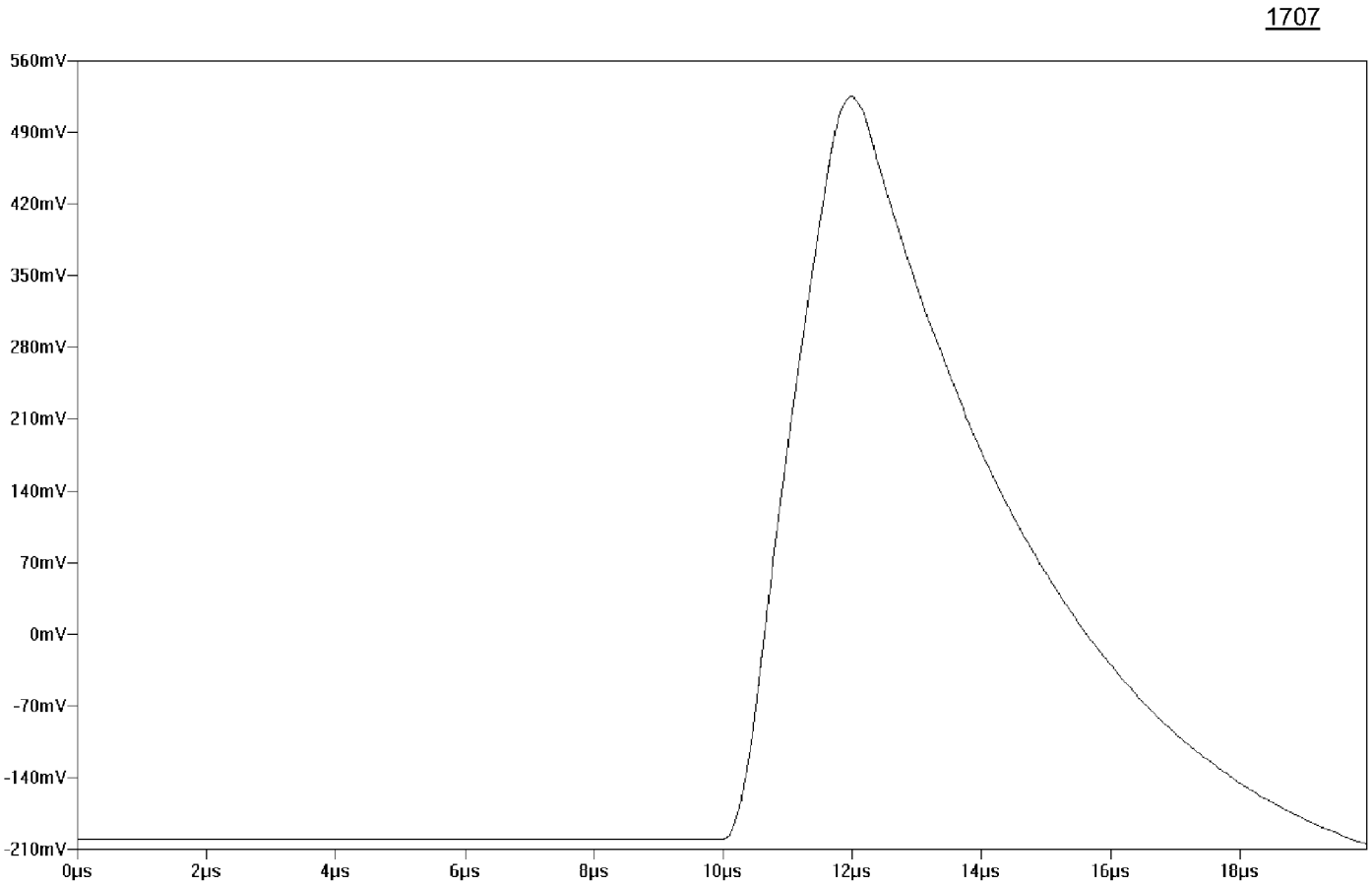
FIG. 17H shows a diagram of the modeled response of the circuit of FIG. 15 with a further increase in inductance and further increase in supply voltages.

FIG. 17H shows a diagram 1707 of the modeled response of the voltage across the double-layer capacitance C1 of circuit FIG. 15 with the following parameters: L1=500 nanohenries, C1=100 microfarads, R1=1 Megohm, and R3=0.1 ohms, V8=0.2 volts, V6=26 volts, V2=1 volt, and V4=23 volts. In comparison to diagram 1706, V6 and V4 have been increased from 15 volts and 15.3 volts to 55 volts and 51 volts, respectively. The 55-volt supply voltage is close to the limit for the Si4850EY NFET (60 volts), but the capacitor voltage amplitude is still below 600 millivolts.

FIGS. 17C-H illustrate some of the difficulties involved in rapidly charging and discharging the double-layer capacitance associated with an electrode area of roughly one square inch, particularly the impact of series inductance. Although inductance is frequently ignored, it is a considerable burden for systems intended to provide high-speed control of the interphase in electrolytic cells. Even for systems with low inductance, the selection of the proper switch devices and drive circuit topology is important for optimizing performance.

Figure 18A:
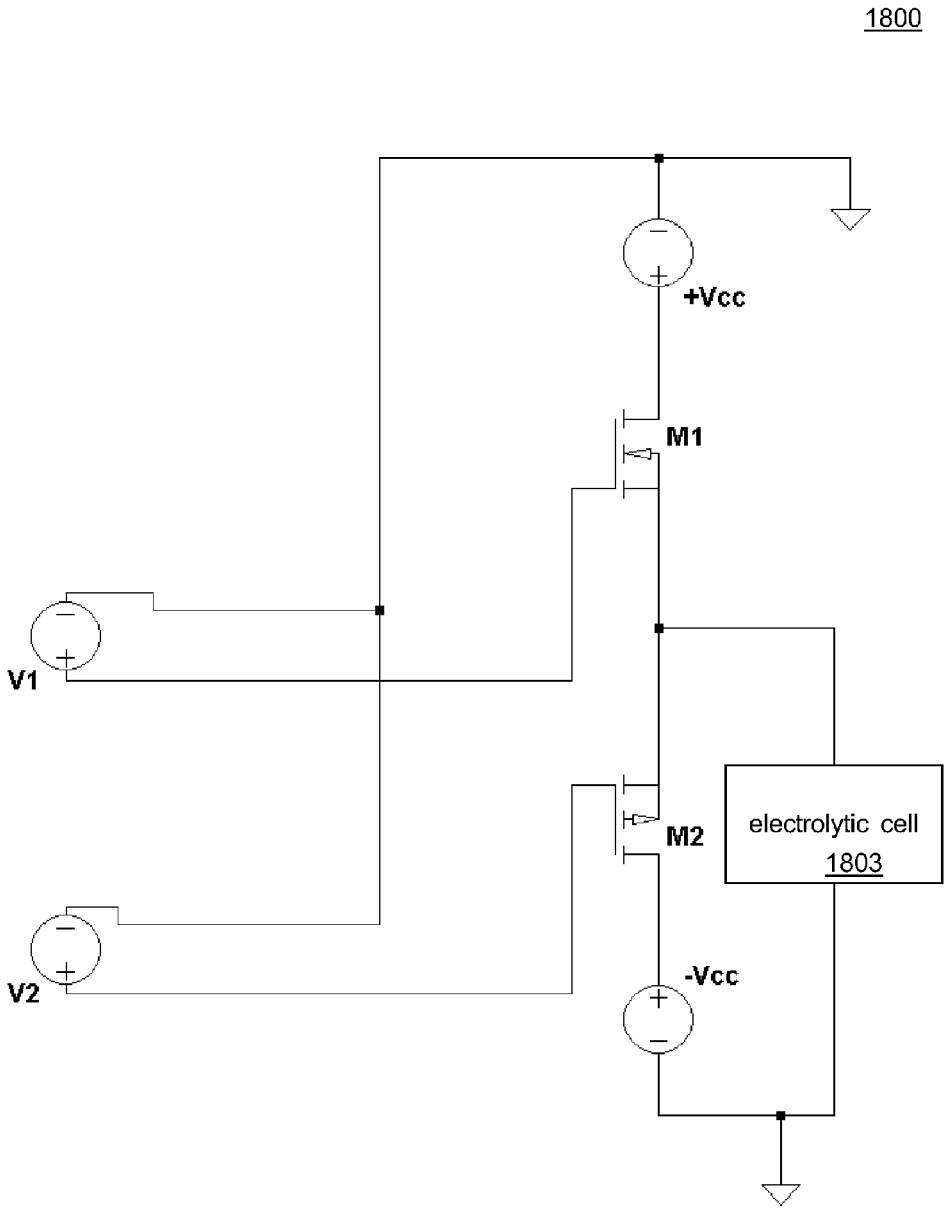
FIG. 18A shows a schematic diagram of a complementary output circuit for driving an electrolytic cell with dual voltages in accordance with an embodiment of the present invention.

FIG. 18A shows an electrical schematic diagram 1800 of an embodiment of a dual voltage complementary MOSFET circuit for driving an electrolytic cell 1803. A positive supply voltage +Vcc is provided to a NFET M1 and a negative supply voltage −Vcc is provided to a PFET M2. The source of M1 and M2 are coupled to one terminal of the electrolytic cell 1803 and the other terminal of the electrolytic cell 1803 is connected to ground. A drive waveform is provided to the gates of M1 and M2 by sources V1 and V2, respectively, M1 and M2 may be augmented by additional transistors M1 and M2 in parallel.

Figure 18B:
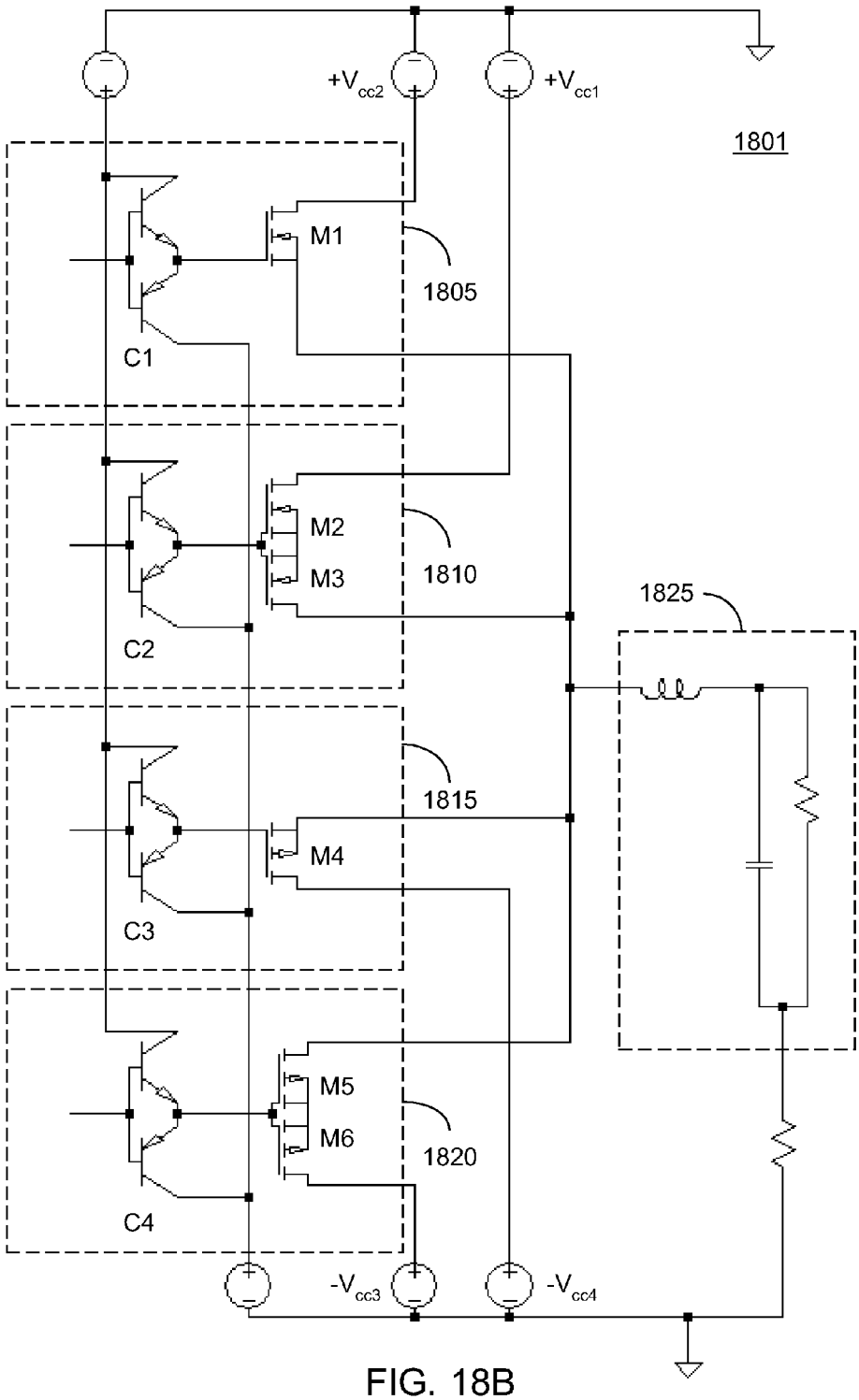
FIG. 18B shows a schematic diagram of a complementary output circuit for driving an electrolytic cell with four voltages in accordance with an embodiment of the present invention.

FIG. 18B shows an electrical schematic diagram 1801 of an embodiment of a quadruple voltage complementary MOSFET circuit for driving an electrolytic cell 1825. Gain block 1805 includes a complementary bipolar transistor pair C1 as a driver stage for NFET M1, which switches high supply $+V_{cc2}$ to the load 1825. Gain block 1810 includes a complementary bipolar transistor pair C2 as a driver stage for back-to-back NFET M2 and NFET M3, which switch low supply $+V_{cc1}$ to the load 1825. Gain block 1815 includes a complementary bipolar transistor pair C3 as a driver stage for PFET M4, which switches high supply $-V_{cc3}$ to the load 1825. Gain block 1820 includes a complementary bipolar transistor pair C4 as a driver stage for back-to-back PFET M5 and PFET M6, which switch low supply $+V_{cc3}$ to the load 1825. The circuit shown in FIG. 18B may be used to provide the waveform shown in FIG. 14.

Figure 19:
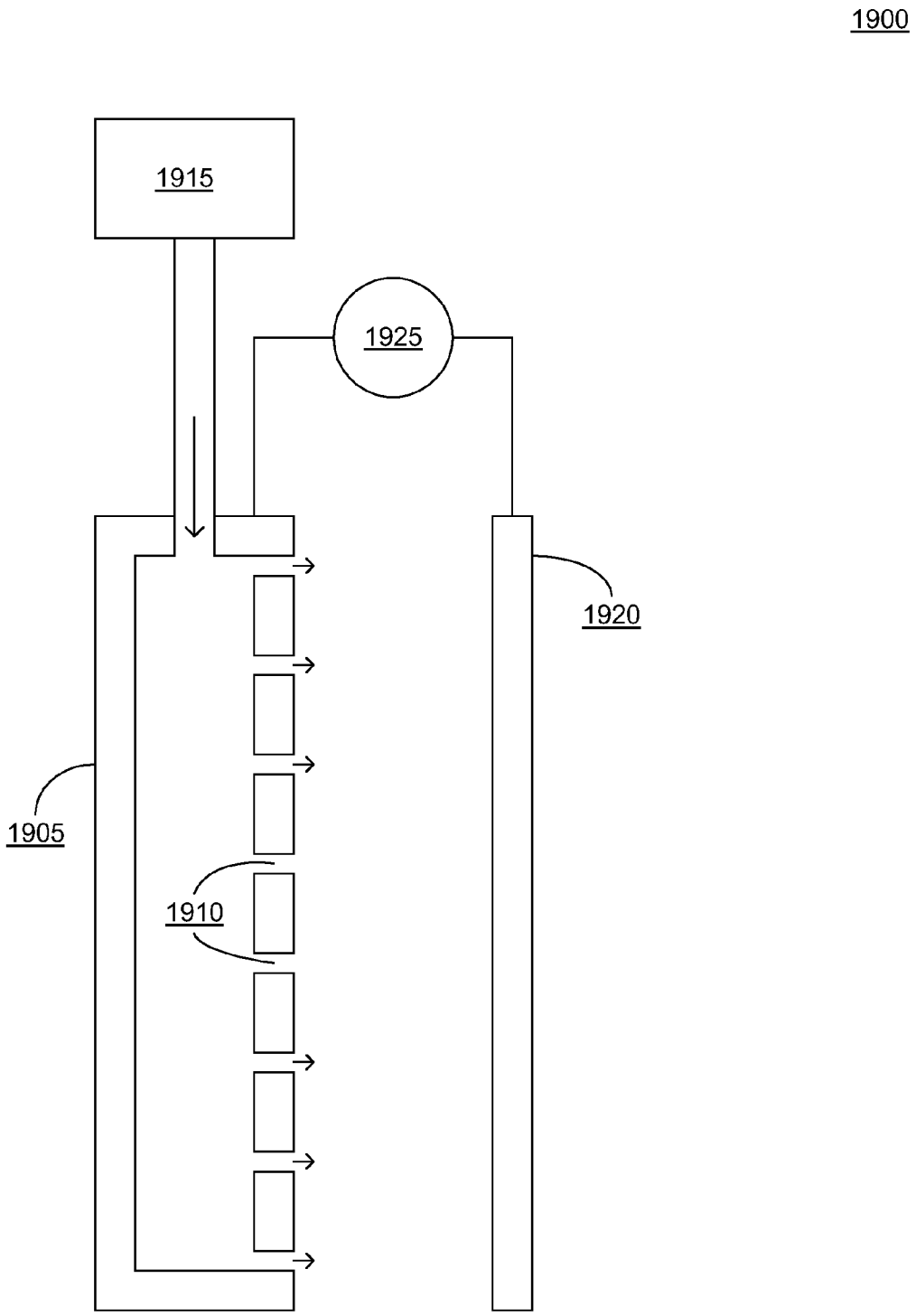
FIG. 19 shows a porous electrode with a pressurized gas source in accordance with an embodiment of the present invention.

FIG. 19 shows an embodiment of an electrode assembly 1900 with a porous electrode 1905 coupled to a pressurized gas source 1915. The pressurized gas may be an inert gas such as argon, or it may be a soluble gas that is capable of affecting the equilibrium concentration of reactants and products in the electrolytic cell (e.g., hydrogen or oxygen). A pulse power supply 1925 couples porous electrode 1905 to an opposing electrode 1920. Pores 1910 are distributed across the active surface of porous electrode 1905. The porous electrode 1905 may have a surface (e.g., carbon) that provides poor adhesion for electrodeposited species, so that the pores will not be blocked by deposits.

Gas flowing through the pores 1910 produces bubbling at the active surface of electrode 1905 that disrupts the stagnant layer adjacent to the surface. The gas flow through the porous electrode 1905 is more effective than conventional sparging in minimizing depletion of a species being reduced at the electrode surface. Although electrolytic hydrogen evolution may also be effective, it is difficult to control independently of the other electrolytic processes taking place in the cell.

In an alternative embodiment, the pressurized gas source 1915 may be replaced by an electrolyte pump that circulates electrolyte through the porous electrode 1905. An electrolyte pump is preferred for cell geometries where the electrode spacing is small and a gas flow would significantly displace electrolyte from the gap between the electrodes.

Figure 20A:
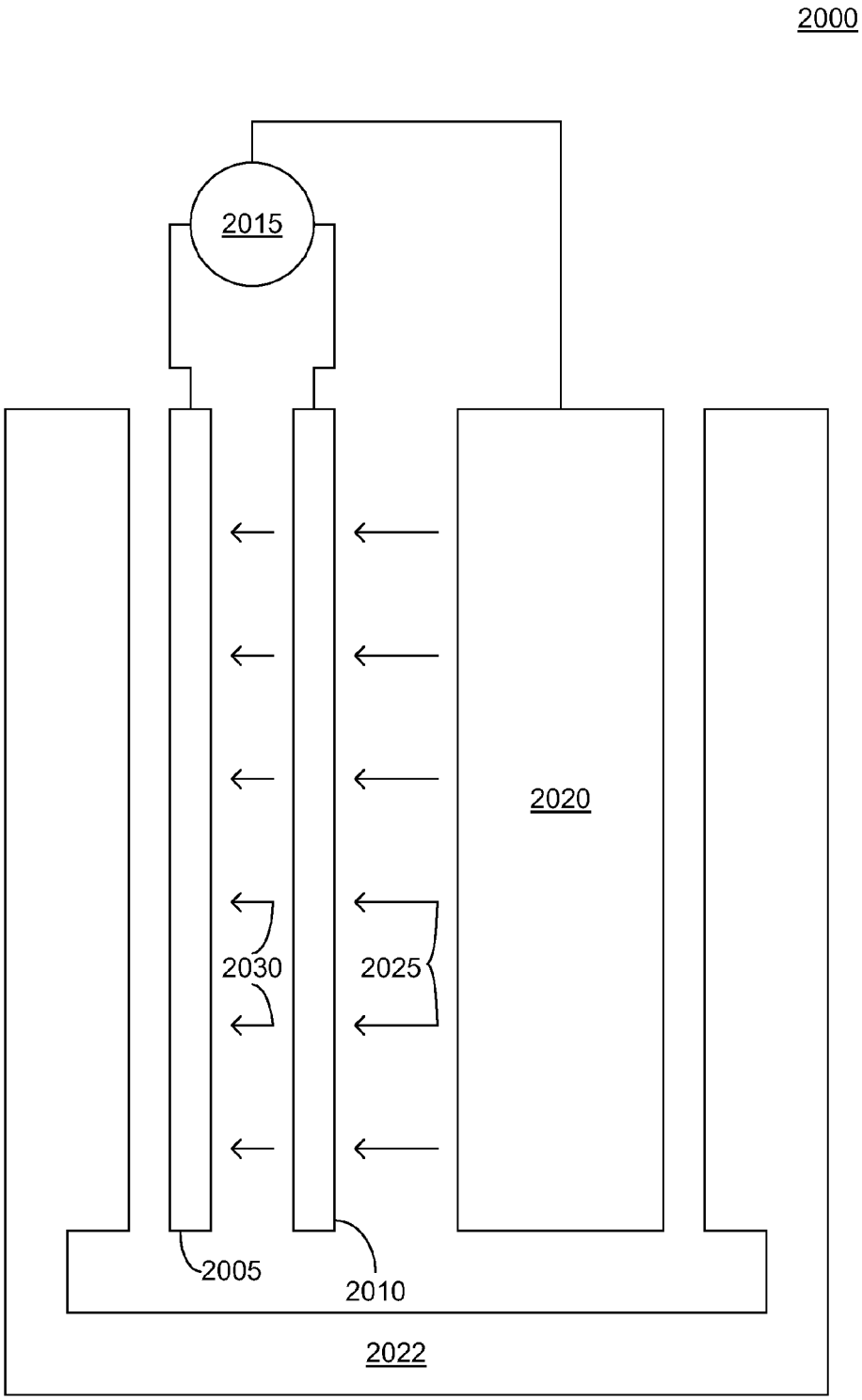
FIG. 20A shows an electrode assembly with a transparent electrode and magnet in accordance with an embodiment of the present invention.

FIG. 20A shows an embodiment of an electrode assembly 2000 with a transparent electrode 2010 coupled to an opposing electrode 2005. A photon source 2020 is also coupled to the pulse power supply 2015 and provides emitted electromagnetic radiation 2025 that is transmitted by the transparent electrode 2010 producing transmitted electromagnetic radiation 2030. The transparent electrode 2010 may be fabricated from a transparent substrate such as sapphire or silica coated with a transparent conductive oxide such as indium tin oxide, and/or a patterned metal film. A transparent electrode will generally have greater attenuation than a transparent window that is nonconductive.

A magnet 2022 may be used to provide a magnetic field in the electrolyte gap between the electrodes. The magnet 2022 may be a permanent magnet or it may be an electromagnet. For high frequency fields an electromagnet with a ferrite core is preferred. The application of a magnetic waveform may be synchronized with the application of the electrical waveform applied to the electrodes (2005, 2010) and may also be synchronized with the output of the photon source 2020. A static magnetic field may be combined with an alternating magnetic field, and more than one magnet 2022 may be used.

The magnetic field produced by magnet 2022 is essentially perpendicular to the electrode surface; however, other magnetic field orientations may be employed. For example, a magnet may be oriented so that the magnetic field it produces is parallel to the electrode surface. A static magnetic field may also be oriented from 0 to 90 degrees with respect to an alternating magnetic field produced by currents flowing in the electrodes, or applied independently.

Figure 20B:
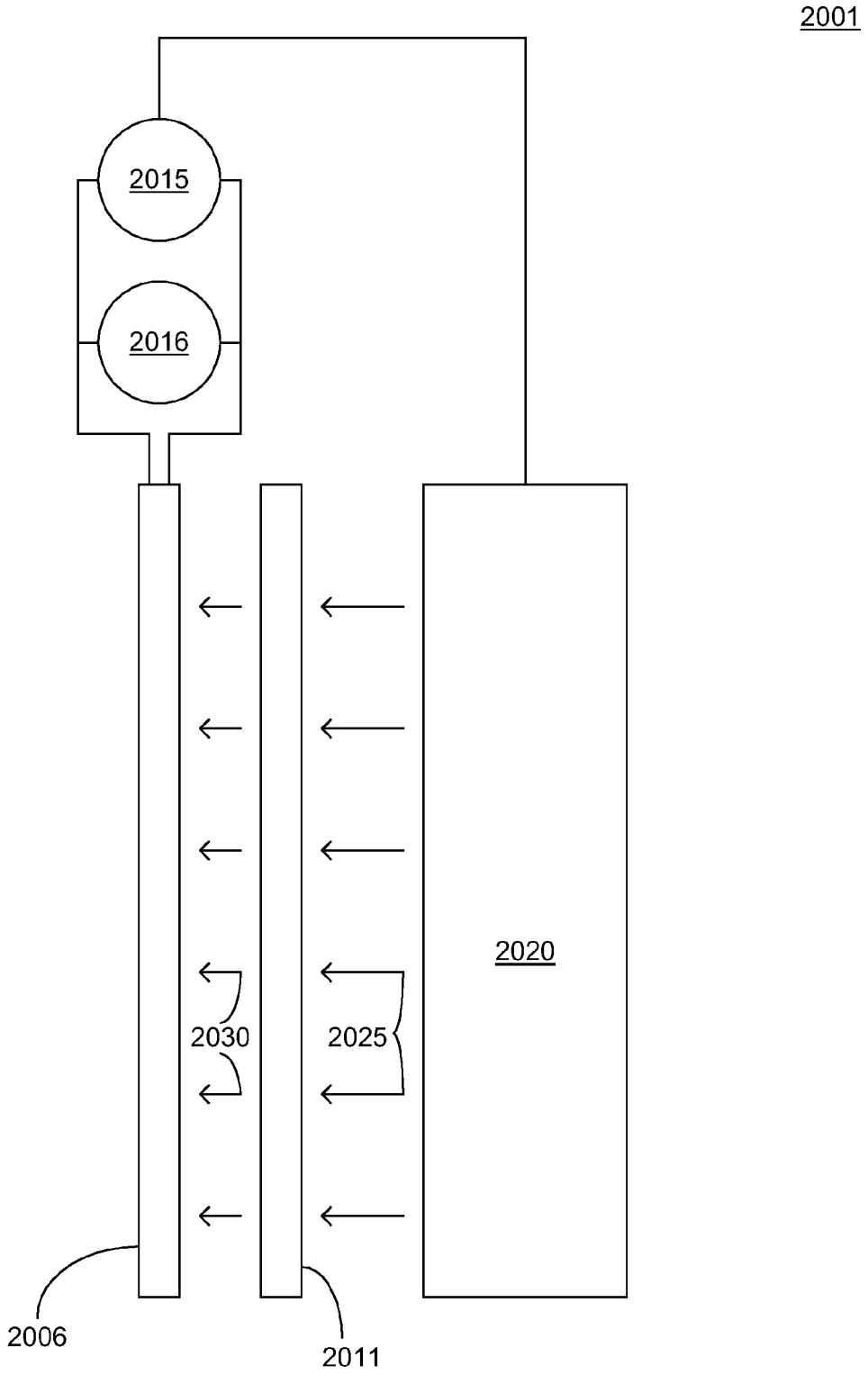
FIG. 20B shows an electrode assembly with a transparent window and coplanar electrode assembly in accordance with an embodiment of the present invention.

FIG. 20B shows an embodiment of an electrode assembly 2001 with a transparent window 2011 and an integrated electrode 2006 coupled to a pulse power supply 2015. The integrated electrode 2006 may also be coupled to a RF/microwave current source 2016. Integrated electrode 2006 may be a coplanar interdigitated anode and cathode pattern, or it may be a structure such as that shown in FIG. 13A. A photon source 2020 is also coupled to the pulse power supply 2015 and provides emitted electromagnetic radiation 2025 that is transmitted by the transparent window 2010, producing transmitted electromagnetic radiation 2030. Although not shown, a magnet similar to that shown in FIG. 20A may be used with electrode assembly 2001.

The integrated electrode assembly 2006 may also serve as a coplanar waveguide or microstrip circuit. The integrated electrode assembly may be fabricated on a dielectric substrate or a semiconductor substrate. When fabricated on a semiconductor substrate, active components such as switches (e.g., a shunt switch) may also be incorporated. For low power systems, the pulse power supply 2015 may also be incorporated on the substrate.

Figure 21:
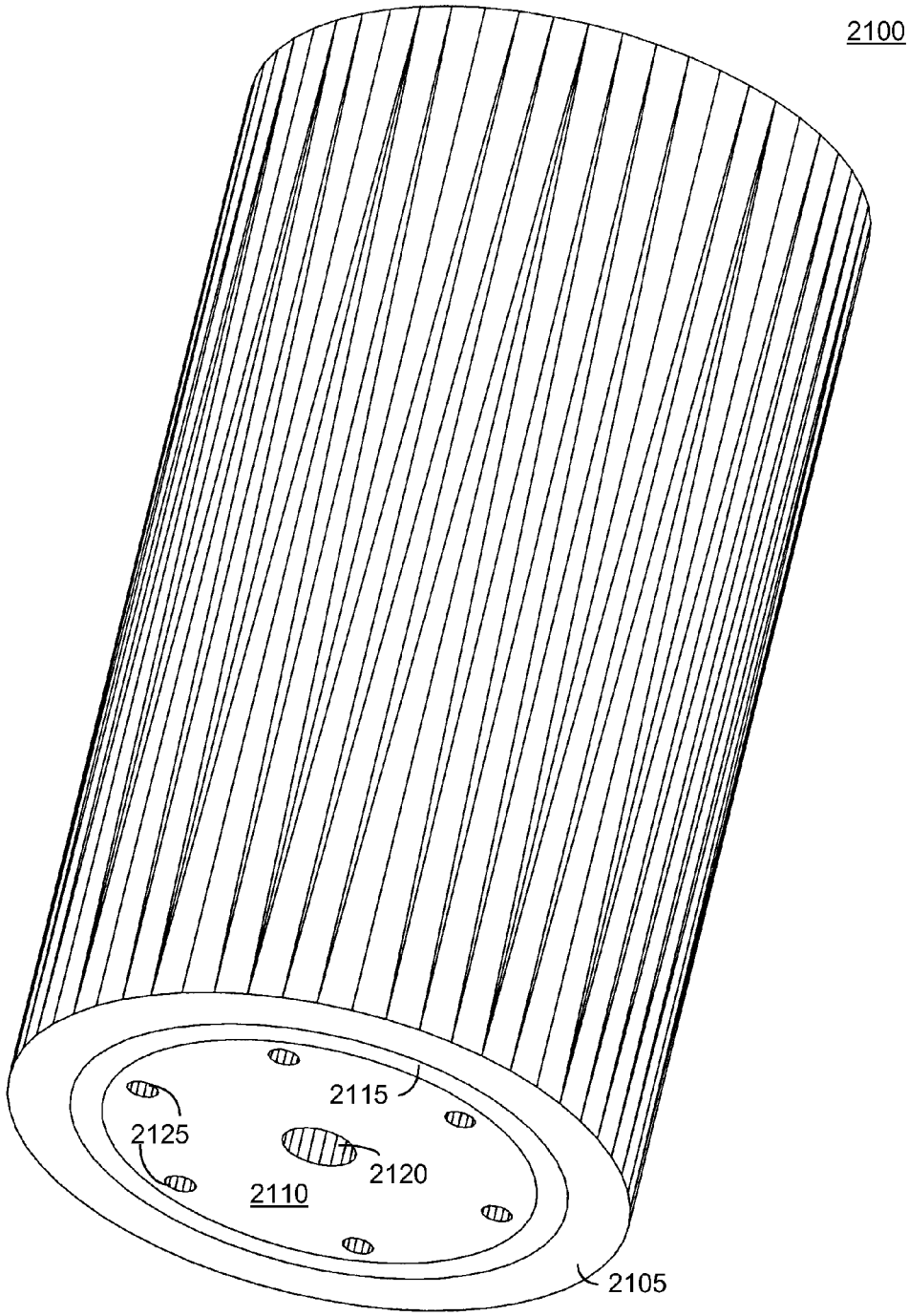
FIG. 21 shows a coaxial transmission line with a circulating center conductor in accordance with an embodiment of the present invention.

FIG. 21 shows an embodiment of a circulating coaxial transmission line assembly 2100 having a circulating center conductor 2110. The outer conductor 2105 is separated from the circulating center conductor 2110 by a dielectric 2115. A central duct 2120 and peripheral ducts 2125 provide paths for electrolyte flow to the face of the circulating center conductor 2110. The ducts 2120 and 2125 allow all or a portion of the face of the center conductor to serve as an electrode surface that may be placed in close proximity to an opposing electrode coupled to the outer conductor 2105, while maintaining electrolyte turnover within the gap. The ducts 2120 and 2125 and/or a portion of the center conductor 2110 may include a dielectric material, thereby limiting the active electrode area of the circulating center conductor, or modifying the current path within the circulating center conductor.

The circulating coaxial transmission line assembly 2100 has a circular cross-section for which the inductance may be approximated by the equation:

$$L = 2 \times 10^{-7} \times \ln\left(\frac{r_o}{r_i}\right)$$

With respect to the above equation, $r_o$=inner radius of outer conductor 2105, $r_i$=outer radius of inner conductor 2110, and L=inductance in henries/meter, Although the circulating coaxial transmission line assembly 2100 is shown with a circular cross-section, other geometries (e.g., rectangular) may also be used.

Figure 22A:
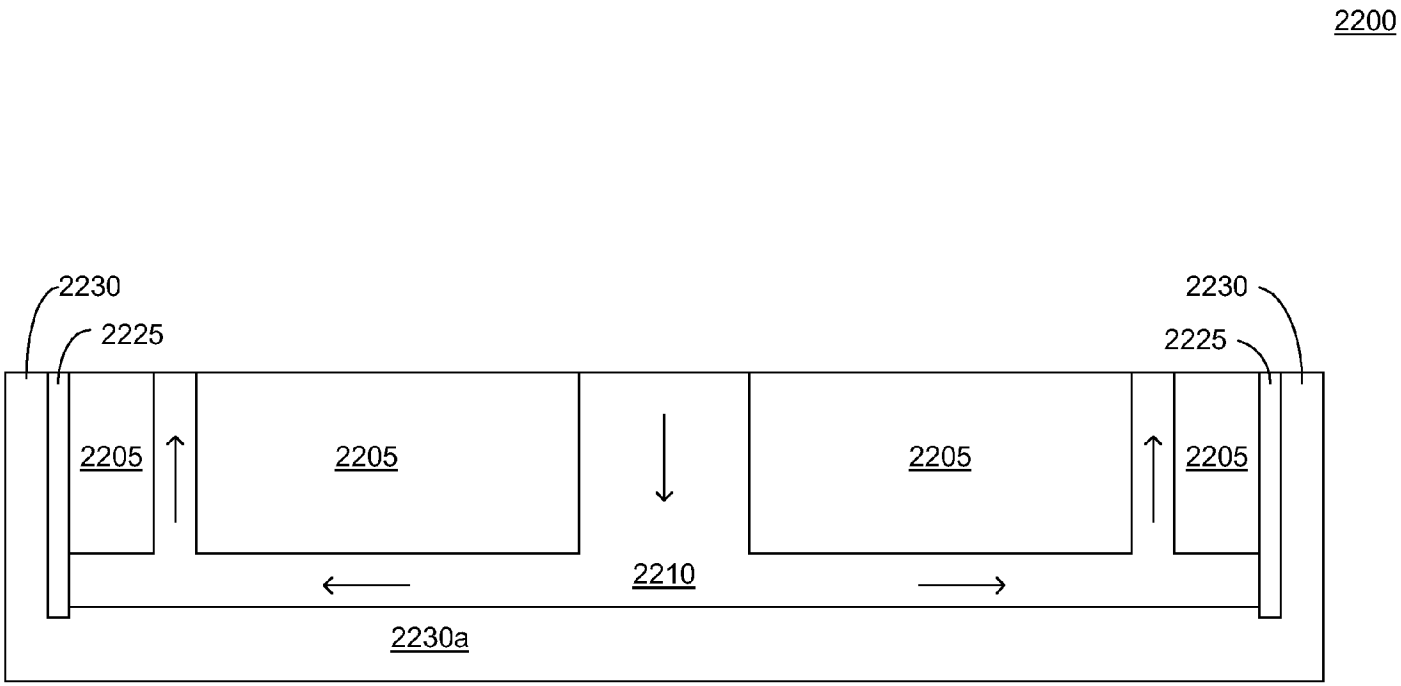
FIG. 22A shows an electrolytic cell with a circulating center conductor in accordance with an embodiment of the present invention.

FIG. 22A shows an embodiment of an electrolytic cell 2200 that may be used to terminate the circulating coaxial transmission line of FIG. 21. A circulating center conductor 2205 is separated from an outer conductor 2230 by a dielectric 2225. A terminal electrode 2230*a* is coupled to the outer conductor 2230 and forms an electrolyte gap 2210 in conjunction with the circulating center conductor 2205.

Figure 22B:
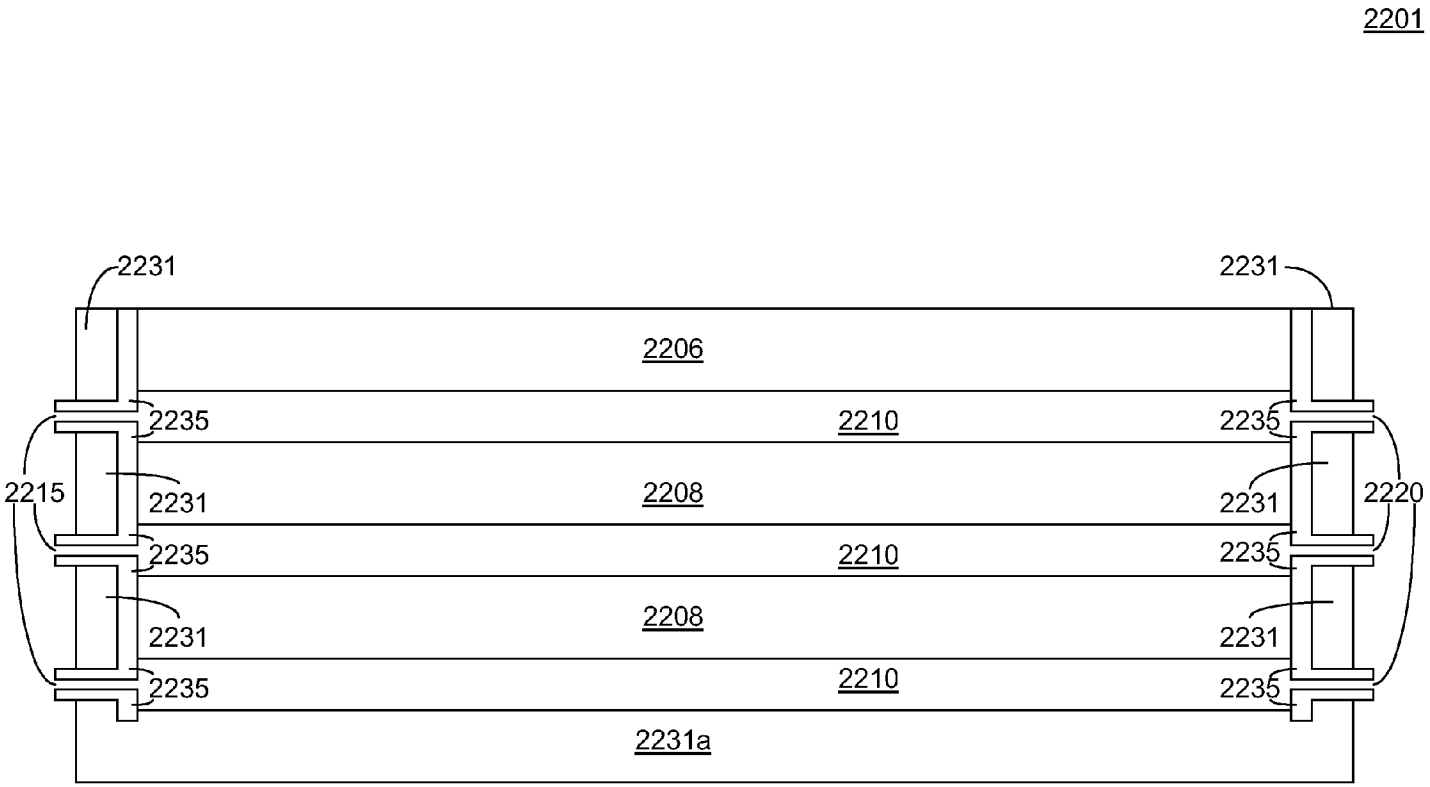
FIG. 22B shows a coaxial transmission line with multiple electrolytic cells in a series configuration in accordance with an embodiment of the present invention.

FIG. 22B shows an embodiment of a coaxial transmission line assembly 2201 having multiple electrolytic cells in a series configuration that may be used in conjunction with the coaxial transmission lines shown in FIGS. 7A and 7B. A center contact electrode 2206 serves as a connection point and the first electrode in the series. Bipolar electrodes 2208 are disposed between the center contact electrode 2206 and a terminal electrode 2231*a* that is coupled to an outer conductor 2231. Electrodes 2206, 2208, and 2231*a* are separated by electrolyte gaps 2210, each of which has an intake port 2215 and an exhaust port 2220.

It is preferable that each electrolyte gap 2210 be served by an independent electrolyte fluid circuit; however, for high resistivity electrolytes a common circuit with a remote common connection may be used. The leakage current due to a common electrolyte connection may be reduced to an acceptable level by maintaining a large resistance between the electrolyte cells 2210 and their common electrolyte connection. The coaxial transmission line assembly 2201 offers advantages similar to those of the electrolytic module shown in FIG. 11.

Figure 23:
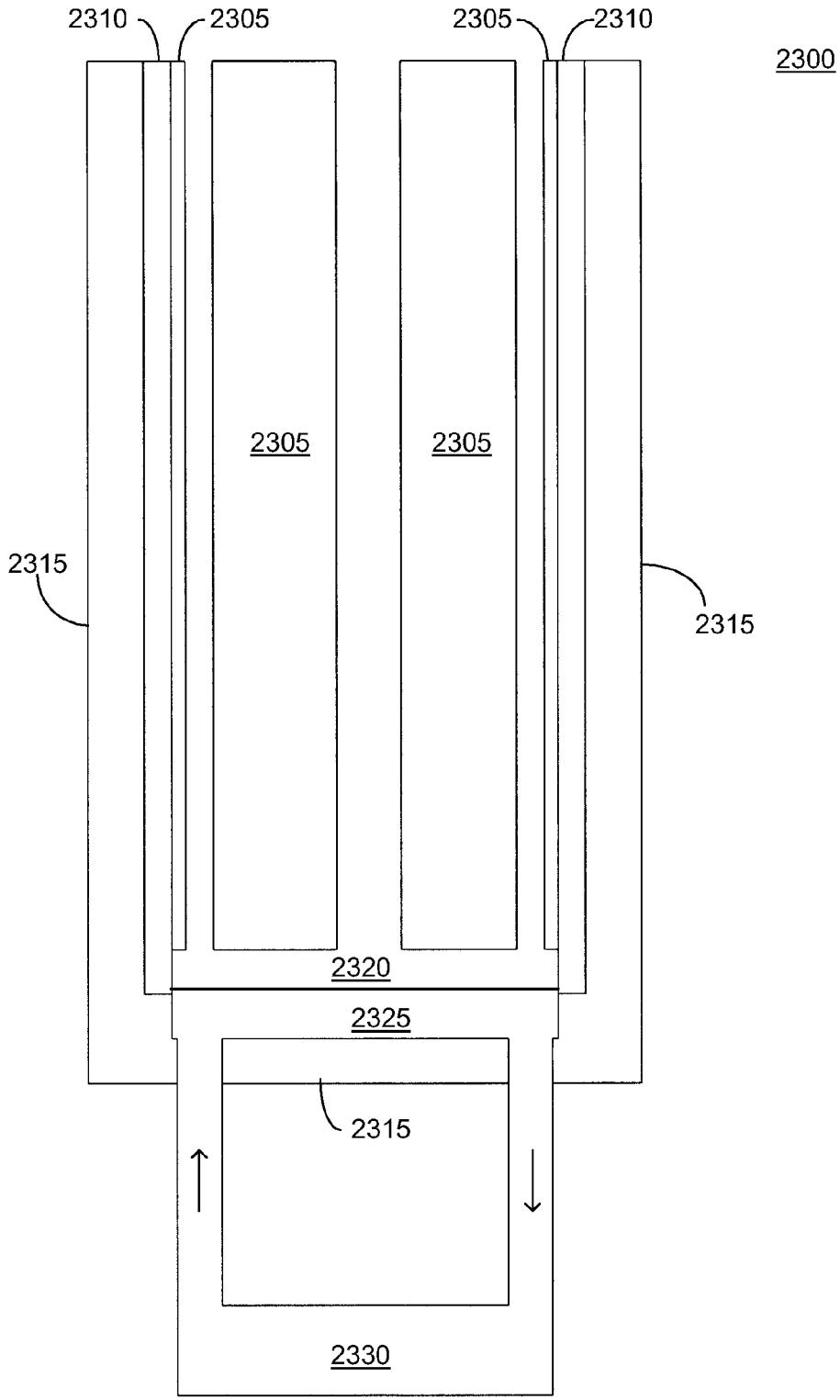
FIG. 23 shows a coaxial transmission line with a liquid metal electrode in accordance with an embodiment of the present invention.

FIG. 23 shows an embodiment of a circulating electrolytic coaxial transmission line assembly 2300 with a liquid metal electrode 2325. An electrolyte gap 2320 separates the liquid metal electrode 2325 from a circulating center conductor 2305 that is separated from an outer conductor 2315 by a dielectric 2310. The liquid metal electrode 2325 is coupled to the outer conductor 2315. The liquid metal electrode 2325 may be circulated through a circulation reservoir 2330 from which electrolytic reaction products may be extracted by methods such as filtering, centrifuging, cooling, or distillation.

The liquid metal electrode 2325 may be a metal that is liquid at or near room temperature (e.g., mercury or gallium) and can be used with low melting point electrolytes. For low melting point electrolytes such as room temperature ionic liquids, aqueous electrolytes and organic solvents, polymer materials such as epoxy resins and fluorocarbons may be used in the fabrication of the circulating electrolytic coaxial transmission line assembly 2300. The preferred metals for use in the transmission line assembly are metals that are insoluble in the liquid metal 2325, or metals that form intermetallic compounds with a melting point that is higher than the operating temperature of the circulating electrolytic coaxial transmission line assembly 2300.

Alternatively, the liquid metal electrode 2325 may be a metal with a higher melting point, thus making it suitable for use with molten halides and other molten salts. Examples of higher melting point metals are: Zn, In, Sn, Sb, Te, Pb, and Bi. The preferred materials for construction of the circulating electrolytic coaxial transmission line assembly 2300 are ceramics such as oxides and nitrides that may be metallized for bonding and providing conductive surfaces. Materials and techniques (e.g., moly-manganese metallized alumina) for metallizing and bonding ceramics that are used in the high power vacuum tube industry are well suited to fabrication of high temperature embodiments of the circulating electrolytic coaxial transmission line assembly 2300.

A high-melting point liquid metal 2325 may be chosen based on compatibility with a metal that is being reduced. For example, uranium may be reduced from a molten salt electrolyte into a liquid zinc electrode. Metals used in contact with liquid zinc or other liquid metals would preferably be insoluble in liquid metal 2325 or form an intermetallic compound with a melting point that is higher than the operating temperature of the liquid metal 2325.

Figure 24A:
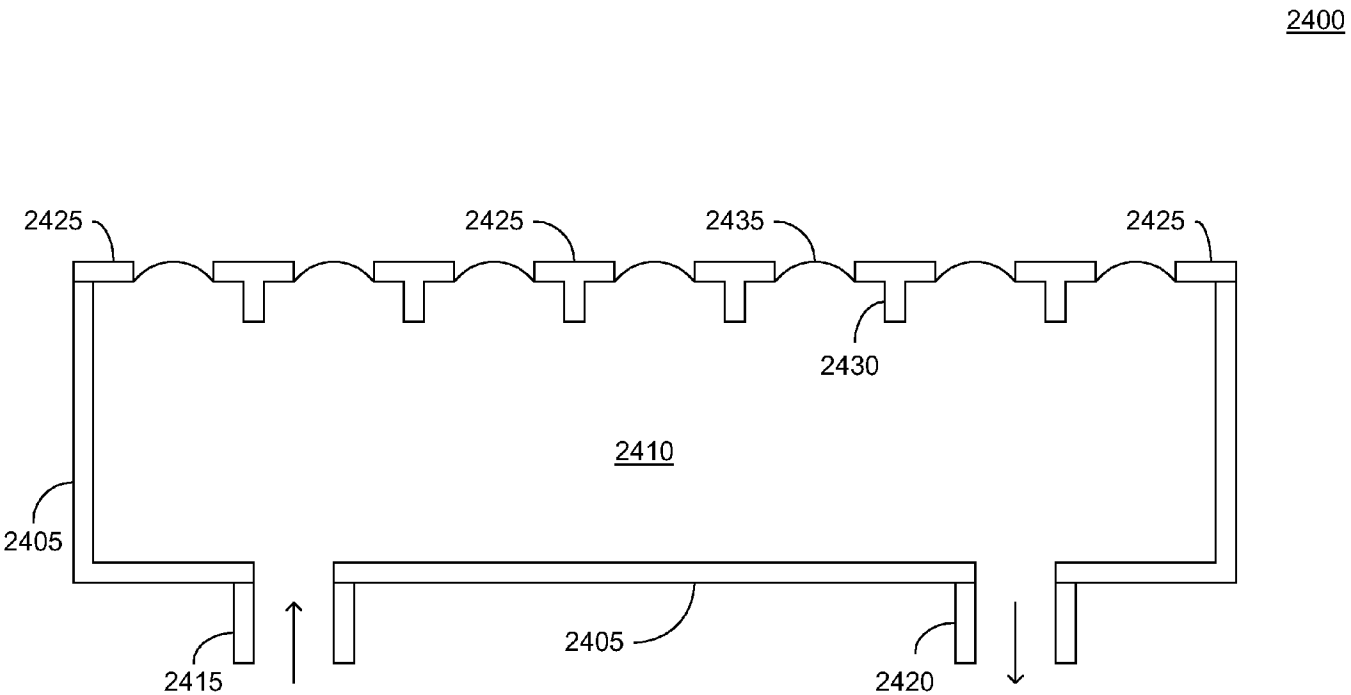
FIG. 24A shows a stabilized liquid metal electrode in accordance with an embodiment of the present invention.

FIG. 24A shows an embodiment of a surface-stabilized liquid metal electrode 2400. A container 2405 holds a volume of liquid metal 2410 that may be circulated through an intake port 2415 and an exhaust port 2420. Since many of the electrode configurations associated with embodiments of the present invention may have a small spacing between electrodes, it is desirable that a liquid metal electrode be prevented from developing a short circuit across a small gap. A perforated cover 2425 divides the surface of the liquid metal into a plurality of smaller discrete surfaces 2435. In this embodiment, the cover 2425 includes a material that is not wet by the liquid metal 2410. Although oxides are generally not wet by metals at low temperature, some metals (e.g., gallium on glass) may be able to wet ceramic materials. Nitrides are an alternative to oxides.

Either the perforated cover 2425 or the container 2405 may be wholly or partly conductive to provide electrical contact to the liquid metal 2410. The cover 2425 may be a flat structure, or may have optional reinforcing features 2430 to provide rigidity. The cover 2425 may be a composite structure that is composed of both dielectric and electrically conductive materials. For example, a metallic base may be coated with a dielectric in those areas that are in contact with an electrolyte. Alternatively, a metallic honeycomb structure may be used to support a thin ceramic plate.

Forces that may act to destabilize the liquid metal surface include circulation currents in the liquid metal 2410, circulation currents in an electrolyte, and electromagnetic forces due to currents flowing through the electrolytic cell. The division of the metal electrode surface into a plurality of smaller surfaces 2435 increases the force that is necessary to achieve a given displacement of the surface 2435, thus allowing smaller electrolyte gaps to be used in the cell. The smaller electrolyte gaps contribute to lower cell resistance and faster charging of the double-layer capacitance. The viscosity of the electrolyte in contact with the liquid metal 2410 may also be adjusted to dampen oscillations that may arise due to electromagnetic effects.

Figure 24B:
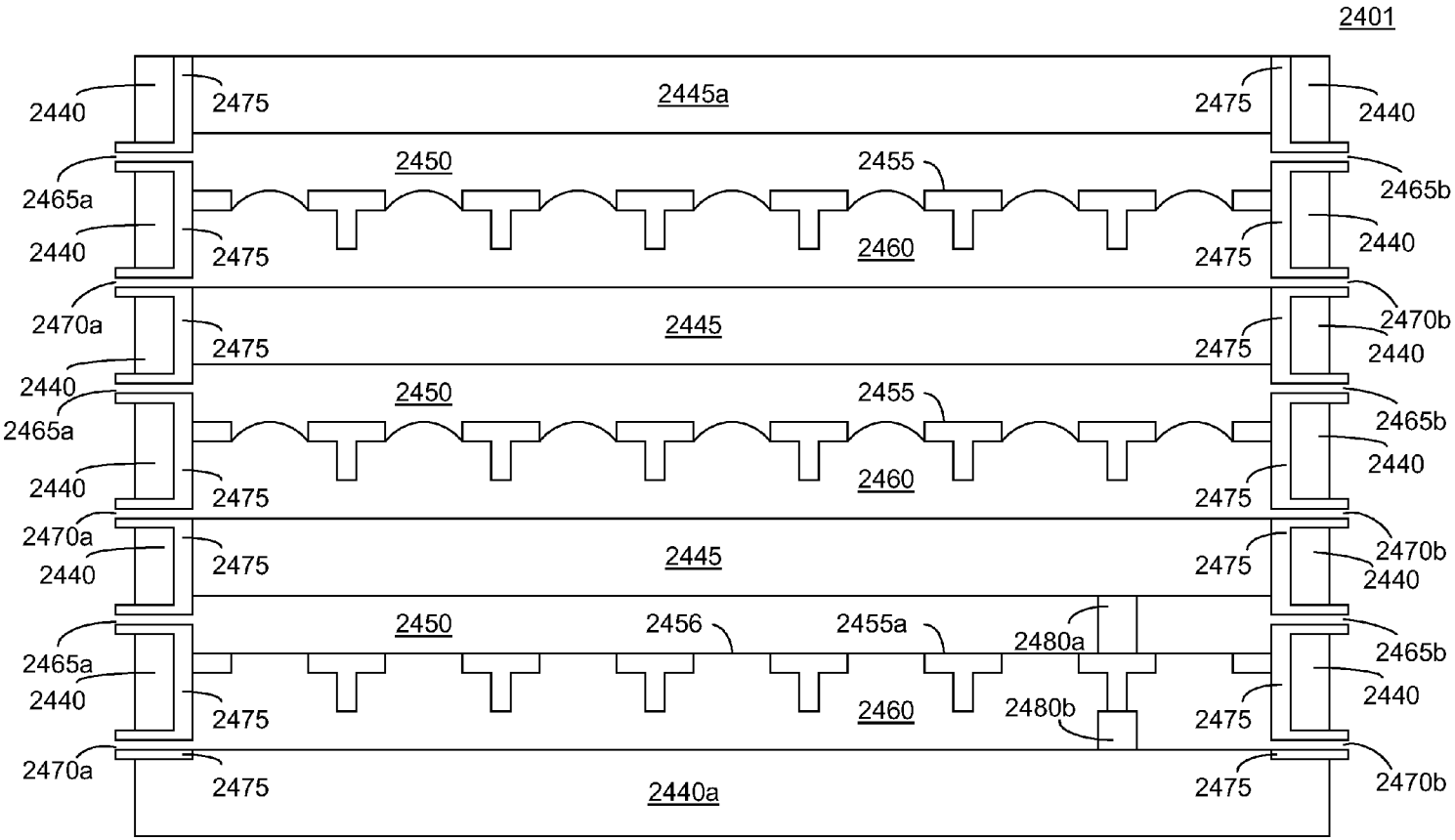
FIG. 24B shows a coaxial transmission line with a series configuration of stabilized liquid metal electrodes in accordance with an embodiment of the present invention.

FIG. 24B shows an embodiment of an electrolytic coaxial transmission line 2401 with a series configuration of stabilized liquid metal electrodes. The basic unit of the electrolytic coaxial transmission line 2401 is made up of a solid electronic conductor (2445*a*, 2445, 2440*a*), an electrolyte-filled gap 2450, and a liquid metal conductor 2460 that are connected in series. The solid electronic conductor 2445*a* that serves as the first electrode in the first cell is adapted for electrical connection to a power bus. Solid electronic conductors 2445 are adapted to contain and establish electrical contact with the liquid metal 2460. The solid electronic conductor 2440 is adapted to contain the liquid metal 2460 and establish electrical contact to the outer conductor 2440.

Examples of materials that are preferred for the construction of high-temperature electrodes (2445*a*, 2445, 2440*a*) are tungsten/copper and silver/molybdenum composites. These materials have a low magnetic permeability, good electrical conductivity, and theft composition can be adjusted to achieve a good thermal expansion match to a variety of ceramic materials. They can also be coated by a wide variety of other materials to optimize their performance as electrodes and liquid metal containers.

The outer conductor 2440 is separated from the center conductor elements by dielectric 2475. Each cell in the coaxial transmission line 2401 has an electrolyte intake port 2465*a* and an electrolyte exhaust port 2465*b*. Each cell in the coaxial transmission line 2401 also has a liquid metal intake port 2470*a* and a liquid metal exhaust port 2470*b*. Two different types of liquid metal electrode stabilizing covers are shown. Stabilizing cover 2455 has apertures whose sides are non-wetting with respect to the liquid metal 2460. Stabilizing cover 2455*a* has apertures that are wet by the liquid metal 2460.

Stabilizing cover 2455*a* is given mechanical support by electrolyte standoff 2480*a* and electrode standoff 2480*b*. For large area electrodes, standoffs 2480*a* and 2480*b* stiffen the stabilizing cover and enable the use of smaller electrolyte gaps. Stabilizing cover 2455*a* has aperture surfaces that are wet by the liquid metal 2460, thus providing a liquid metal surface 2456 that is closer to the opposing electrode 2445.

Figure 25A:
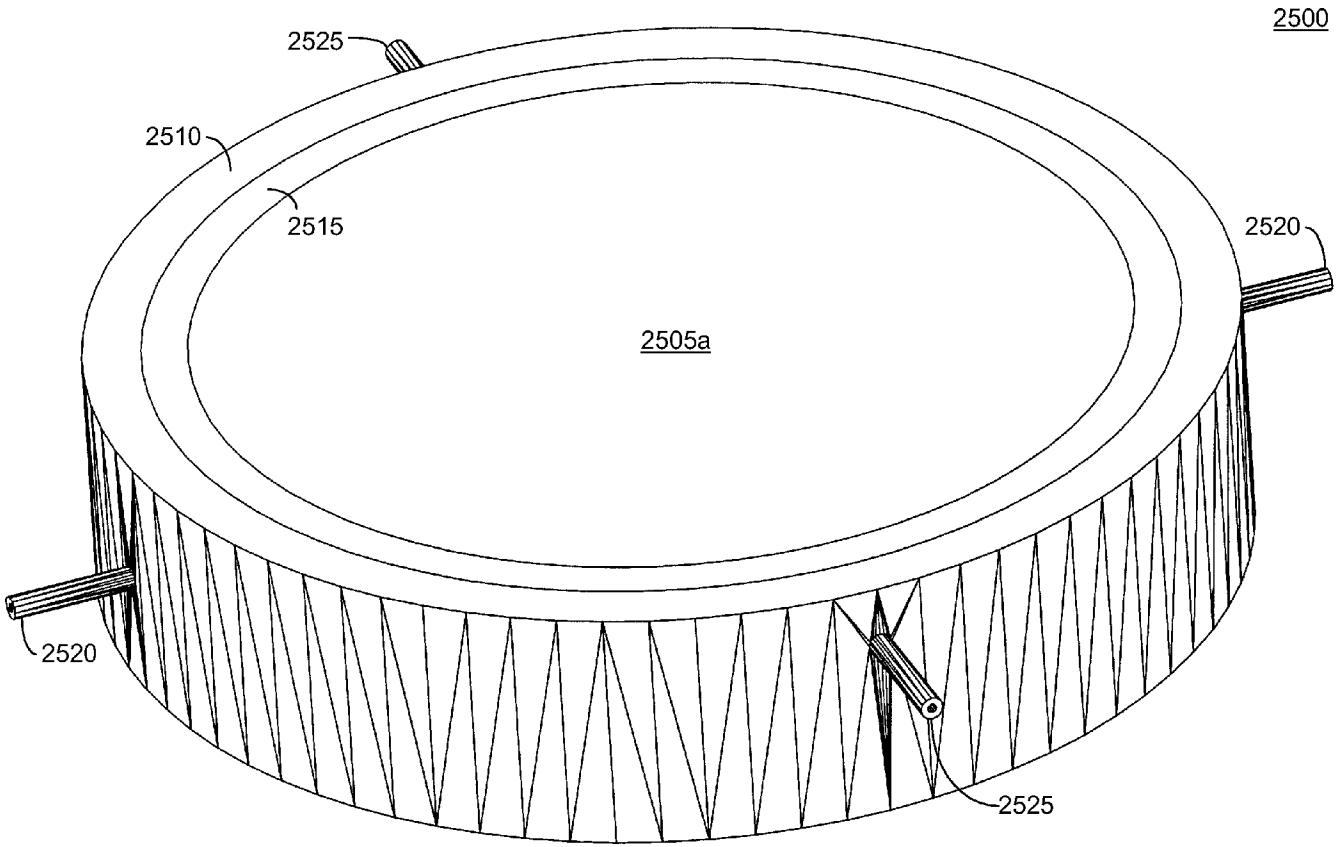
FIG. 25A shows a perspective view of a coaxial electrolytic cell module in accordance with an embodiment of the present invention.
Figure 25B:
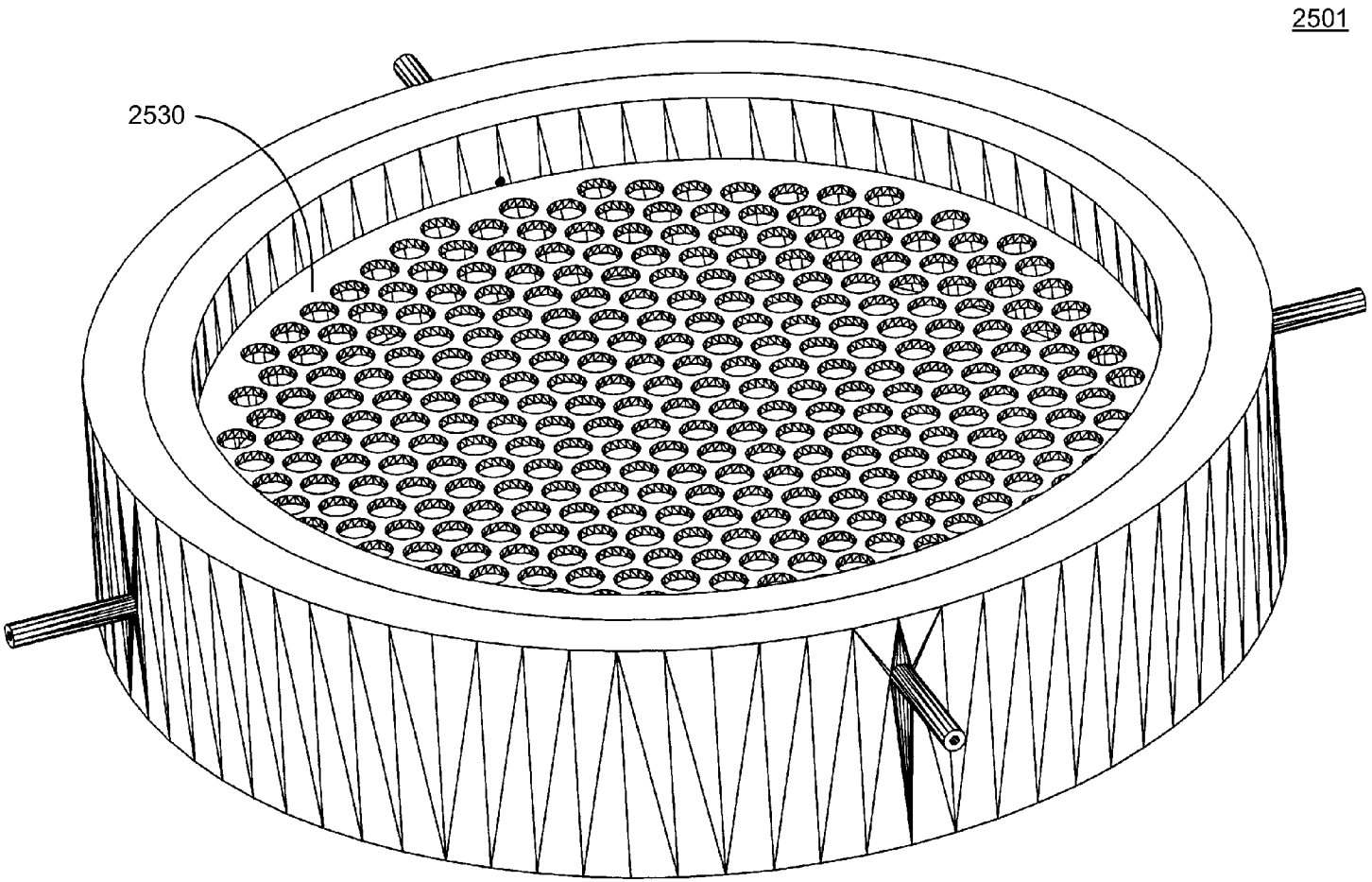
FIG. 25B shows a cutaway view of the coaxial electrolytic cell of FIG. 25A.
Figure 25C:
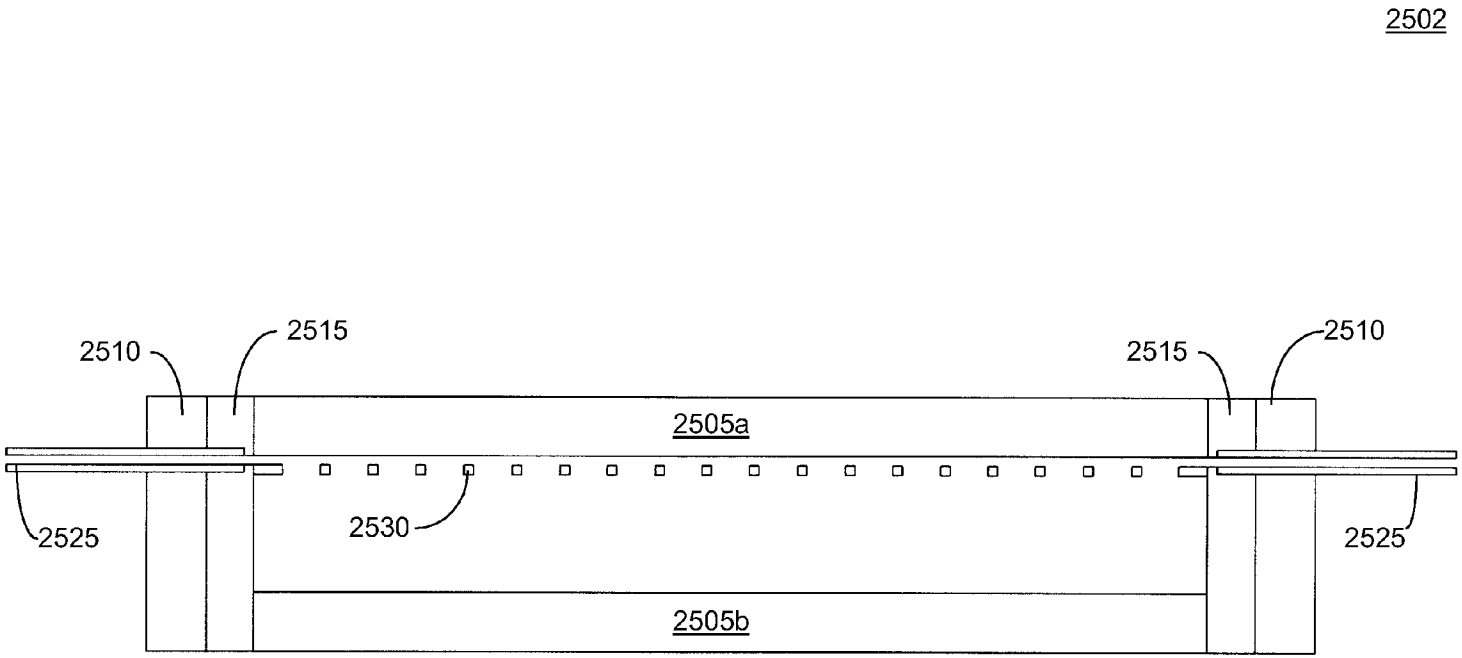
FIG. 25C shows a section view of the electrolyte ports axis of the coaxial electrolytic cell of FIG. 25A.
Figure 25D:
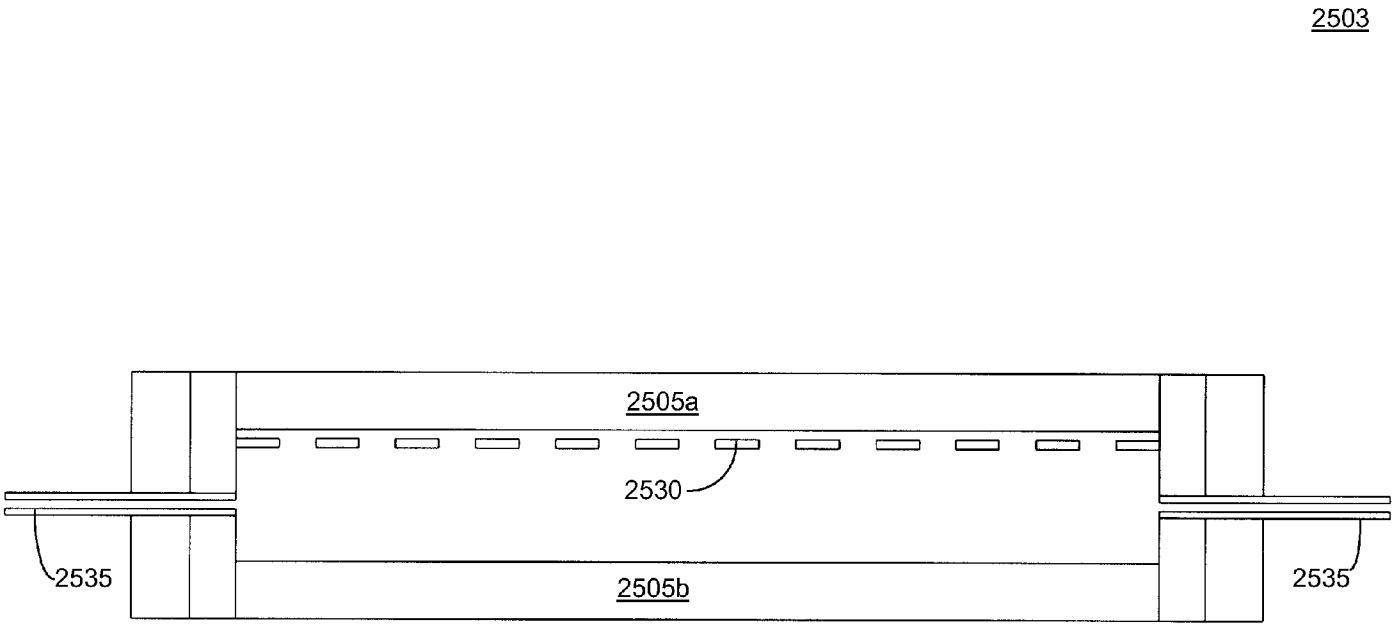
FIG. 25D shows a section view of the liquid metal ports axis of the coaxial electrolytic cell of FIG. 25A.

FIG. 25A shows a perspective view of an embodiment of a coaxial electrolytic cell module 2500 that may be used in the construction of a circulating electrolytic coaxial transmission line similar to that shown in FIG. 24B. A solid electrode 2505*a* is separated from an outer electrode 2510 by a dielectric 2515. Electrolyte ports 2525 and liquid metal ports 2520 are offset 90° from each other. FIG. 25B shows a cutaway view 2501 of the coaxial electrolytic cell module 2500 of FIG. 25A and shows a stabilizing liquid metal cover 2530. FIG. 25C shows a section view 2502 through the axis of the electrolyte ports 2525. FIG. 25D shows a section view 2503 through the axis of the liquid metal ports 2535. Electrode 2505*b* is the counterelectrode to electrode 2505*a*.

Figure 26:
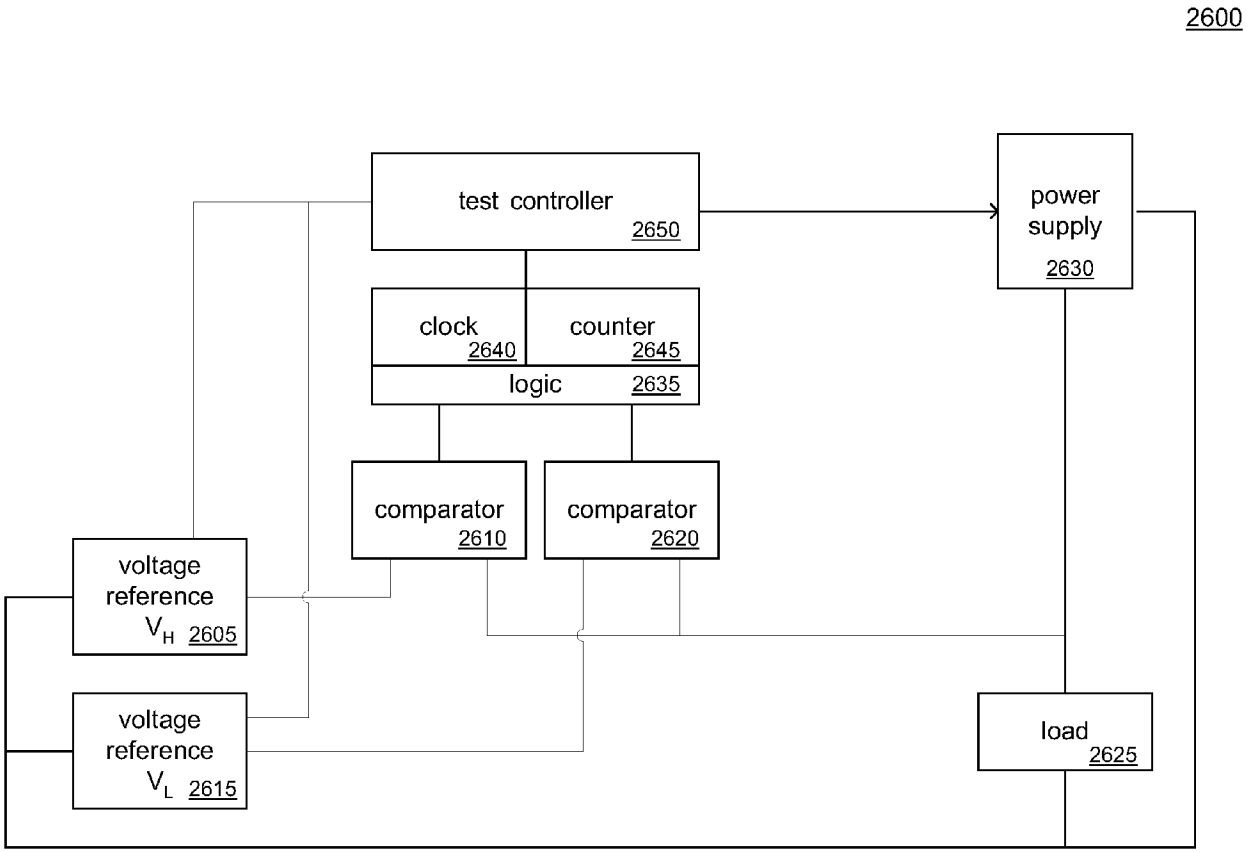
FIG. 26 shows a schematic for an RC time constant measurement circuit in accordance with an embodiment of the present invention.

FIG. 26 shows a schematic diagram 2600 for an RC time constant measurement circuit that may be used in conjunction with the electrolytic cell interphase control system shown in FIG. 3A. In order to optimize the waveform provided to an electrolytic cell, it is desirable to know the charging characteristics of the double-layer capacitance associated with the cell. Load 2625 represents an electrolytic cell, or a series of electrolytic cells. Power supply 2630 supplies current to the load 2625 and is controlled by the test controller 2650. The RC time constant of the load 2625 is measured by determining the time required for discharge of the intrinsic load capacitance from voltage reference $V_H$ to a lower voltage reference $V_L$.

In one embodiment, the test controller causes the power supply to charge the load 2625 to a voltage value that is slightly greater than $V_H$. When charged to a voltage greater than $V_H$ the outputs of comparators 2610 and 2620 are in the same state (e.g., high) since the voltage across the load 2625 is greater than both $V_H$ and $V_L$. The outputs of comparators 2610 and 2620 are coupled to logic 2635 (e.g., an XOR gate). Clock 2640 is coupled to logic 2635 and a counter 2645 that is enabled to count pulses from clock 2640 when the logic 2635 is in the appropriate state (e.g., XOR high).

When the test controller 2650 causes the load 3625 to be shunted to ground or other potential that is less than or equal to $V_L$, the discharge is initiated and the voltage across the load 2625 falls. When the voltage falls below $V_H$ the logic 2635 enables the counting of clock pulses by the counter 2645 until the voltage across the load falls below $V_L$, at which time the logic disables the counting of pulses by the counter 2645. The test controller 2650 may be used to set $V_L$ and $V_H$ so that the RC time constant over a particular voltage range may be determined. The RC time constant thus determined might be used to establish the required pulse width of a fixed voltage pulse that is applied to charge the double-layer capacitance to a desired voltage.

For example, $V_H$ may be established as the voltage for which the onset of a desired redox reaction occurs in the load 2625. With respect to FIG. 14 in this instance, $V_2$ may be a value somewhat larger than $V_H$. $V_L$ would be set to $V_0$ or $V_4$. The RC time constant for the cell that is determined by the discharge from $V_H$ to $V_L$ may then be used to determine the values for $V_1$ and $t_1$ that may quickly charge the double-layer capacitance to $V_H$; and also to determine the values for $V_3$ and $t_3$ that may quickly discharge the double-layer capacitance.

Figure 27:
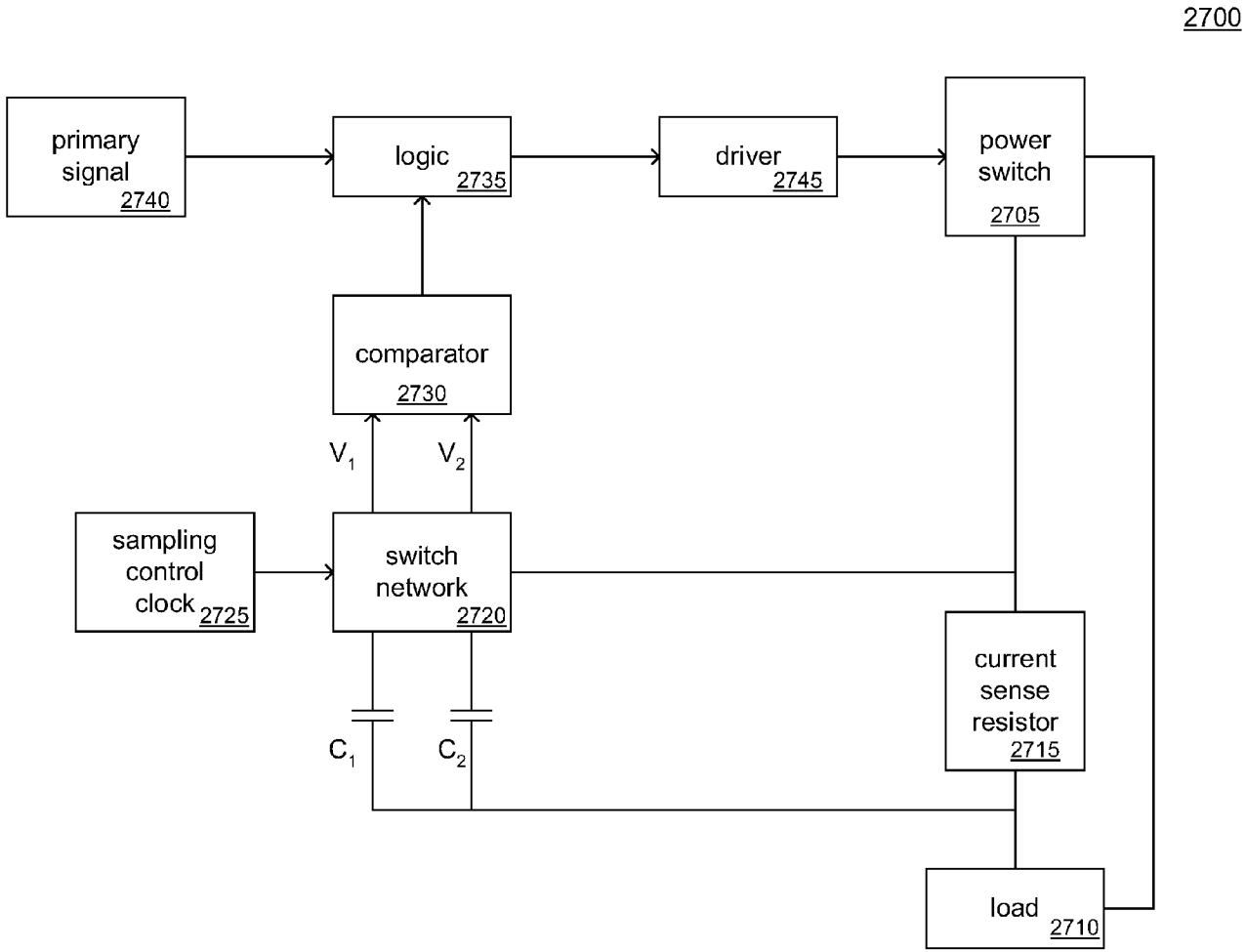
FIG. 27 shows a schematic for a redox reaction detection circuit in accordance with an embodiment of the present invention.

FIG. 27 shows a schematic diagram 2700 of an embodiment of a redox reaction detection circuit for detecting the onset of a redox reaction in an electrolytic cell represented by a load 2710. The circuit may be implemented for real-time control of the potential applied to an electrolytic cell. A power switch 2705 is driven by a driver 2745 that is in turn controlled by output from a logic circuit 2735. The logic circuit 2735 is responsive to a primary signal 2740 and a comparator 2730. The comparator 2730 has one output state associated with the condition $V_1$ greater than or equal to $V_2$, and another state associated with $V_1$ less than $V_2$.

A current sense resistor 2715 that is in series with the load 2710 is coupled to a switch network 2720 and to sampling capacitors $C_1$ and $C_2$. The switch network sequentially samples the potential across the current sense resistor 2715 at an interval controlled by the sampling control dock 2725. The current sense resistor may be a specific discrete resistor that is added to the circuit, or it may be a resistance that is intrinsic to the circuit.

At the beginning of a sampling cycle capacitor $C_1$ may be switched by the switch network 2720 to a parallel connection with the current sense resistor 2715 for a short period of time (e.g., <10 nanoseconds) that allows $C_1$ to track the potential across the current sense resistor 2715. $C_1$ is then disconnected from the current sense resistor 2715 by the switch network 2720. The sampling process may then be repeated for $C_2$. After voltage samples $V_1$ and $V_2$ have been acquired respectively on $C_1$ and $C_2$, the switch network 2720 subsequently couples C1 and C2 to comparator 2730.

When charging the capacitance associated with the load 2710 by a fixed voltage in the absence of redox reactions, the current through the current sense resistor 2715 will decrease over time. Since $V_2$ is acquired after $V_1$, it will normally be less than $V_2$. However, the onset of a redox reaction may produce an increase in current that will result in $V_2$ being greater than $V_1$. When this happens, the comparator output changes state, causing the control logic to turn off the driver 2745 which in turn causes the power switch 2705 to shut off.

Alternatively, the power switch may reduce the current to a preselected value for a period prior to shutting off.

RC measurement circuit shown in FIG. 26 may be used to establish process pulse waveform parameters prior to applying the process pulse waveform to an electrolytic cell. In contrast, the redox detection circuit shown in FIG. 27 may be used to provide realtime control of a process pulse waveform on a pulse-by-pulse basis. The RC measurement circuit shown in FIG. 26 and the redox detection circuit of FIG. 27 may each be used in conjunction with the circuits shown in FIG. 16, FIG. 18A, and FIG. 18B.

Figure 28A:
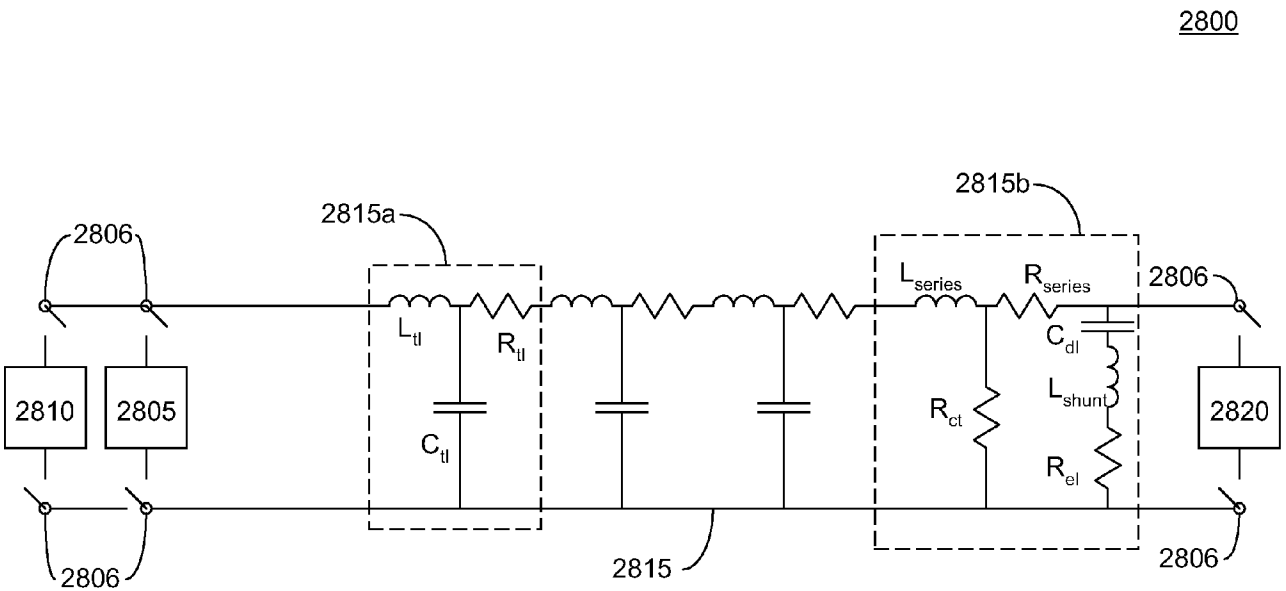
FIG. 28A shows a schematic for an electrolytic redox circuit with a high frequency source in accordance with an embodiment of the present invention.
Figure 28B:
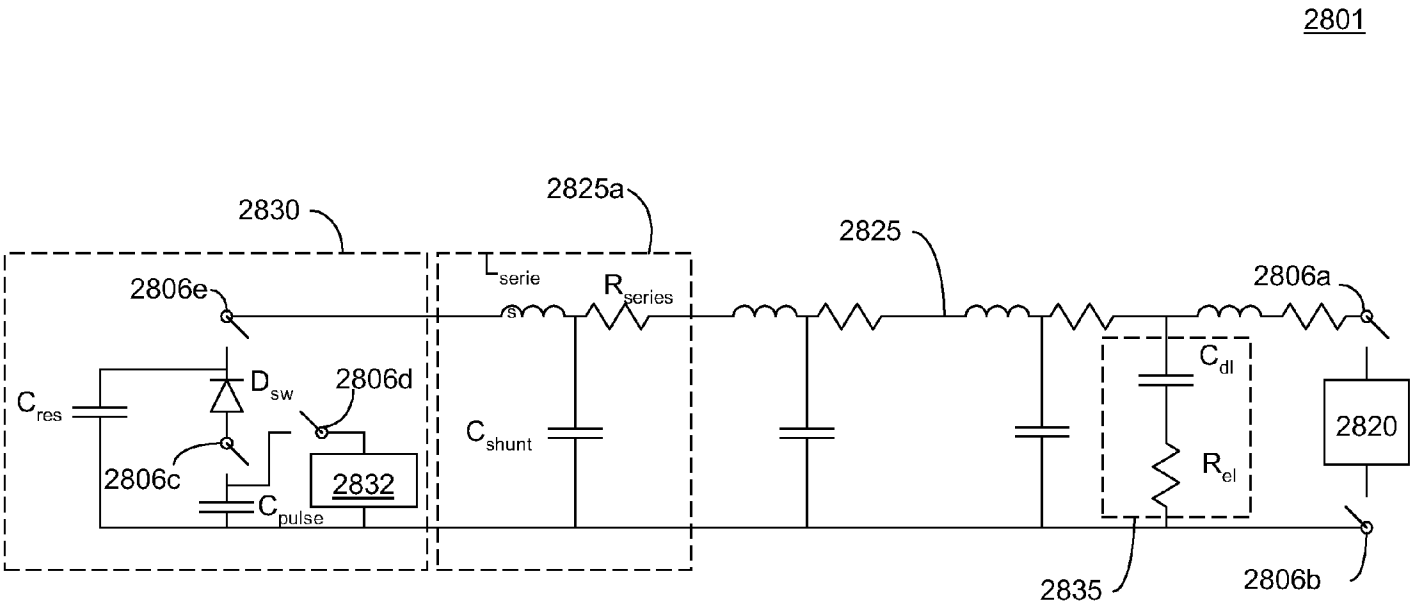
FIG. 28B shows a schematic for a transmission line duct with a pulsed excitation source in accordance with an embodiment of the present invention.

FIG. 28A shows an electrical schematic for an embodiment of an electrolytic isotope separation system 2800. A transmission line duct 2815 includes two basic units, a bus transmission line segment 2815*a* and a transmission line electrode unit 2815*b*. The bus transmission line segment 2815*a* is represented by series inductance $L_{tl}$, series resistance Rd, and shunt capacitance $C_{tl}$. The transmission line electrode unit 2815*b* is represented by series inductance $L_{series}$, series resistance $R_{series}$, combined with an electrolytic cell represented by a combination of double layer capacitance $C_{dl}$, inductance $L_{shunt}$, and electrolyte resistance $R_{el}$ in parallel with a charge transfer resistance $R_{ct}$. For simplicity, dielectric and magnetic loss elements are not shown, although they may be significant at high frequencies.

A pulse power supply 2805, a radio frequency (RF) power supply 2810 and shunt 2820 are each coupled by a pair of switches 2806 to the transmission line duct 2815. Two switches generally provide better isolation between the switched components, and reduce parasitic elements (e.g., capacitance) seen by an active component. Alternatively, a single switch may be used with the other switch being replaced by a connection.

The pulse power supply 2805 provides current for charging/discharging the double layer capacitance $C_{dl}$ and/or carrying out redox reactions. For example, the circuit shown in FIG. 16, or a derivative thereof, may serve as the pulse power supply 2805. The pulse power supply 2805 is generally switched in to the transmission line duct 2815 when the RF power supply 2810 and shunt 2820 are switched out, although a DC bias may be combined with an RF signal. In general, it is desirable that the total inductance for the transmission line structure be less than one microhenry and that the RC time constant of the electrolytic cell be less than one millisecond. These electrical constraints translate to close conductor and electrode spacings and a compact system size when realized in a physical embodiment. When a high frequency magnetic excitation is to be applied, the electrical requirements become more stringent.

The RF power supply 2810 may be used to provide a high frequency current at one or more frequencies. The RF power supply 2810 may include one or more oscillators, which may be either tunable or fixed frequency. The RF power supply 2810 is typically used in conjunction with the shunt 2820. The shunt 2820 provides a switchable path that reduces the voltage developed across the electrolytic cell ($R_{ct}$, $C_{dl}$, $L_{shunt}$, and $R_{el}$), while providing a current through the transmission line conductors, The shunt 2820 may act as a short circuit in a lumped circuit, or may provide a matched termination to minimize reflections in a distributed circuit.

Depending upon the physical dimensions associated with the transmission line duct 2815, the nature of the dielectric used in construction, and the operating frequency of the RF power supply 2810, the transmission line duct 2815 may be treated as either a lumped circuit or a distributed circuit. In general, it is desirable that size of the electrolytic isotope separation circuit 2800 be chosen so that it may be treated as a lumped circuit; however, at high frequencies (e.g., above about 100 MHz), the difficulty associated with physical miniaturization must be balanced with the complexity of dealing with a distributed circuit.

An array of small circuits that can be treated individually as lumped circuits is preferred to a single large system that has a dimension on the order of the excitation wavelength. Nuclear magnetic resonance (NMR) frequencies in low static magnetic fields are generally below 100 MHz, whereas electron paramagnetic resonance (EPR) frequencies may be orders of magnitude higher (e.g., greater than 10 GHz). Due to skin depth effects, a large system will have resistive losses associated with conductor lengths that cannot be simply offset by a proportional increase in conductor cross-section. In a preferred embodiment, the length of the electrode/electrolyte interface, measured in the direction of the current flow, is less than 1/100 of the wavelength of the magnetic excitation frequency.

The combination of the RF power supply 2810 and transmission line duct 2815 may be a resonant structure with capacitance being largely provided by the RF power supply 2810, and inductance being largely provided by the transmission line duct 2815 series inductance $L_{series}$. The resonant frequency of the structure may be tuned to a frequency for producing a microwave-induced magnetic isotope effect (MIMIE) in species present in the electrolyte within the transmission line electrode unit 2815*b*.

FIG. 283 shows an electrical schematic for an embodiment of an electrolytic isotope separation system 2801 with a pulsed excitation source 2830 coupled to a transmission line duct 2825. The pulsed excitation source includes a charging circuit 2832 coupled to a pulse capacitor $C_{pulse}$ by a switch 2806*d*. $C_{pulse}$ is coupled to a switch diode $D_{sw}$ by a switch 2806*c*. Resonant capacitor $C_{res}$ and $D_{sw}$ are coupled to the transmission line duct 2825 by switch 2806*e*.

In the following description of an operational embodiment it is assumed that switches 2806(*a, b, c, d*) are initially open. Excitation is enabled by closing switches 2806*a* and 2806*b* so that shunt 2820 effectively shorts the end of the transmission line duct 2825. Switch 2806*d* is closed to charge $C_{pulse}$. Once $C_{pulse}$ is charged, switch 2806*d* may be opened. Switch 2806*c* is closed to charge $C_{res}$. Switch 2806*e* may then be closed to connect pulsed excitation source 2830 to the transmission line duct 2825. Upon the closure of switch 2806*e*, the energy stored in $C_{res}$ will oscillate between $C_{res}$ and the inductance $L_{series}$ of transmission line 2825. $R_{series}$ and other lossy elements will damp the oscillation, which may be regenerated by further discharges from $C_{pulse}$. It should be noted that a single capacitor may be used for single shot excitation.

In one embodiment, switch 2806*e* is kept in a dosed state while switch 2806*c* is operated to produce a sequence of resonance regeneration pulses. Each pulse produced by switch 2806*c* produces a damped resonant response that decays after a number of cycles at the resonant frequency. For example, transmission line duct system 2801 may be excited at a resonant frequency of 80 MHz and switch 2806*c* may be operated at a frequency of 10 MHz. In the process of excitation, a precise amplitude may not be critical, but it may be desirable to maintain the current above a threshold value required for a desired magnetic field intensity within the electrolyte gap. The number of resonant cycles between pulses applied by switch 2806*c* may be determined by the threshold current value and the amount of energy delivered in each pulse. Thus, an excitation frequency that is considerably higher than the power switching frequency may be obtained.

Selection of the value for $C_{res}$ may be done by characterizing the transmission line 2825 and then selecting the value of $C_{res}$ that corresponds to a desired resonant frequency. The characteristics of electrolytic cell 2835 may vary with frequency, particularly at high frequencies (e.g., the Debye-Falkenhagen effect). Thus, the criteria for selection of solvents and/or electrolytes may extend beyond electrochemical concerns and may involve solvent and/or ionic species behavior at RF and microwave frequencies.

Typically, the required excitation voltage will rise with frequency due to the increasing inductive reactance. However, the increase in applied frequency will offset the enhanced charging of $C_{dl}$ due to the increased voltage since the charging time will be reduced. It is generally desired that redox reactions in the electrolytic cell be avoidable during RF or microwave excitation. The area of the electrode/electrolyte interface may be selected to provide a desired $C_{dl}$. $R_{el}$ may also be tailored to provide an RC time constant that allows RF excitation to be achieved while minimizing unwanted redox reactions in the electrolytic cell during excitation. An intentional DC bias may be applied to induce redox reactions during excitation.

Figure 29A:
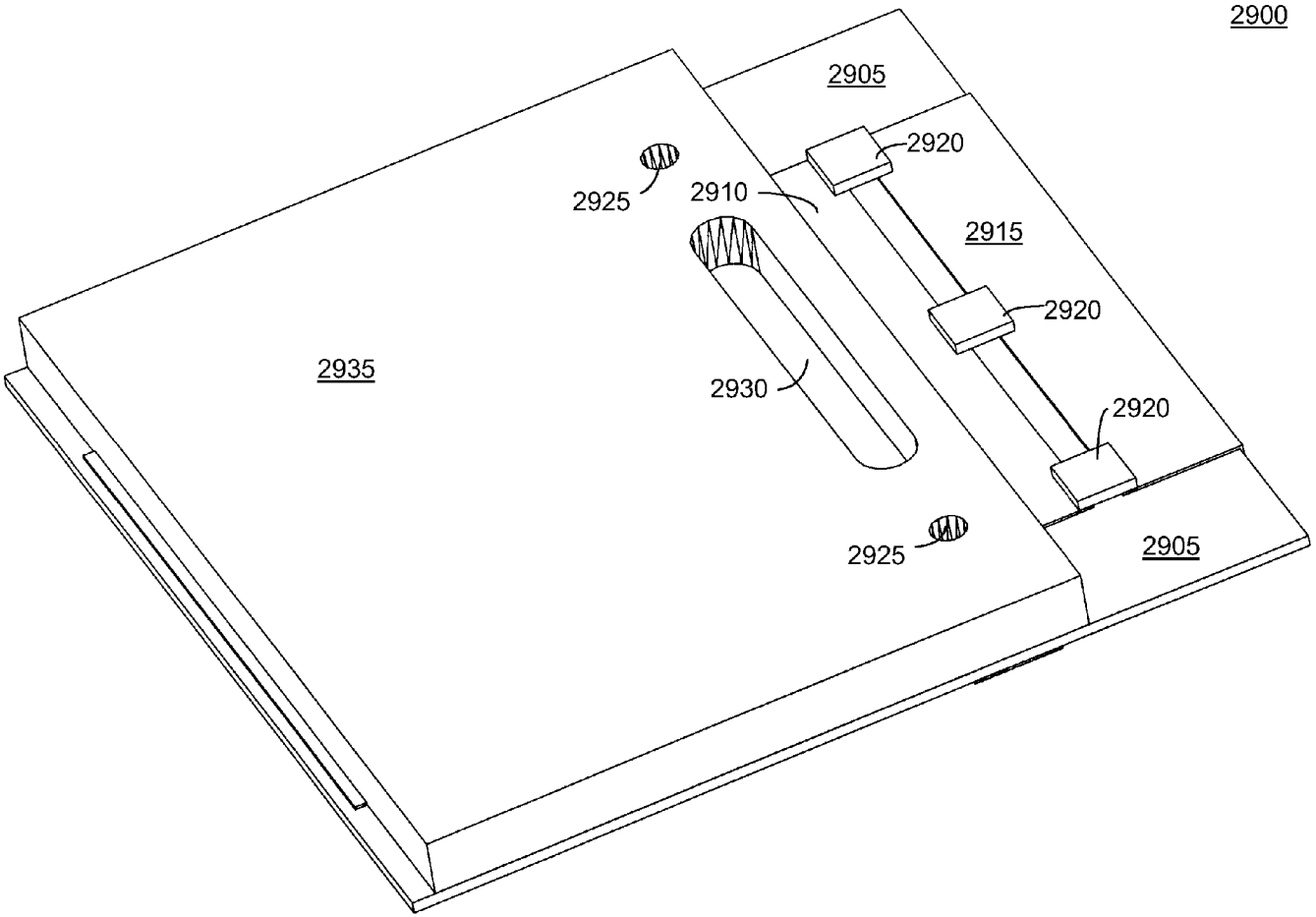
FIG. 29A shows a perspective view of a parallel plate transmission line duct with a shunt switch in accordance with an embodiment of the present invention.

FIG. 29A shows a perspective view of an embodiment of a parallel plate transmission line duct 2900 with shunt switches 2920. A top plate 2935 has an aperture 2930 and electrolyte ports 2925. Shunt 2915 is coupled to a top conductor 2910 by switches 2920. It is preferable that switches 2920 have low inductance and low resistance in the on state. Top conductor 2910 is disposed between a dielectric 2905 and top plate 2935.

Figure 29B:
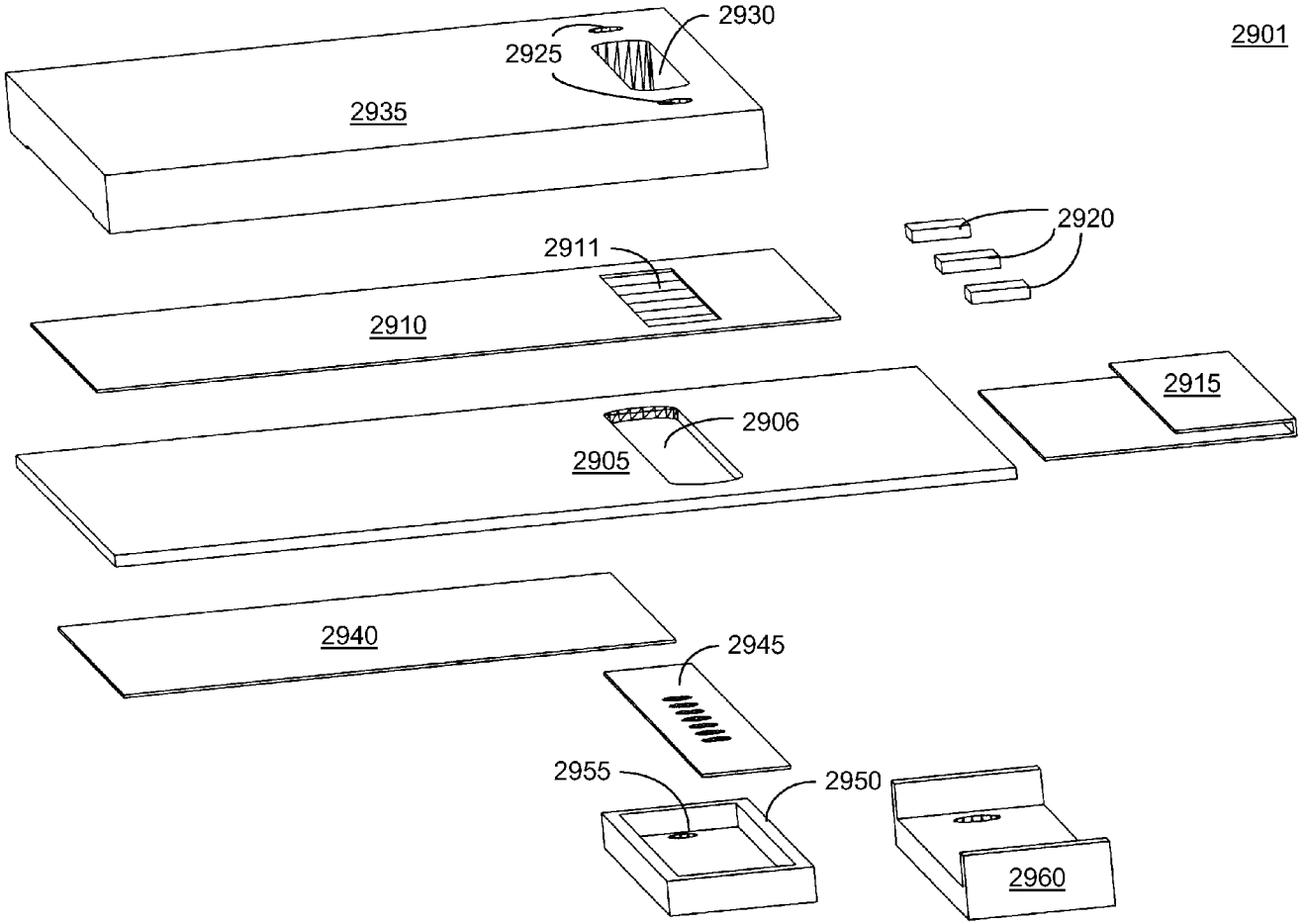
FIG. 29B shows an exploded view of the parallel plate transmission line duct shown in FIG. 29A.

FIG. 29B shows an exploded view 2901 of the parallel plate transmission line duct 2900 shown in FIG. 29A. A bottom conductor 2940 is separated from the top conductor 2910 by the dielectric 2905. It is preferable that the dielectric 2905 be a material with a low dielectric constant and low dielectric loss, particularly at high frequencies. Fluorocarbon polymers and porous materials may be used. A portion of the dielectric may be a material with a high magnetic permeability that serves to modify a magnetic field in the gap between the top conductor 2910 and the bottom conductor 2940.

Preferred materials for the top conductor 2910 and bottom conductor 2940 are copper and silver, particularly at high frequencies where the skin depth is small. The top conductor 2910 and bottom conductor 2940 may have portions that are coated to provide compatibility with an electrolyte or liquid metal. For example, the top conductor 2910 may have a platinum coating. It is generally desirable to maintain thin (e.g., less than one micron) coatings of uniform thickness with abrupt transitions to the base metal, particularly at higher frequencies. A liquid metal stabilizer 2945 and an electrode chamber 2950 provide containment for a liquid metal electrode. In an alternative embodiment, the liquid metal stabilizer is a narrow slit with a length that is at least ten times greater than its width. The electrode chamber 2950 may have one or more ports 2955.

Ideally, most of the magnetic flux produced by excitation current flowing in the parallel plate transmission line duct 2900 would pass through the electrolyte chamber 2906; however, for a structure with a uniform magnetic permeability the magnetic field will be distributed over a region of space that will be significantly larger than the volume of the electrolyte chamber 2906. Thus, it may be desirable to introduce elements that can shape the magnetic field and increase the magnetic flux that is produced by a given excitation current.

A magnetic field enhancer 2960 intensifies the magnetic field in the electrolyte chamber 2950 that is produced by the RF current flowing through the parallel plate transmission line duct 2900. The magnetic field enhancer is fabricated from a material that has a relative permeability greater than one. In general, structures with a high initial permeability and a low saturation inductance are preferred. In a particular embodiment the magnetic field enhancer 2960 is saturated at current levels that exceed the desired operating excitation current amplitude by 10% or more.

In order for the parallel plate transmission line duct 2900 to provide a sufficiently strong RF magnetic field within the electrolyte chamber 2906, a certain amount of inductance is required. However, too much inductance in the electrolytic current path may degrade the electrolytic pulse waveform. Since the peak electrolytic current may be much larger than the current used to produce the RF magnetic field, a low saturation inductance in the magnetic field enhancer 2960 minimizes the impact on the electrolytic pulse waveform that is applied. Application and synchronization of the electrolytic pulse and magnetic excitation may be controlled by components similar to those disclosed with respect to FIG. 10A.

A magnetic field enhancer 2960 may be disposed between the upper conductor 2910 and the lower conductor 2940. Since a magnetic field enhancer 2960 that is disposed between the upper conductor 2910 and the lower conductor 2940 will have a greater impact on the capacitance of the parallel plate transmission line duct 2900, a material with a lower dielectric constant may be used. Although the dielectric constants of the materials of construction are not critical with respect to the electrolytic pulse, it can make the difference as to whether the parallel plate transmission line duct 2900 may be treated as a lumped circuit or a distributed circuit, as the excitation wavelength in the transmission line duct 2815 will decrease with increasing dielectric constant of the dielectric 2905.

In a particular embodiment, a portion of a parallel plate transmission line duct 2900 that includes a magnetic field enhancer 2960 and an electrolyte chamber 2906, forms a magnetic circuit in which more than 75% of the shortest magnetic flux path length lies within the magnetic field enhancer 2960 and less than 25% of the magnetic flux path lies within the electrolyte chamber 2906.

In one embodiment the magnetic field enhancer 2960 is fabricated from a homogeneous soft ferrite. In another embodiments, thin film laminate and/or composite structures may be used. More than one magnetic field enhancer 2960 may be used to enhance and/or shape the RF magnetic field. Since the RF current path differs from the electrolytic current path, the magnetic field enhancer may not be placed to simply maximize the RF magnetic field intensity, but may be placed to optimize the tradeoff between the increase in the RF magnetic field and the degradation of the electrolytic pulse.

A window insert 2911 provides for the transmission of electromagnetic radiation to the electrolyte chamber 2906. The window insert is preferably a high transmittance material that is chemically inert with respect to the electrolyte that is used. The window insert may have a transparent conductive coating such as indium tin oxide, or it may have a metal pattern disposed on the surface to form an electrode. In a preferred embodiment, a metal pattern having parallel metal traces with a width of less than 20 microns is used. Diffraction of incident electromagnetic radiation should be taken into account when a metal pattern is used, particularly for monochromatic sources.

Figure 29C:
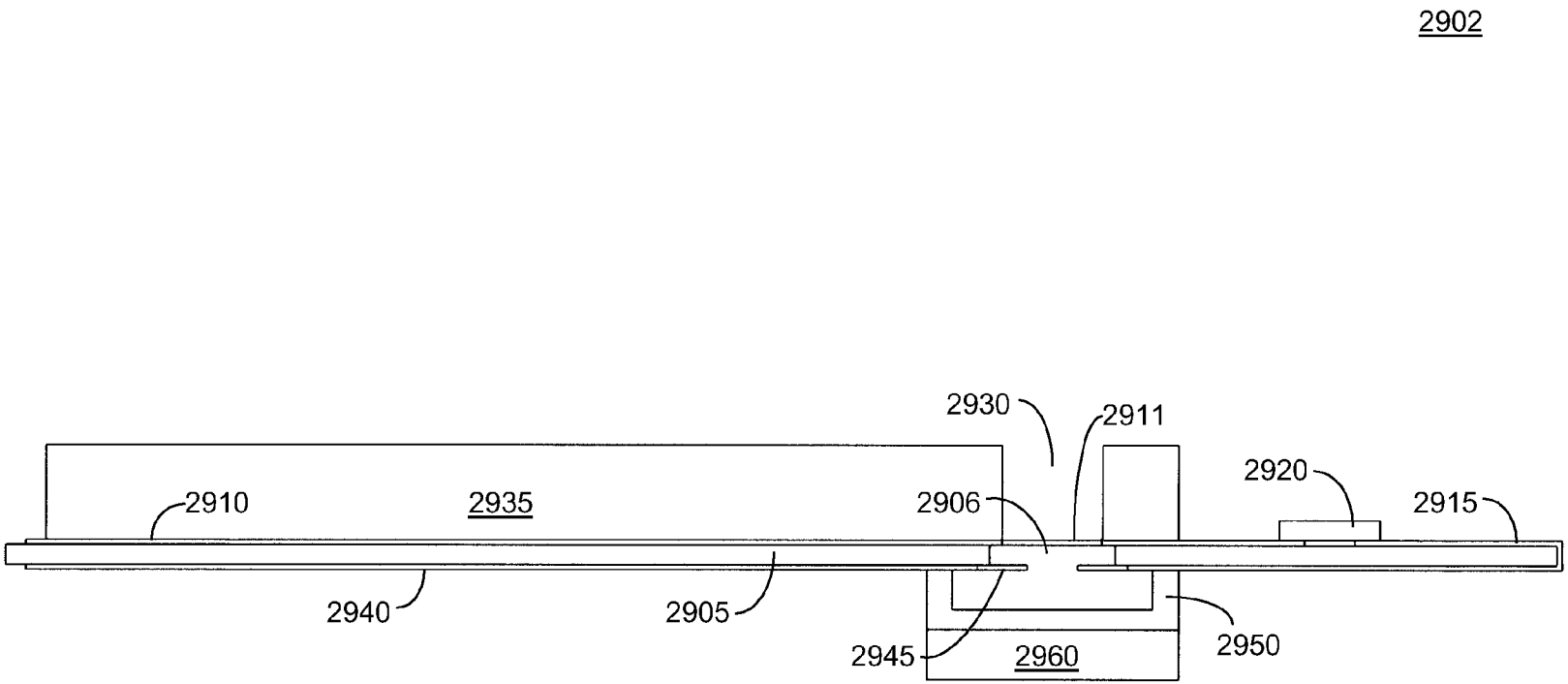
FIG. 29C shows section view of the parallel plate transmission line duct shown in FIG. 29A.

FIG. 29C shows section view 2902 of the parallel plate transmission line duct 2900 shown in FIG. 29A. The cavity in the electrode chamber 2950 allows a contained liquid metal to electrically couple the bottom conductor 2940 to the shunt 2915. Thus, the electrode chamber 2950 may be either a dielectric or conductor. The liquid metal stabilizer 2945 separates the electrode chamber from the electrolyte chamber 2906. Access to the electrolyte chamber 2906 is obtained through the electrolyte ports 2925. An electrolyte circulation system may be used to remove heat produced by the electrolytic current and excitation energy. For example, the bath controller 1240 shown in FIG. 12A may provide cooling in addition to heating.

Figure 29D:
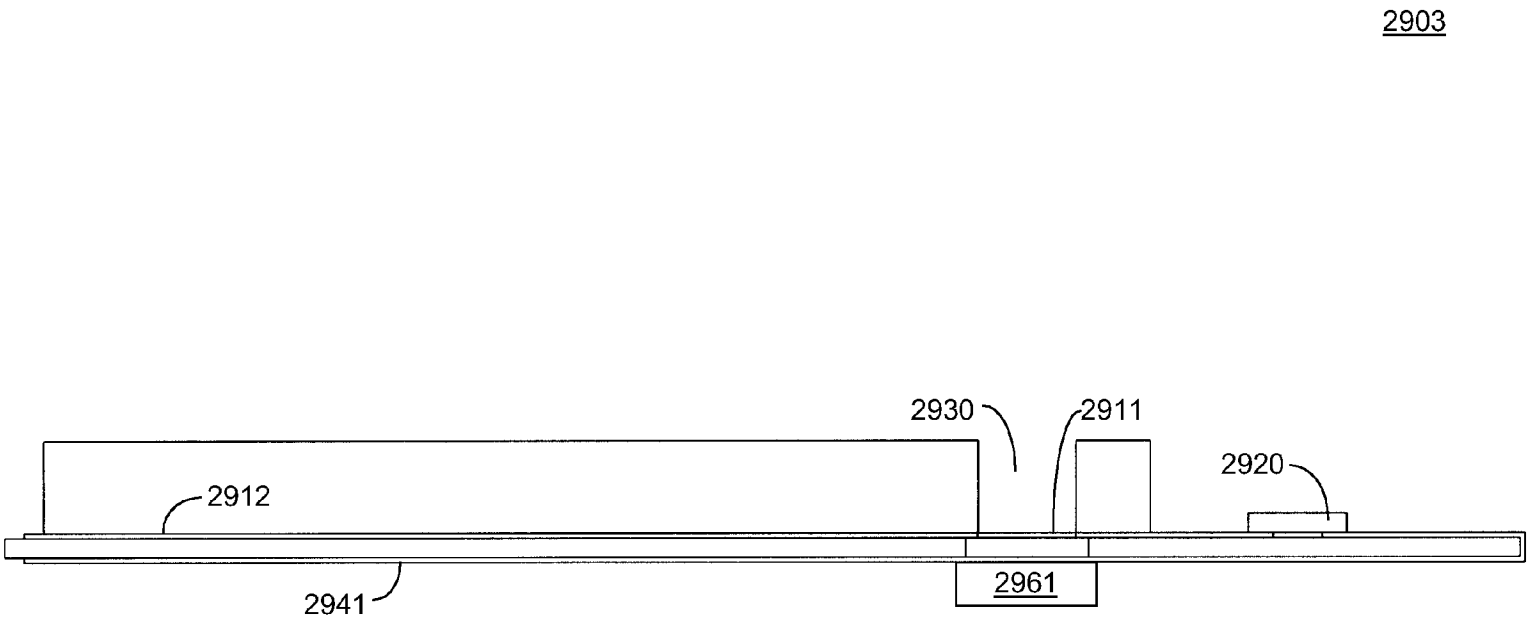
FIG. 29D shows a section view of a parallel plate transmission line duct with solid electrodes in accordance with an embodiment of the present invention.

FIG. 29D shows a section view of an embodiment of a parallel plate transmission line duct 2903 similar to that shown in FIG. 29C, except that a solid electrode 2941 replaces the liquid metal electrode assembly and is coupled directly to the shunt switches 2920. Solid electrodes are preferred for electrolytic processes involving oxidation or partial reduction of species, particularly in a low conductivity electrolyte where a narrow gap is desired. A magnetic field enhancer 2961 is coupled to the solid electrode 2941. Although the separation between electrodes 2912 and 2941 is shown as uniform, the separation may be varied along the length of the transmission line duct 2903. For example, the separation may be greater across the electrolyte gap 2906 and smaller across the dielectric 2905, or vice versa.

Figure 30:
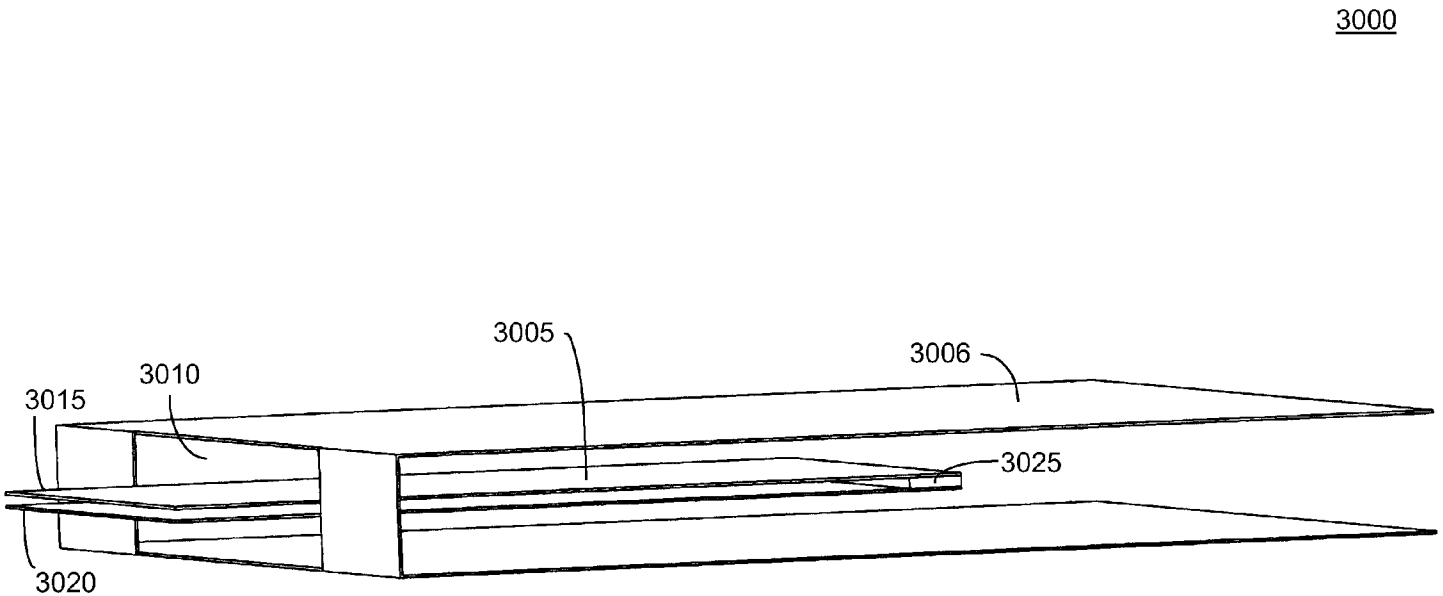
FIG. 30 shows a perspective view of a parallel plate transmission line duct with a coupled single turn solenoid in accordance with an embodiment of the present invention.

FIG. 30 shows a perspective view of a parallel plate transmission line duct system 3000. A parallel plate transmission line duct 3005 is magnetically coupled to a single turn solenoid 3006. An aperture 3010 allows the electrolytic cell portion 3025 of the transmission line duct 3005 to reside within the core of the single turn solenoid 3006. The top conductor 3015 and bottom conductor 3020 extend beyond the core of the single turn solenoid 3006. The single turn solenoid 3006 may be used to provide a magnetic field for RF excitation of species within the electrolytic cell 3025 and provides an alternative to the self-excited structure shown in FIG. 29A. Supporting dielectric structures and magnetic materials similar to those disclosed elsewhere within this application may be used to provide mechanical support and magnetic field modification, and are not shown in FIG. 30. In general, an external magnetic field source other than a single turn solenoid may be used and may be configured in other orientations.

Figure 31:
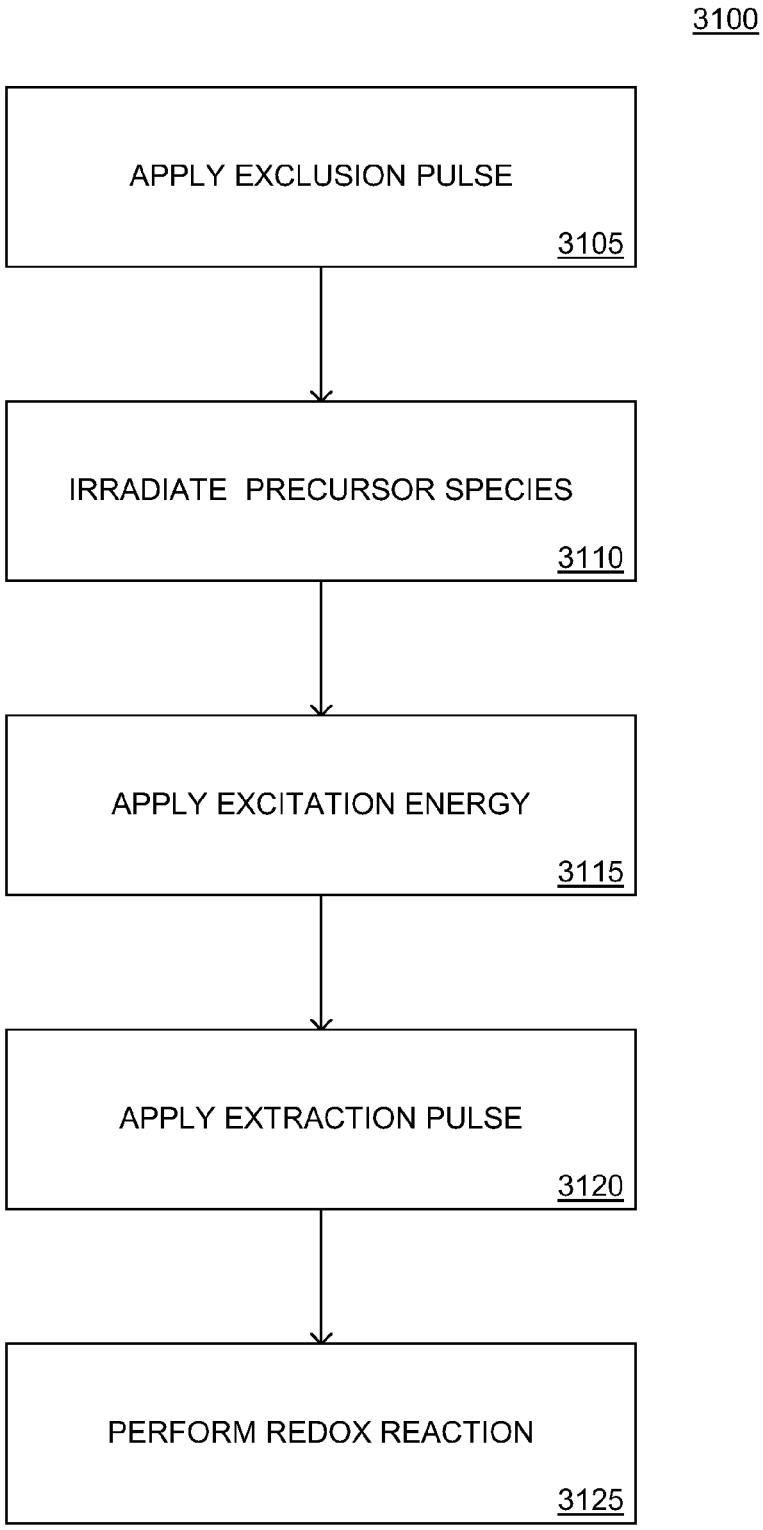
FIG. 31 shows flow diagram for an isotope separation process in accordance with an embodiment of the present invention.

FIG. 31 shows a flow diagram 3100 for an embodiment of an isotope separation process. At step 3105, an exclusion pulse is applied to an electrolytic cell. The exclusion pulse establishes a desired concentration profile for cationic and anionic species within the interphase at an electrode of the electrolytic cell. The potential applied to an electrode is the same as the charge of the species of interest at that electrode. For example, if a cationic species such as a metal cation (e.g., $U^{4+}$ or $Cu^{2+}$) or metal containing complex (e.g. $UO_2^{2+}$) is the species of interest, a positive potential is applied. The applied positive potential decreases the concentration of the species of interest within the interphase. Similarly, if an anionic species such as a metal complex (e.g., $UCl_6^{2-}$ or $UO_2Cl_4^{2-}$) is the species of interest, a negative potential is applied.

The exclusion pulse creates a depletion region through which the species of interest may subsequently be transported to the electrode surface under the influence of an applied potential of opposite potential to that of the exclusion pulse. The products of reactions involving the species of interest may also be subsequently transported to the electrode surface under the influence of an applied potential. The increased separation between the electrode surface and the species of interest provides a greater distance over which mass-dependent transport processes (e.g., electromigration and diffusion) may provide isotope separation.

Conventional centrifuge and diffusion techniques for isotope separation typically rely on the gaseous state and thus have a relatively limited number of compounds that can be used as a working material. In contrast, there are an enormous number of anionic and cationic species that can be prepared using a wide variety of solvents and solutes. Water, aprotic solvents, molten halides, and room temperature ionic liquids are examples of solvents that may be used. Given the wide variety of organic and inorganic liquids, and supercritical fluids that are available for use, a mixture of isotopes of any of the following elements may be prepared as a dissolved ionic species, organometallic compound, or a soluble complex for use in embodiments of the present invention: Li, B, C, Mg, Si, K, Ca, Ti, V, Cr, Fe, Ni, Cu, Zn, Ga, Ge, Se, Rb, Sr, Zr, Mo, Ru, Pd, Ag, Cd, In, Sn, Sb, Te, Ba, La, Ce, Nd, Sm, Eu, Gd, Dy, Er, Yb, Lu, Hf, Ta, W, Re, Os, Ir, Pt. Hg, Tl, Pb, Bi, Po, Th, U, Np, Pu, Am, and Cm.

Room temperature ionic liquids (RTILs) are of particular interest since there are many possible compounds that can be prepared. The selection of cation and anion for a RTIL can take into account the properties desired in an ionic species (e.g., a transition metal or actinide complex). For example, quaternary ammonium salts of the bis(trifluoromethanesulfonyl)imide anion ($N(SO_2CF_3)_2$ (i.e., —$NTf_2$) have been shown to be useful vehicles for redox reactions involving uranium and uranium complexes. A room temperature ionic liquid may be used in combination with salts (e.g., chlorides) that provide additional complexing agents or ligands.

In one embodiment, the exclusion pulse appears across the electrode surfaces as a fixed voltage square wave with a rise time of less than one microsecond and a fall time of less than microsecond, and the applied voltage is a voltage at which no redox reactions occur that involve species other than impurities. In another embodiment, the exclusion pulse appears across the electrode surfaces as a fixed voltage square wave with a rise time of less than 500 nanoseconds and a fall time of less than 500 nanoseconds, and the applied voltage is a voltage at which no redox reactions occur that involve species other than impurities. Further, in each of the aforementioned embodiments the RC time constant of the electrolytic cell associated with the electrodes is greater than 10 microseconds and less than 1000 microseconds.

Cationic or anionic species may be excluded at an electrode. For example, a $UO_2^{2+}$ cationic complex may be excluded at an electrode by applying a positive potential prior to reversing the electrode polarity and carrying out a reduction of the $UO_2^{2+}$ cationic complex. Similarly an anionic trivalent actinide (e.g., $U^{3+}$) complex may be excluded at an electrode by applying a negative potential prior to reversing the potential and carrying out an oxidation of the anionic trivalent actinide complex.

At step 3110, the species of interest is dissociated by the application of an energy pulse. The pulse of energy may be electromagnetic radiation (e.g., with a wavelength between 0.2 microns and 20 microns). The species of interest may be an electrically neutral species such as an organometallic compound, a solvated ion, or a charged complex (e.g., transition metal or actinide complex). The dissociation of the species of interest may result in a radical pair or a radical-ion pair, which may be spin-correlated. The radical pair or radical-ion pair may be a triplet pair or may be a singlet pair.

For gaseous atoms or free ions, distinct differences in optical absorption may exist between isotopes. However, in solutions the differences are less distinct due to the effects of the solution environment. A monochromatic or narrow-band light source may be used to produce a small preferential dissociation for a species containing a particular isotope. This preferential dissociation may contribute to an overall isotope separation process that employs the mass isotope effect or the magnetic isotope effect.

An anionic complex may be dissociated to produce an anion-cation pair or a neutral-anion pair. Similarly, a cationic complex may be dissociated to produce an anion-cation pair or a neutral-cation pair. A pair produced by dissociation may also be further dissociated to form another pair through multi-photon absorption. Pair formation may involve electron transfer with other adjacent species (e.g., photoreduction).

At step 3115, magnetic excitation is applied. The excitation may be applied by a DC magnetic field, an alternating magnetic field, or a combination of a DC magnetic field and an alternating magnetic field. A DC magnetic field may be applied to modify the spin evolution of species formed in step 3110. The Ag mechanism (AgM), hyperfine coupling mechanism (HFCM), and the level crossing mechanism (LCM) are examples of mechanisms that can be modified by a DC magnetic field to control differential spin conversion of isotope containing radical pairs or radical-ion pairs. An alternating magnetic field may also be used to induce differential level transitions in the electron and nuclear spins of isotope containing species. The alternating magnetic field may have a frequency in the range of 100 kHz to 100 GHz. Although the energy differences involved in spin conversion may be small in comparison to the thermodynamic energies associated with chemical reactions, they may have a significant impact on chemical reaction rates.

Excitation by an alternating magnetic field or a combination of an alternating magnetic field and a DC magnetic field may be used to alter the relative recombination or reaction rates of magnetic and nonmagnetic isotope containing pairs. The alteration of recombination or reaction rates may include accelerating or retarding a reaction rate. The excitation may be used to produce a transient population of cationic or anionic species having an enhanced concentration of a magnetic or nonmagnetic isotope. Although not as great as the differences between magnetic and nonmagnetic isotopes, the difference in magnetic moment between magnetic isotopes of the same element (e.g., $^{63}Cu$ and $^{65}Cu$) may also be used as a basis for transient fractionation through magnetic excitation.

Transient fractionation produced by managed differences in nuclear spin and magnetic moment may be used to produce an isotopically enhanced population near the surface of an electrode that may be converted to stable species through redox reactions at the electrode surface. In addition to the enhancement of the recombination and/or reaction of magnetic isotopic species to produce such a population, magnetic excitation (e.g., spin inversion) may be used to provide a relative enhancement of recombination and/or reaction of nonmagnetic isotopic species with respect to magnetic isotopic species to create the population.

Reversible photoreduction of uranyl ($UO_2^{2+}$) to uranoyl ($UO_2^{+}$) in the presence of an appropriate electron donor provides a method for transient fractionation that relies on magnetically enhanced reoxidation of $^{235}UO_2^{+}$ to $^{235}UO_2^{2+}$ to provide a $^{235}U$ enhanced population of $UO_2^{2+}$ that may be attracted to an electrode with a greater velocity than the $^{238}U$ enriched $UO_2^{+}$. As with other photolytic transient fractionation processes that rely on differential recombination to reproduce a starting species, it is desirable to have a high quantum yield for the initial reaction.

At step 3120, a potential is applied to the electrolytic cell to extract cationic or anionic species. The population of cationic or anionic species attracted to the electrode may or may not have been produced by step 3105 and/or step 3110. In the absence of step 3105 and 3110, the mass isotope effect will be the primary effect in providing isotope separation. As the ionic species migrate toward the electrode, the lighter isotope will do so with a greater velocity, causing the initial contact population on the electrode surface to be enriched in the lighter isotope.

The applied potential waveform may correspond to the ($V_1$, $t_1$) and/or ($V_2$, $t_2$) segments shown in FIG. 14. In one embodiment, the attraction pulse results in a current peak of at least 20 amperes and appears across the electrode surfaces as one or more fixed voltage square waves, with each having a rise time of less than 500 nanoseconds and a fall time of less than 500 nanoseconds. In another embodiment, the attraction pulse results in a current peak of at least 50 amperes and is applied across the electrode surfaces as one or more fixed voltage square waves, with each having a rise time of less than 100 nanoseconds and a fall time of less than 100 nanoseconds. Further, in each of the aforementioned embodiments the RC time constant of the electrolytic cell associated with the electrodes is greater than 10 microseconds and less than 1000 microseconds.

Transient isotope fractionation provided by step 3105 and/or step 3110 may be used to produce a population of cation/neutral pairs from a cationic complex, with the difference in mass between the cationic complex and the cation pair component being considerably greater than the isotope mass difference. For example, accelerated recombination of a $^{235}U$ containing pair will produce a population of lighter unrecombined cations that is enriched in $^{238}U$. Since most neutral species (e.g., solvent molecules) will have a mass that is considerably greater than the 3 atomic mass unit difference between $^{235}U$ and $^{238}U$, the total isotope fractionation at the electrode surface will be a combination of initial population isotope fractionation through the magnetic isotope effect combined with an enhanced mass isotope effect during migration. Although all cationic species will respond to the electrode potential, the $^{238}U$ containing species will be greater in number and faster than the $^{235}U$ containing species.

In another embodiment, transient isotope fractionation between magnetic and nonmagnetic isotopes is provided by step 3105 and/or step 3110 to produce a population of cation/anion pairs from an anionic complex. Due to enhanced recombination and/or reaction of magnetic cations (e.g., $^{235}U$ containing cations) to form anionic complexes, the unrecombined cation population will be rich in nonmagnetic (e.g., $^{238}U$ containing cations). Under the influence of a negative potential at the electrode surface, the $^{235}U$ rich population of anionic complexes will tend to be excluded from the electrode surface as the $^{238}U$ rich cation complexes are attracted to the electrode surface.

Upon application of an extraction pulse, both diffusion and migration within the applied electric field may drive mass transport to the electrode. It is desirable that the transport time to the electrode surface be shorter than the lifetime of transient species of interest. The mean distance to the electrode may be decreased by increasing the concentration of ionic species, and the transport velocity may be increased by reducing the electrolyte viscosity. The magnitude of the exclusion potential applied in step 3105 may be reduced to decrease the mean distance to the electrode.

At step 3125, charge transfer between the electrode and species attracted to the electrode surface during step 3120 occurs and an oxidation or a reduction is carried out. The oxidation or reduction reaction may be partial or complete. For example, a $Cu^{2+}$ cation may be reduced to $Cu^{+}$ or it may be reduced to Cu metal. Reduction may be carried out at a solid or liquid electrode surface. The charge involved in the reaction may be provided by the attraction pulse applied in step 3120.

Figure 32A:
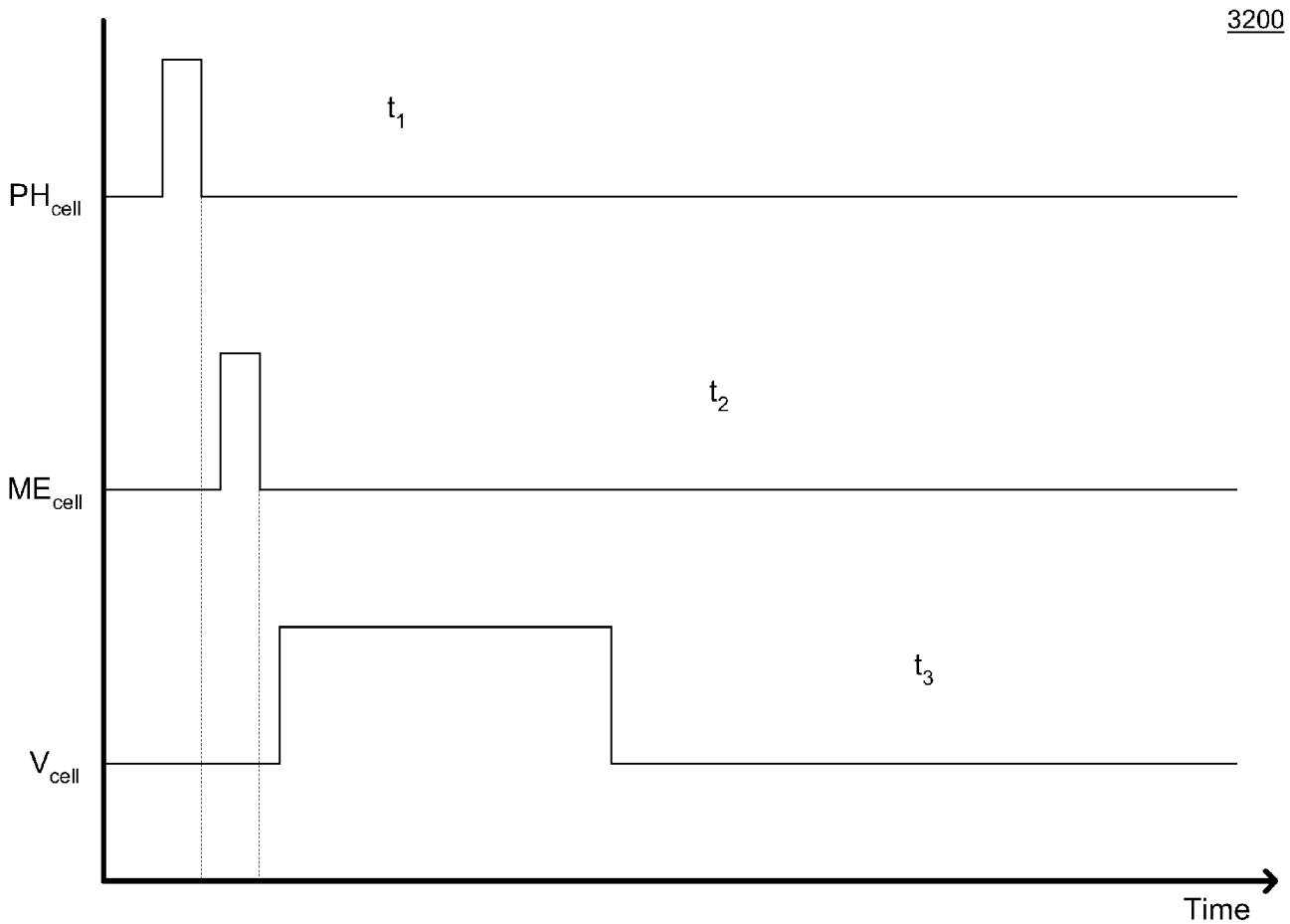
FIG. 32A shows a timing diagram for an isotope separation process with non-overlapping pulses and a simple extraction pulse in accordance with an embodiment of the present invention.

FIG. 32A shows a timing diagram 3200 for an embodiment of an isotope separation process with non-overlapping pulses and a simple extraction pulse. A photolytic energy waveform $PH_{cell}$ is applied for a period $t_1$. Subsequent to the application of waveform $PH_{cell}$, a magnetic excitation waveform $ME_{cell}$ is applied with a period $t_2$. Following the application of waveform $ME_{cell}$, an extraction pulse $V_{cell}$ is applied for a period $t_3$. In an embodiment, $t_1$ is less than one microsecond, $t_2$ is less than one microsecond, and $t_3$ is less than 10 microseconds. Non-overlapping pulses are generally preferred for a sequence in which a precursor is dissociated then subjected to differentially enhanced recombination to produce isotope fractionation, then extracted to the electrode for a redox reaction.

Figure 32B:
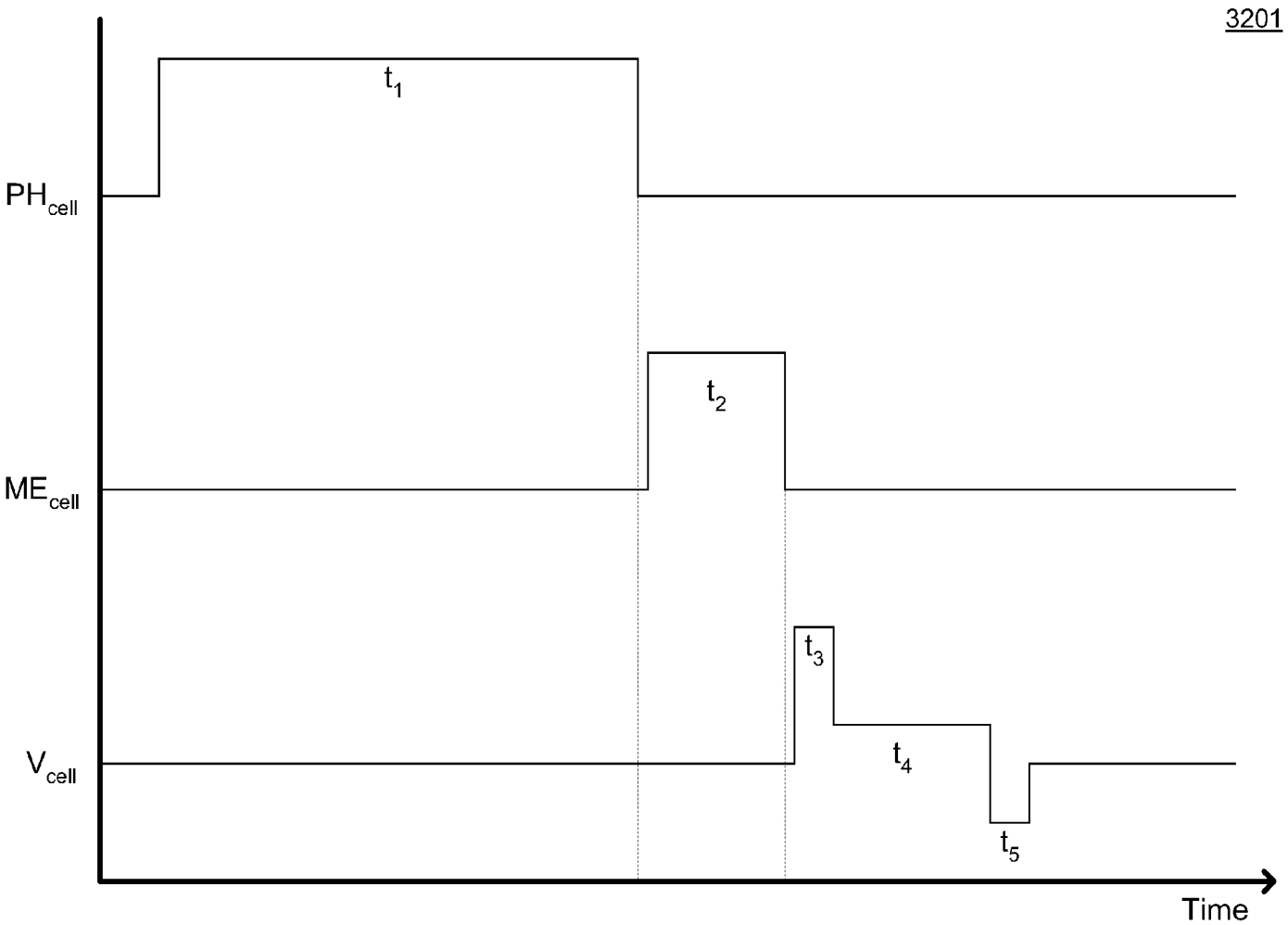
FIG. 32B shows a timing diagram for an isotope separation process with non-overlapping pulses and a complex extraction pulse in accordance with an embodiment of the present invention.

FIG. 32B shows a timing diagram 3201 for an embodiment of an isotope separation process with non-overlapping pulses similar to that shown in FIG. 32A, except that the simple extraction pulse with a period $t_3$ has been replaced with a complex extraction pulse similar to that shown in FIG. 14, having period segments $t_3$, $t_4$, and $t_5$. The complex pulse is preferred for electrolytic cells with a large RC time constant (e.g., greater than 10 microseconds), and an extraction species with a short lifetime (e.g., less than 10 microseconds).

Figure 32C:
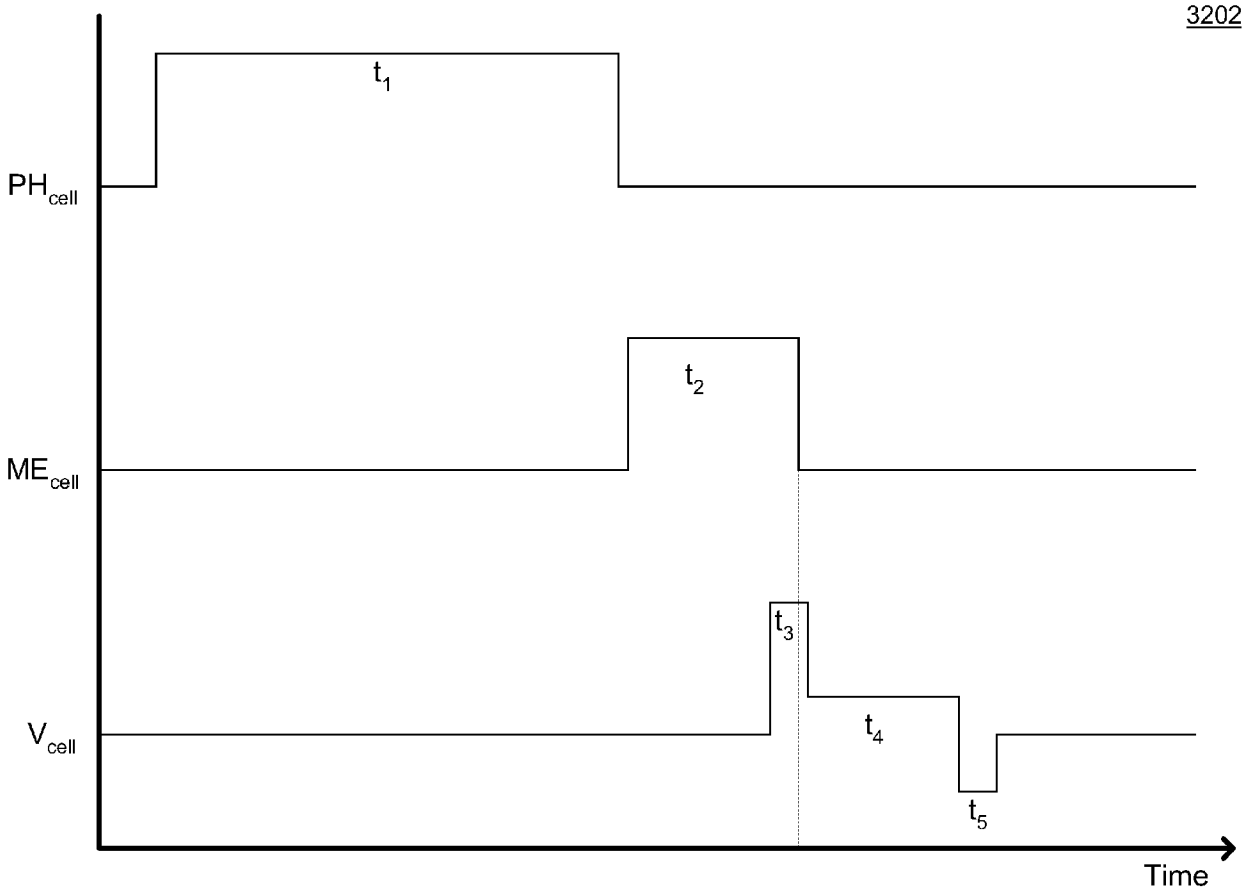
FIG. 32C shows a timing diagram for an isotope separation process with overlapping magnetic excitation and extraction pulses in accordance with an embodiment of the present invention.

FIG. 32C shows a timing diagram 3202 for an embodiment of an isotope separation process with a magnetic excitation $ME_{cell}$ pulse that overlaps an extraction $V_{cell}$ pulse. Overlapping excitation and extraction pulses may be used in a process in which magnetic excitation is used to inhibit recombination or reaction (e.g., spin locking), and thus maintain fractionation during extraction.

Figure 32D:
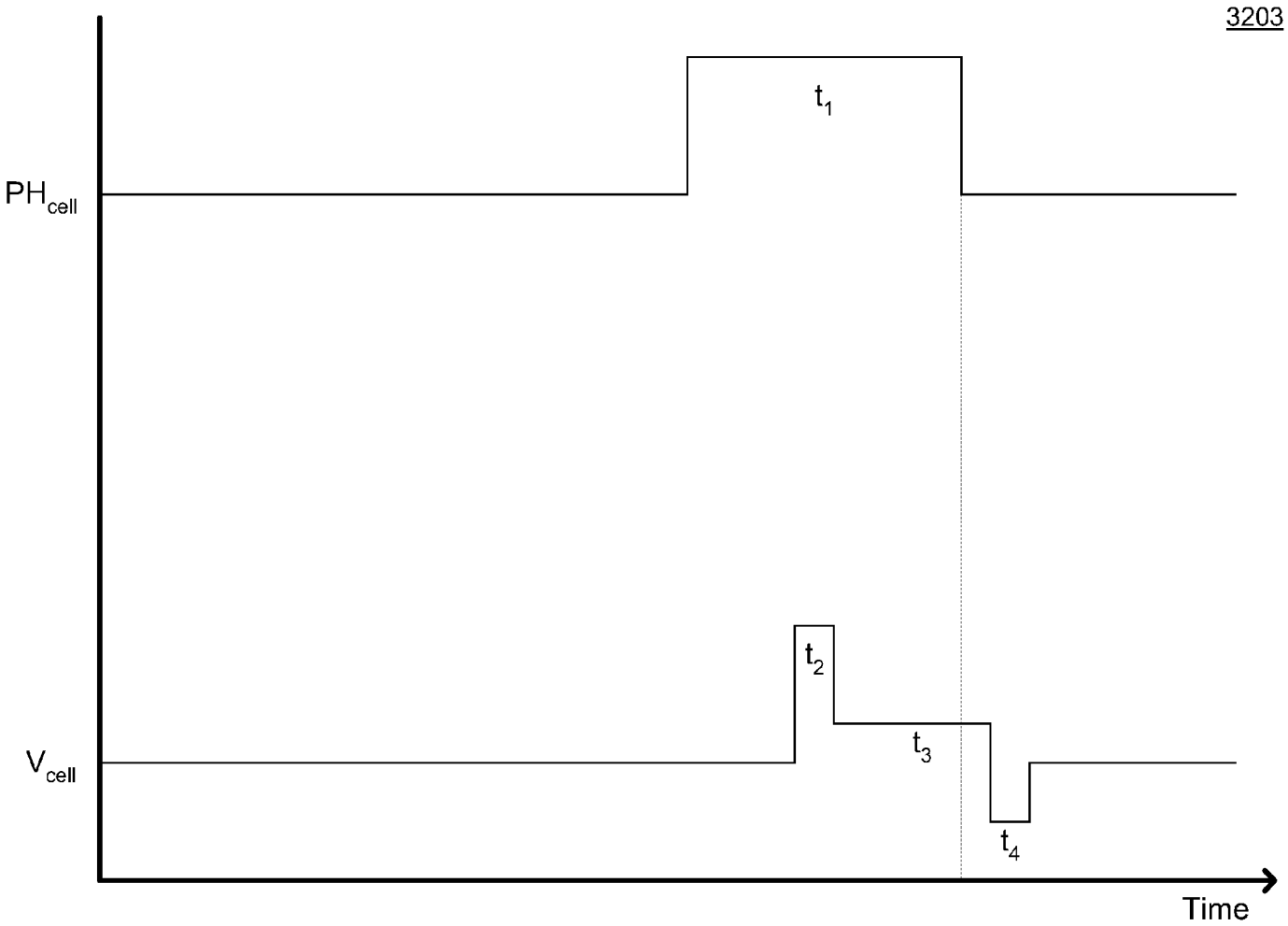
FIG. 32D shows a timing diagram for an isotope separation process with overlapping photolytic and extraction pulses in accordance with an embodiment of the present invention.

FIG. 32D shows a timing diagram 3203 for an embodiment of an isotope separation process with overlapping photolytic $PH_{cell}$ and extraction $V_{cell}$ pulses. Overlapping photolytic and extraction process may be used in a process in which a degree of fractionation is achieved through photolysis and augmented by a mass isotope effect during transport to the electrode.

While the invention has been described in detail with reference to preferred embodiments thereof, it will be apparent to one skilled in the art that various changes can be made, and equivalents employed, without departing from the scope of the invention. For example, embodiments of the invention may include all of the steps shown in FIG. 31, or may omit one or more of the disclosed steps (e.g., application of an exclusion pulse). Various embodiments of power supplies, bus transmission lines, transmission line electrodes and electrode surfaces have been disclosed. Within the scope of the invention, combinations of the aforementioned disclosed components other than those combinations explicitly disclosed may be used in a system for electrolytic isotope separation. For example, structures disclosed herein may be adapted to provide a coaxial transmission line duct with magnetic excitation, an electrolytic pulse power supply, and a switchable shunt.

What is claimed:

1. A system for isotope selective electrolysis comprising:
- an electrolytic cell having at least two electrodes comprising an anode and a cathode in contact with a flowing electrolyte;
- a magnet for producing a static magnetic field that is essentially perpendicular to a surface of said anode or said cathode that is in contact with said flowing electrolyte; and,
- an electric circuit for producing an alternating magnetic field that is essentially perpendicular to said static magnetic field at said surface.

2. The system of claim 1, wherein said cathode comprises carbon.

3. The system of claim 1, wherein said alternating magnetic field has a frequency between 100 kHz and 100 GHz.

4. The system of claim 1, wherein said electric circuit is a resonant circuit.

5. The system of claim 4, wherein said resonant circuit is tuned to a frequency for producing a microwave-induced magnetic isotope effect (MIMIE) in a species present in said flowing electrolyte.

6. The system of claim 1, wherein said electric circuit includes one of said at least two electrodes.

7. The system of claim 6, wherein said electric circuit includes said cathode.

8. A system for isotope selective electrolysis comprising:
- an electrolytic cell having at least two electrodes comprising an anode and a cathode in contact with a flowing electrolyte;
- a magnet for producing a static magnetic field that is essentially perpendicular to a surface of said anode or said cathode that is in contact with said flowing electrolyte; and,
- a solenoid for producing an alternating magnetic field that is essentially perpendicular to said static magnetic field at said surface.

9. The system of claim 8, wherein said cathode comprises carbon.

10. The system of claim 8, wherein said cathode is disposed within said solenoid.

11. The system of claim 8, wherein said solenoid is part of a resonant circuit.

12. The system of claim 11, wherein said resonant circuit is tuned to a frequency for producing a microwave-induced magnetic isotope effect (MIMIE) in a species present in said flowing electrolyte.

13. The system of claim 8, wherein said solenoid is a single turn solenoid.

14. The system of claim 8, further comprising a photon source for irradiating said flowing electrolyte.

15. A method for isotope selective electrolysis comprising:
- flowing an electrolyte over an electrode surface in an electrolytic cell;
- applying a static magnetic field that is essentially perpendicular to said electrode surface;
- using a current flowing in a circuit to produce an alternating magnetic field perpendicular to said static magnetic field at said electrode surface, thereby inducing spin level transitions in a species in said flowing electrolyte; and
- applying an electric potential to said electrolytic cell to produce an electrolytic reaction at said electrode surface.

16. The method of claim 15, wherein said electrolytic reaction comprises reducing a cationic species.

17. The method of claim 16, further comprising absorbing a reduced species into a liquid metal cathode.

18. The method of claim 15, wherein said inducing spin level transitions in a species in said flowing electrolyte further comprises spin locking a species in said flowing electrolyte.

19. The method of claim 15, further comprising irradiating said flowing electrolyte with electromagnetic radiation.

20. The method of claim 15, wherein said electric potential is a DC potential applied concurrently with said static magnetic field and said alternating magnetic field.

* * * * *